US005318121A

United States Patent [19]

Brockman et al.

[11] Patent Number: 5,318,121

[45] Date of Patent: Jun. 7, 1994

[54] METHOD AND APPARATUS FOR LOCATING AND RE-ENTERING ONE OR MORE HORIZONTAL WELLS USING WHIPSTOCK WITH SEALABLE BORES

[75] Inventors: Mark W. Brockman, Cypress; L. Cameron White, Houston; Douglas J. Murray, Humble, all of Tex.; Robert J. McNair, Aerdenhout, Netherlands; Jeffrey D. Cockrell, Pearland, Tex.

[73] Assignee: Baker Hughes Incorporated, Houston, Tex.

[21] Appl. No.: 927,567

[22] Filed: Aug. 7, 1992

[51] Int. Cl.[5] ..... E21B 43/14

[52] U.S. Cl. ..... 166/313; 166/50; 166/117.6

[58] Field of Search ..... 166/313, 384, 50, 117.5, 166/117.6

[56] References Cited

U.S. PATENT DOCUMENTS

| | | | |
|---|---|---|---|
| 2,397,070 | 3/1946 | Zublin . | |
| 2,452,920 | 11/1948 | Gilbert . | |
| 2,797,893 | 7/1957 | McCune et al. | 166/50 X |
| 2,858,107 | 10/1958 | Colmerauer . | |
| 3,330,349 | 7/1967 | Owsley et al. . | |
| 4,396,075 | 8/1983 | Wood et al. . | |
| 4,402,551 | 9/1983 | Wood et al. . | |
| 4,415,205 | 11/1983 | Rehm et al. | 166/50 X |
| 4,436,165 | 3/1984 | Emery | 166/50 X |
| 4,444,276 | 4/1984 | Peterson, Jr. . | |
| 4,515,213 | 5/1985 | Rogen et al. . | |
| 4,573,541 | 4/1986 | Josse et al. . | |
| 4,807,704 | 2/1989 | Hsu et al. | 166/313 |
| 5,113,938 | 5/1992 | Clayton | 166/117.6 |
| 5,115,872 | 5/1992 | Brunet et al. | 166/50 X |

OTHER PUBLICATIONS

"Arco drill horizontal drainhole" Moore III; Sep. 1990.

L. McDonald Schetky, Shape-Memory Alloys, Nov. 1979, Scientific American, pp. 1-10.

G-F. Fuh and P. K. Loose, Horizontal Wellbore Stability for Openhole Completions, 1969, Society of Petroleum Engineers, pp. 155-164.

U. Ahmed and S. Jacobsen, Schlumberger, Practical Aspects of Horizontal Well Technology: A Perspective, 1990, Society of Petroleum Engineers, pp. 1-16.

H. Karlsson, R. Cobbley, and G. E. Jacques, New Developments in Short-, Medium-, and Long-Radius Lateral Drilling, 1989, SPE/IADC, p. 725.

A. Damgaard, S. D. Bangert, D. J. Murray, R. P. Rubbo and G. W. Stout, A Unique Method for Perforating, Fracturing and Completing Horizontal Wells, 1989, Society of Petroleum Engineers, pp. 1-13.

Sid B. Nice, Leading Edge Logging, (unknown), Popular Horizontal, p. 4.

Derry D. Sparlin, Raymond W. Hagen, Jr., Controlling Sand in a Horizontal Completion, Nov. 1988, World Oil, pp. 54-58.

D. Ackert et al, Looking Sideways for Oil, (unknown), The Technical Review, pp. 22-31.

Dr. S. D. Joshi, Proper Completion Critical for Horizontal Wells, Jan. 1990, Joshi Technologies International, Inc., pp. 1-4.

E. Brown, R. Thomas and A. Milne, The Challenge of Completing and Stimulating Horizontal Wells, (unknown), Oilfield Review, pp. 54-63.

(List continued on next page.)

*Primary Examiner*—William P. Neuder

*Attorney, Agent, or Firm*—Fishman, Dionne & Cantor

[57] ABSTRACT

In accordance with the present invention, a plurality of methods and devices are provided for solving important and serious problems posed by lateral (and especially multilateral) completion including methods and devices for re-entering selected lateral wells to perform completions work, additional drilling, or remedial and stimulation work. Various methods and devices are provided for assisting in the location and re-entry of lateral wells. Such re-entry devices include permanent or retrievable deflector (e.g., whipstock) devices. Preferably, the re-entry methods of this invention permit the bore size of the lateral wells to be the same or substantially the same bore size as the vertical wells.

32 Claims, 34 Drawing Sheets

OTHER PUBLICATIONS

Sid B. Nice, Leading Edge Logging—Well Logging and Completion Technology for Horizontal Wellbores, Jan./Mar. 1991, Popular Horizontal, pp. 4–13.
Rainer Jurgens, Ron Bitto, Bruce Henderson, Cameron White and Gus Mullins, Horizontal Drilling and Completions: A Review of Available Technology—Medium- and Long-Radius Horizontal Drilling, Mar. 1991, Petroleum Engineer International, pp. 32–37.
Rainer Jurgens, Ron Bitto, Bruce Henderson, Cameron White and Gus Mullins, Horizontal Drilling and Completions: A Review of Available Technology—Short- and Medium-Radius Horizontal Drilling, Feb. 1991, Petroleum Engineer International, pp. 14–21.
M. F. Cooney, T. Rogers and R. N. Stephens, Case History of an Opposed-Bore, Dual Horizontal Well in the Austin Chalk Formation" of South Texas, 1991, SPE/IADC, pp. 737–748.
Stephen A. Graham, Charles E. Graham II & Associates, Inc., Bruce Henderson and Greg Nazzal, Drilling a Dual-Bore Horizontal Well in the Austin Chalk: A Case History, (unknown), The American Society of Mechanical Engineers, pp. 1–9.
Cameron White and Mark Hopmann, Controlling Flow in Horizontal Wells, Nov. 1991, Production '91, pp. 1–6.
T. K. Li, V. Chandelle, and J. Brych, Lateral Drilling: A New Application Shows Promise, Jun. 1986, World Oil, pp. 68–71.
R. H. Reiley, J. W. Black, T. O. Stagg, D. A. Walters and G. R. Atol, Improving Liner Cementing in High--Angle/Horizontal Wells, Jul. 1988, World Oil, pp. 69, 71–74.
Ray H. Holifield and Bill Rehm, Recompletion by Horizontal Drilling Pays Off, Mar. 1989, World Oil, pp. 42, 43 and 50.
Denny Kerr, How to Drill a Smooth Medium-Radius Well, Mar. 1990, World Oil, pp. 46–47.
R. C. Haas and C. O. Stokley, Drilling and Completing a Horizontal Well in Fractured Carbonate, Oct. 1989, World Oil, pp. 39, 40, 42, 44 and 45.
Bernhard Prevedel, Case History: How One Operator Drilled Horizontally Through a Salt Dome, Dec. 1985, World Oil, pp. 69, 73, 76 and 80.
Chris Zimmerman and Donny Winslow, How to Select the Right Tools for Stimulating Horizontal Wells, Nov. 1989, World Oil, pp. 53–56.
Mohamed Soliman, Bob Rose, Wadood El Rabaa and James L. Hunt, Planning Hydraulically Fractured Horizontal Completion, Sep. 1989, World Oil, pp. 54–56 and 58.
Robert D. Grace and Mike Pippin, Downhole Fires Furing Air Drilling: Causes and Cures, May 1989, World Oil, pp. 42–44.
H. Delafon, BHA Prediction Software Improves Directional drilling, Apr. 1989, World Oil, pp. 51–56 and 60.
Haraldur Karlsson and Ron Bitto, Worldwide Experience Shows Horizontal Well Success, Mar. 1989, World Oil, pp. 51–54 and 56.
H. Delafon, BHA Prediction Software Improves Directional Drilling, Mar. 1989, World Oil, pp. 45-48 and 50.
Michael J. Economides, John D. McLennan, Ernest Brown and Jean-Claude Roegiers, Performance and Stimulation of Horizontal Wells, Jul. 1989, World Oil, pp. 69–72, 76 and 77.
Jean-Francois Giannesini, Horizontal Drilling is Becoming Commonplace: Here's How It's Done, Mar. 1989, World Oil, pp. 35–38 and 40.
William King, Selecting Bits for Extended Reach and Horizontal Wells, Apr. 1990, World Oil, pp. 53, 55, 57, 59 and 60.
Hanette Kuich, Seismic and Horizontal Drilling Unlock Austin Chalk, Sep. 1990, World Oil, pp. 47, 48, 50, 52 and 54.
Jim D. Fultz and Fred J. Pittard, Bottomhole System Works Completes Horizontal Wells, Mar. 1990, World Oil, pp. 48–50.
T. O. Stagg and R. H. Relly, Horizontal Well Completions in Alaska, Mar. 1990, World Oil pp. 37–44.
Denny Kerr, Designing Tangent Sections for Medium-Radius Horizontal Wells, Mar. 1991, World Oil, pp. 45–47.
Dr. A. S. Picovi, Lic L. Guasaviono, Dr. A. Pozzo and Eng. J. A. Musmarra, Comparing Cost and Performance of Horizontal Wells, Mar. 1991, World Oil, pp. 39, 40, 42≧44.
S. B. Nice and W. H. Fertl, Logging, Compleing Extended-Reach and Horizontal Wells, Mar. 1991, World Oil, pp. 49, 50, 52, 53, 55 and 56.
D. R. Holbert, New Interest in Drainhole Drilling Revives Technology, Mar. 1981, World Oil, pp. 57, 58, 61, 62, 64, 66, 70 and 72.

(List continued on next page.)

OTHER PUBLICATIONS

Larry E. Pendleton and A. Behrooz Ramesh, Bechtel Develops Innovative Method for Horizontal Drilling, May 27, 1985, Oil & Gas Journal, pp. 95-99.
Anthony W. Gorody, Tedsi Develops Horizontal Drilling Technology, Oct. 1, 1984, Oil & Gas Journal, pp. 118, 120, 125 and 126.
Les Shane, Downhole Motor Specifically Designed for Directional Air Drilling, Feb. 3, 1992, Oil & Gas Journal, pp. 45-49.
Douglas Gust, Horizontal Drilling Evolving from Art to Science, Jul. 24, 1989, Oil & Gas Journal, pp. 43-46 and 49-52.
Theodore E. Zaleksi Jr., and Jefferson P. Ashton, Gravel Packing Feasible in Horizontal Well Completions, Jun. 11, 1990, Oil & Gas Journal, pp. 33-37.
Guntis Moritis, Horizontal Drilling Technology Keeps Advancing, Mar. 11, 1991, Oil & Gas Journal, pp. 49-54.
James A. Dech, David D. Hearn, Frank J. Schuh and Bob Lenhart, New Tools Allow Medium-Radius Horizontal Drilling, Jul. 14, 1986, Oil & Gas Journal, pp. 95-99.
Floyd Harvey, Fluid Program Built Around Hole Cleaning, Protecting Formation Nov. 5, 1990, Oil & Gas Journal, pp. 37-41.
Guy Feneyrou, French Three-Leg Multidrain Well Improves Production, Oct. 1, 1984, Oil & Gas Journal, pp. 126-127.
Kevin T. Corbett and Rapier Dawson, Drillstring Design for Directional Wells, Apr. 30, 1984, Oil & Gas Journal, pp. 61-66.
Glen Tolle and Thomas Dellinger, Mobil Identifies Extended-Reach-Drilling Advantages, Possibilities in North Sea, May 26, 1986, Oil & Gas Journal, pp. 78-8-1-86.
Alain Spreux, Christain Georges and Jacques Cessi, Most Problems in Horizontal Completions are Resolved, Jun. 13, 1988, Oil & Gas Journal, pp. 48-52.
Cameron White, Formation Characteristics Dictate Completion Design, Dec. 3, 1990, Oil & Gas Journal, pp. 58-62 and 64.
Warren Jones, Unusual Stresses Require Attention to Bit Selection, Oct. 22, 1990, Oil & Gas Journal, pp. 81-85.
Guntis Moritis, Horizontal Drilling Scores More Successes, Feb. 26, 1990, Oil & Gas Journal, pp. 53, 54, 58, 60-64.
Ron Matson and Rod Bennett, Cementing Horizontal Holes Becoming More Common, Dec. 17, 1990, Oil & Gas Journal, pp. 40-46.
Andrew Gallup, B. L. Wilson and Robert Marshall, ESP's Placed in Horizontal Lateral Increase Production, Jun. 18, 1990, Oil & Gas Journal, pp. 58-60, 62 and 63.
Carl W. Stan, Alternative Electronic Logging Technique Locates Fractures in Austin Chaulk Horizontal Well, Nov. 6, 1989, Oil & Gas Journal, pp. 42-45.
D. D. Cramer, Guides Exist for Fracture Treatment in Horizontal Wells, Mar. 27, 1989, Oil & Gas Journal, pp. 41, 44, 46, 48 and 49.
Stephen A. Graham and Greg Nazzal, Second Lateral in Horizontal Well Solves Water Problem, Mar. 18, 1991, Oil & Gas Journal, pp. 111-114.
Richard S. Carden, Air Drilling has Some Pluses for Horizontal Wells, Apr. 8, 1991, Oil & Gas Journal, pp. 76-78.
Jiang Wu and Hans C. Juvkam-Wold, Drag and Torque Calculations for Horizontal Wells Simplified for Field Use, Apr. 29, 1991, Oil & Gas Journal, pp. 49-53 and 56.
Kenneth B. Gunn, Well Cored to 9,800 Ft in Paraguay, May 13, 1991, Oil & Gas Journal, pp. 51-55.
E. P. Deliac, J. P. Messines and B. A. Thierree, Mining Technique Finds Applications in Oil Exploration, May 6, 1991, Oil & Gas Journal, pp. 85-86, 88 and 90.
Siegfried K. Schueler, Horizontal Well Improves Recovery in Deep Sour Gas Field, Mar. 23, 1992, Oil & Gas Journal, pp. 93-94, 96 and 97.
Wade Dickinson, Eric Dickinson, Herman Dykstra and John M. Nees, Horizontal Radials Enhance Oil Production from a Thermal Project, May 4, 1992, Oil & Gas Journal, pp. 116, 118, 120, 122-124.
D. R. Schroeter and H. W. Chan, Successful Application of Drilling Technology Extends Directional Capability, Sep. 1989, SPE Drilling Engineer, pp. 230-236.
T. M. Gaynor, Downhole Control of Deviation with Steerable Straight-Hole Turbodrills, Mar. 1988, SPE Drilling Engineer, pp. 50-56.
W. Dickinson, R. R. Anderson and D. W. Dickinson, The Ultrashort-Radius Radial System, Sep. 1989, SPE Drilling Engineer, pp. 247-254.

(List continued on next page.)

OTHER PUBLICATIONS

M. A. Wilson and F. L. Sabins, A Laboratory Investigation of Cementing Horizontal Wells, Sep. 1988, SPE Drilling Engineer, pp. 275, 278 and 280.

H. J. Vrlellnk and A. M. Hippman, The Optimization of Slant-Well Drilling in the Lindbergh Field, Dec. 1989, SPE Drilling Engineer, pp. 307-314.

P. Hardman, Beckingham 36 Horizontal Well, Mar. 1989, SPE Drilling Engineer, pp. 17-23.

D. B. Chritain, Planning and Operational Requirements for a Shallow-Objective, High-Angle Well in the Gulf of Mexico, Sep. 1988, SPE Drilling Engineer, pp. 241-247.

(Unknown), Reservoir Selection for Horizontal Wells, (unknown), Western International, pp. 1-8.

(Unknown), Cementing of Horizontal Wells, (unknown), Western International, pp. 9-14.

(Unknown), Matriz Stimulation of Horizontal Wells, (unknown), Western International, pp. 15-21.

(Unknown), Fracturing of Horizontal Wells, (unknown), Western International, pp. 23-30.

(Unknown), Horizontal Well Case Histories, (unknown), Western International, pp. 31-37.

J. P. Wilkinson, J. H. Smith, T. O. Stagg, and D. A. Walters, Horizontal Drilling Techniques at Prudhoe Bay, Alaska, 1980, Society of Petroleum Engineers, pp. 1-12.

William J. Lang and Marion B. Jett, High Expectations for Horizontal Drilling Becoming Reality, Sep. 24, 1990, Oil & Gas Journal, pp. 70 72 74, 76 and 79.

Ron Matson and Rod Bennett, Cementing Horizontal Holes Becoming More Common, Dec. 17, 1990, Oil & Gas Journal, pp. 40-45.

Gavin Clark, Piyush Shah, Bruno Deruyck, D. K. Gupta and S. K. Sharma, Horizontal Well Testing in India, Schlumberger Oil Field Review; Schlumberger Technical Review, pp. 64-67.

Peter Betts, Curt Blount, Bill Broman, Brian Clark, Larry Hibbard, Alain Louis and Paul Oosthoek, Acquiring and Interpreting Logs in Horizontal Wells, Schlumberger Oil Field Review; Schlumberger Technical Review, pp. 34-51.

Trevor Burgess and Patrick Van de Slijke, Horizontal Drilling Comes of Age, Schlumberger Oil Field Review-Schlumber Technical Review, pp. 22-33.

(Unknown), Drilling Fluids for Horizontal Wells, Schlumberger Oil Field Review; Schlumberger Technical Review, pp., 8-10.

Svend Aagne Andersen, Joun M. Conlin, Kjeld Fjeldgaard and Svend Aage Hansen, Exploiting Reservoirs with Horizontal Wells: The Maersk Experience, Schlumberger Oil Field Review-Schlumberger Technical Review, pp. 11-21.

Jiang Wu, Pin Chen and Hans C. Juvkam-Wold, Casing Centralization—Centralization of Casing in Horizontal Wells, Apr./Jun. 1991, Popular Horizontal, pp. 14-16, 18-21.

T. E. Zaleski Jr., Sand-Control Alternatives for Horizontal Wells, May 1991, JPT, pp. 509-511.

M. Y. Soliman, James L. Hunt and A. M. El Rabaa, Fracturing Aspects of Horizontal Wells, Aug. 1990, JPT, pp. 966-973.

R. A. Skopec, M. M. Mann, D. Jeffers and S. P. Grier, Horizontal Core Acquisition and Orientation for Formation Evaluation, 1990, Society of Petroleum Engineers, pp. 153-166.

Giin-Fa Fuh, E. G. Dew, C. A. Ramsey and K. Collins, Borehole Stability Analysis for the Design of First Horizontal Well Drilled in the U.K.'s Southern 'V' Fields, 1990, Society of Petroleum Enginners, pp. 31-42.

C. D. Pope and P. J. Handren, Completion Techniques for Horizontal Wells in the Pearsall Austin Chalk, 1990, Society of Petroleum Engineers, pp. 657-664.

F. R. Myal and K-H. Frohne, Slant-Hole Completion Test in the Piceance Basin, Colo., 1991, Society of Petroleum Engineers, pp. 611-622.

R. C. Leaf and F. J. Pittard, A Review of Horizontal Methods and Drilling Technology, 1991, Society of Petroleum Engineers, pp. 575-584.

D. J. Hall, J. L. Walker, E. G. Schmelzl and T. B. Haene, Logging and Perforating of Horizontal Wells: An Innovative Approach, 1991, Society of Petroleum Engineers, pp. 307-316.

T. P. Frick, M. J. Economides and Mining U. Leoben, Horizontal Well Damage Characterization and Removal. 1991, Society of Petroleum Engineers, pp. 429-438.

O. L. A. Santos, Important Aspects of Well Control for Horizontal Drilling Including Deepwater Situations, 1991, SPE/IADC, pp. 785-796.

S. B. Claytor, K. J. Manning and D. L. Schmalzried, (List continued on next page.)

OTHER PUBLICATIONS

Drilling a Medium-Radius Horizontal Well with Aerated Drilling Fluid: A Case Study, 1991, SPE/IADC, pp. 759-773.

John F. Greenip Jr., How to Design Casing Strings for Horizontal Wells, Dec. 1989, Petroleum Engineer, pp. 34-38.

Steven D. Moore, Meridian Oil Finds Success with Horizontal Wells, Nov. 1989, Petroleum Engineer, pp. 17-20 and 22.

Tony Beckett, Test Off Philippines Boosts Horizontal Drilling Technology, Nov. 1989, Petroleum Engineer, pp. 24-26.

G. Norel, C. Dubois and G. Georges, Test Bench Checks Cement in Horizontal Holes, Nov. 1988, Petroleum Engineer, pp. 54-59.

Christian Mariotti and Evelyne Kou, Elf Improves Horizontal Drilling at Rospo Mare, Aug. 1988, Petroleum Engineer, pp. 30, 32 and 35.

Staff Report, Getting to the Bottom with Slant-Hole Logging Tools, Feb. 1988, Petroleum Engineer, pp. 32, 34 and 35.

Jeff H. Littleton, Sohio Studies Extended-Reach Drilling for Prudhoe Bay, Oct. 1985, Petroleum Engineer, pp. 28, 32 and 34.

(Unknown), Horizontal Drilling Stays Hot, Apr. 1989, Petroleum Engineer International, pp. 24 and 26.

Gary M. Briggs, How to Design a Medium-Radius Horizontal Well, Sep. 1989, Petroleum Engineer, pp. 26, 30-32, 36 and 37.

Dennis Dann and David Jetelina, New Logging Approach Detects Fractures in Horizontal Wells, Sep. 1990, Petroleum Engineer, pp. 30, 32, 33, 35 and 36.

Sid B. Nice and W. H. Fertl, New Logging, Completion Techniques Boost Horizontal Well Productivity, Nov. 1990, Petroleum Engineer, pp. 20, 22-24, 26-29.

Michael M. Power, Roger Chapman and Robert O'-Neal, Horizontal Well Sets Depth Record-Horizontal Drilling Below 14,600 Ft, Nov. 1990, Petroleum Engineer, pp. 36-38, 40 and 41.

Lindsay Fraser, Effective Ways to Clean and Stabilize High-Angle Holes, Nov. 1990, Petroleum Engineer, pp. 30, 32, 34 and 35.

Bruce Woodlan and G. E. Powell, Casing Design in Directionally Drilled Wells, 1975, Society of Petroleum Engineers, pp. 1-11.

Wade Dickinson, Michael J. Pesavento and R. Wayne Dickinson, Data Acquisition, Analysis, and Control while Drilling with Horizontal Water Jet Drilling Systems, 1990, Society of Petroleum Engineers, pp. 127--1-127-10.

A. Eddison and J. Symons, Downhole Adjustable Gauge Stabilizer Improves Drilling Efficiency in Directional Wells, 1990, Society of Petroleum Engineers, pp. 509-516.

S. H. Fowler, Jr. and C. W. Plesants, Operation and Utilization of Hydraulic-Actuated Service Tools for Reeled Tubing, 1990, Society of Petroleum Engineers, pp. 631-640.

P. E. Harness, M. D. Hansen, G. A. Terzian, S. H. Fowler, Jr., and F. J. Golino, An Overview of Reeled-Tubing-Conveyed Production Logging Capabilities in California, 1990, Society of Petroleum Engineers, pp. 155-163.

D. K. Trichel and M. P. Ohanlan, Unique Articulated Downhole Motor Holds Promising Future for Short Radius Horizontal Drilling, 1990, Society of Petroleum Engineers, pp. 137-149.

Y. Tsukano and M. Ueno, Development of Lightweight Steel Drillpipe with 165-KSI Yield Strength, 1990, Society of Petroleum Engineers, pp. 403-412.

O. Rivas, A. Newsky, M. Cadeno and P. Rivera, Sucker Rod Centralizer for Directional Wells, 1990, Society of Petroleum Engineers.

Fred L. Sebins, Problems in Cementing Horizontal Wells, Apr. 1990, JPT, pp. 398-400.

J. D. Fultz, F. J. Pittard, F. D. Sawyer and W. R. Farmer, Slim-Hole Drilling in Harsh Environments, 1990, IADC/SPE, pp. 333-340.

M. R. Islam and A. E. George, Sand Control in Horizontal Wells in Heavy Oil Reservoirs, 1989, Society of Petroleum Engineers, pp. 437-452.

S. B. Claytor Jr., R. King and J. Speed, Steerable Systems Drilling: The Right Angle for Horizontal Drilling, 1989, Society of Petroleum Engineers, pp. 7-16.

C. W. White, Drilling and Completion of a Horizontal Lower Spraberry Well Including Multiple Hydraulic Fracture Treatments, 1989, Society of Petroleum Engineers, pp. 205-210.

R. L. Cook, J. W. Nicholson, M. G. Sheppard and W. Westlake, First Real Time Measurements of Downhole Vibrations, Forces, and Pressures Used to Monitor (List continued on next page.)

OTHER PUBLICATIONS

Directional Drilling Operations, 1989, SPE/IADC, pp. 283-290.
L. Keelean, S. S. Harris and N. Petronio, Short Radius Drilling Technology Utilizing Mobile Service/Workover Rig, 1989, SPE/IADC, pp. 765-772.
R. Ehiers, L. Kracht and J. Witte, Case History of Horizontal Wells Drilled with Navigation Technology in European Operations, 1989, SPE/IADC, pp. 315-324.
H. Karlsson, R. Cobbley and G. E. Jacques, New Developments in Short-, Medium-, and Long-Radius Lateral Drilling, 1989, SPE/IADC, pp. 725-736.
G. K. McKown, Drillstring Design Optimization for High-Angle Wells, 1989, SPE/IADC, pp. 275-282.
W. Dickinson, R. G. Knowll, N. Nordlund and W. Dickinson, Flexible Sand Barrier (FSB): A Novel Sand Control System, 1989, Society of Petroleum Engineers, pp. 419-424.
P. A. Goode and D. J. Wilkinson, Inflow Performance of Partially Open Horizontal Wells, 1989, Society of Petroleum Engineers, pp. 309-320.
G. E. King, Perforating the Horizontal Well, Jul. 1989, Journal of Petroleum Technology, pp. 671-672.
J. P. Ashton, J. Liput, R. Leomons and J. Summerlin, Gravel Packing Horizontal and Highly Deviated Openhole Completions Using a Single-Screen Prepacked Liner in Offshore California Fields, 1989, Society of Petroleum Engineers, pp. 165-178.
R. E. Cooper and J. C. Troncose, An Overview of Horizontal Well Completion Technology, 1988, Society of Petroleum Engineers, pp. 335-350.
R. E. Cooper, Coiled Tubing in Horizontal Wells, 1988, Society of Petroleum Engineers, pp. 323-334.
S. A. Andersen, S. A. Hansen and K. Fjeldgaard, Horizontal Drilling and Completion: Denmark, 1988, Society of Petroleum Engineers, pp. 155-165.
D. Kerr and K. Lesley, Mechanical Aspects of Medium Radius Well Design, 1988, Society of Petroleum Engineers, pp. 719-726.
J. E. Fontenot, Successful High Angle Completions, Cementing, and Drilling's Impact, 1988, Society of Petroleum Engineers, pp. 831-842.
J. Lessi and A. Spreux, Completion of Horizontal Drainholes, 1988, Society of Petroleum Engineers, pp. 209-218.
A. Spreux, A. Louis and M. Rocca, Logging Horizontal Wells—Field Practice for Various Techniques, 1987, Society of Petroleum Engineers, pp. 1-14.
J. B. Weirich, T. E. Zaleski Jr., and P. M. Mulcahy, Perforating the Horizontal Well: Designs and Techniques Prove Successful, 1987, Society of Petroleum Engineers, pp. 503-508.
R. H. Reiley, J. W. Black, T. O. Stagg, D. A. Walters and G. R. Atol, Cementing of Liners in Horizontal and High-Angle Wells at Prudhoe Bay, Alaska, 1987, Society of Petroleum Engineers, pp. 583-590.
M. B. Webster, G. E. Otott Jr. and D. L. Rice, Cementing High-Angle Wells Using Cement-Expanded Formation Packers and/or Casing Rotation, 1987, SPE-/IADC, pp. 745-754.
D. W. Sherrard, B. W. Brice and D. G. MacDonald, Application of Horizontal Wells at Prudhoe Bay, 1986, Society of Petroleum Engineers, pp. 1-16.
R. C. Wilson and D. N. Willis, Successful High Angle Drilling in the Statfjord Field, 1986, Society of Petroleum Engineers, pp. 1-13.
C. Zurdo, C. Georges and M. Martin, Mud and Cement for Horizontal Wells, 1986, Society of Petroleum Engineers, pp. 1-8.
A. A. Gavignet and I. J. Sobey, A Mobel for the Transport of Cuttings in Highly Deviated Wells, 1986, Society of Petroleum Engineers, pp. 1-8.
C. J. Perry, Directional Drilling with PDC Bits in the Gulf of Thailand, 1986, Society of Petroleum Engineers, pp. 1-9.
Pat Herbet, Drilling with New-Generation Positive Displacement Motors, 1981, Society of Petroleum Engineers, pp. 1-5.
William P. Diamon and David C. Oyler, Drilling Long Horizontal Coalbed Methane Drainage Holes from a Directional Surface Borehole, 1990, Society of Petroleum Engineers, pp. 341-346.
M. J. Landman and W. H. Goldthrope, Optimization of Perforation Distribution for Horizontal Wells, 1991, Society of Petroleum Engineers, pp. 567-576.
U. Ahmed, Horizontal Well Completion Recommendations Through Optimized Formation Evaluation, 1991, Society of Petroleum Engineers, pp. 423-435.
R. J. Tailby, J. H. Yonker and J. L. Pearce, A New Technique for Servicing Horizontal Wells, 1991, Society of Petroleum Engineers, pp. 43-58.

(List continued on next page.)

OTHER PUBLICATIONS

J. Misselbrook, G. Wilde and G. Falk, The Development and Use of a Coiled-Tubing Simulation for Horizontal Applications, 1991, Society of Petroleum Engineers, pp. 29-41.

P. E. Harness, M. D. Hansen, G. A. Terzian, S. H. Fowler Jr., and F. J. Golino, An Overview of Reeled-Tubing-Conveyed Production Logging Capabilities in California, 1990, Society of Petroleum Engineers, pp. 155-163.

J. Bryant, D. Watson, W. Wisniewski, R. Patterson and L. Smith, Applications and Limitations of Horizontal Drilling in Oklahoma, 1991, Society of Petroleum Engineers, pp. 313-326.

G-F. Fuh, D. B. Deom and R. D. Turner, Wellbore Stability and Drilling Results from the First Horizontal Well in the Kotter Field Offshore the Netherlands, 1991, Society of Petroleum Engineers, pp. 101-109.

L. R. B. Hammons, W. C. Barnett, E. K. Fisher and D. H. Sellers, Stratigraphic Control and Formation Evaluation of Horizontal Wells Using MWD, 1991, Society of Petroleum Engineers, pp. 25-38.

D. B. Gaudin and J. C. Beasley, A Comparison of MWD and Wireline Steering Tool Guidance Systems in Horizontal Drilling, 1991, Society of Petroleum Engineers, pp. 7-18.

C. M. Matthews and L. J. Dunn, Drilling and Production Practices to Mitigate Sucker Rod/Tubing Wear-Related Failures in Directional Wells, 1991, Society of Petroleum Engineers, pp. 363-374.

D. Malekzadeh and D. Tiab, Interference Testing of Horizontal Wells, 1991, Society of Petroleum Engineers, pp. 717-727.

S. Schellenberg, T. Rogers and L. Smith, Deviation Control with Steerable System Lowers Well Costs in Southern Oklahoma, 1991, Society of Petroleum Engineers, pp. 299-312.

L. Shale, Development of Air Drilling Motor Holds Promise for Specialized Directional Drilling Applications, 1991, Society of Petroleum Engineers, pp. 275-286.

J. L. Hood III, M. D. Mueller and M. G. Mims, The Use of Buoyancy in Completing High-Drag Horizontal Wellbores, 1991, Society of Petroleum Engineers, pp. 757-764.

T. J. Moo and M. W. Tweedy, Planning and Drilling Australia's First Medium-Radius Horizontal Wells, 1991, Society of Petroleum Engineers, pp. 629-640.

W. B. Bradley, C. E. Murphey, R. T. McLamore, and L. L. Dickson, Advantages of Heavy Metal Collars in Directional Drilling and Deviation Control, May 1976, Society of Petroleum Engineers, pp. 521-530.

D. Bryant, T. Hudson and S. Hoover, The Use of Low-Density Particles for Packing a Highly Deviated Well, Oct. 1990, Society of Petroleum Engineers, pp. 387-395.

METHOD AND APPARATUS FOR LOCATING AND RE-ENTERING ONE OR MORE HORIZONTAL WELLS USING WHIPSTOCK WITH SEALABLE BORES

CROSS-REFERENCE TO RELATED APPLICATIONS

This application is related to the following applications, all of which have been filed contemporaneously herewith.

(1) U.S. application Ser. No. 927,589 entitled "Method and Apparatus for Sealing the Juncture Between a Vertical Well and One or More Horizontal Wells using Deformable Sealing Means" invented by Douglas J. Murray and F.T. Tilton;

(2) U.S. application Ser. No. 926,893 entitled "Method and Apparatus for Sealing the Juncture Between a Vertical Well and One or More Horizontal Wells Using Mandrel Means" invented by R. Curington, L. Cameron White and Daniel S. Bangert;

(3) U.S. application Ser. No. 927,568 entitled "Method and Apparatus for Sealing the Juncture Between a Vertical Well and One or More Horizontal Wells" invented by Robert J. McNair and Daniel S. Bangert;

(4) U.S. application Ser. No. 926,452 entitled "Method and Apparatus for Locating and Re-Entering One or More Horizontal Wells Using Mandrel Means" invented by Daniel S. Bangert, Alfred R. Curington and L. Cameron White;

(5) U.S. application Ser. No. 926,451 entitled "Method and Apparatus for Isolating One Horizontal Production Zone from Another Horizontal Production Zone in a Multilateral Well" invented by Robert J. McNair, Mark W. Brockman, L. Cameron White, Jeffrey D. Cockrell, Alfred R. Curington and Daniel S. Bangert;

BACKGROUND OF THE INVENTION

This invention relates generally to the completion of lateral wellbores. More particularly, this invention relates to new and improved methods and devices for completion of a branch wellbore extending laterally from a primary well which may be vertical, substantially vertical, inclined or even horizontal. This invention finds particular utility in the completion of multilateral wells, that is, downhole well environments where a plurality of discrete, spaced lateral wells extend from a common vertical wellbore.

Horizontal well drilling and production have been increasingly important to the oil industry in recent years. While horizontal wells have been known for many years, only relatively recently have such wells been determined to be a cost effective alternative (or at least companion) to conventional vertical well drilling. Although drilling a horizontal well costs substantially more than its vertical counterpart, a horizontal well frequently improves production by a factor of five, ten, or even twenty in naturally fractured reservoirs. Generally, projected productivity from a horizontal well must triple that of a vertical hole for horizontal drilling to be economical. This increased production minimizes the number of platforms, cutting investment and operational costs. Horizontal drilling makes reservoirs in urban areas, permafrost zones and deep offshore waters more accessible. Other applications for horizontal wells include periphery wells, thin reservoirs that would require too many vertical wells, and reservoirs with coning problems in which a horizontal well could be optimally distanced from the fluid contact.

Horizontal wells are typically classified into four categories depending on the turning radius:

1. An ultra short turning radius is 1–2 feet; build angle is 45–60 degrees per foot.
2. A short turning radius is 20–100 feet; build angle is 2–5 degrees per foot.
3. A medium turning radius is 300–1,000 feet; build angle is 6–20 degrees per 100 feet.
4. A long turning radius is 1,000–3,000 feet; build angle is 2–6 degrees per 100 feet.

Also, some horizontal wells contain additional wells extending laterally from the primary vertical wells. These additional lateral wells are sometimes referred to as drainholes and vertical wells containing more than one lateral well are referred to as multilateral wells. Multilateral wells are becoming increasingly important, both from the standpoint of new drilling operations and from the increasingly important standpoint of reworking existing wellbores including remedial and stimulation work.

As a result of the foregoing increased dependence on and importance of horizontal wells, horizontal well completion, and particularly multilateral well completion have been important concerns and have provided (and continue to provide) a host of difficult problems to overcome. Lateral completion, particularly at the juncture between the vertical and lateral wellbore is extremely important in order to avoid collapse of the well in unconsolidated or weakly consolidated formations. Thus, open hole completions are limited to competent rock formations; and even then open hole completion are inadequate since there is no control or ability to re-access (or re-enter the lateral) or to isolate production zones within the well. Coupled with this need to complete lateral wells is the growing desire to maintain the size of the wellbore in the lateral well as close as possible to the size of the primary vertical wellbore for ease of drilling and completion.

Conventionally, horizontal wells have been completed using either slotted liner completion, external casing packers (ECP's) or cementing techniques. The primary purpose of inserting a slotted liner in a horizontal well is to guard against hole collapse. Additionally, a liner provides a convenient path to insert various tools such as coiled tubing in a horizontal well. Three types of liners have been used namely (1) perforated liners, where holes are drilled in the liner, (2) slotted liners, where slots of various width and depth are milled along the line length, and (3) prepacked liners.

Slotted liners provide limited sand control through selection of hole sizes and slot width sizes. However, these liners are susceptible to plugging. In unconsolidated formations, wire wrapped slotted liners have been used to control sand production. Gravel packing may also be used for sand control in a horizontal well. The main disadvantage of a slotted liner is that effective well stimulation can be difficult because of the open annular space between the liner and the well. Similarly, selective production (e.g., zone isolation) is difficult.

Another option is a liner with partial isolations. External casing packers (ECPs) have been installed outside the slotted liner to divide a long horizontal well bore into several small sections (FIG. 1). This method provides limited zone isolation, which can be used for stimulation or production control along the well length. However, ECP's are also associated with certain drawbacks and deficiencies. For example, normal horizontal wells are not truly horizontal over their entire length, rather they have many bends and curves. In a hole with several bends it may be difficult to insert a liner with several external casing packers.

Finally, it is possible to cement and perforate medium and long radius wells as shown, for example, in U.S. Pat. No. 4,436,165.

While sealing the juncture between a vertical and lateral well is of importance in both horizontal and multilateral wells, re-entry and zone isolation is of particular importance and pose particularly difficult problems in multilateral wells completions. Re-entering lateral wells is necessary to perform completion work, additional drilling and/or remedial and stimulation work. Isolating a lateral well from other lateral branches is necessary to prevent migration of fluids and to comply with completion practices and regulations regarding the separate production of different production zones. Zonal isolation may also be needed if the borehole drifts in and out of the target reservoir because of insufficient geological knowledge or poor directional control; and because of pressure differentials in vertically displaced strata as will be discussed below.

When horizontal boreholes are drilled in naturally fractured reservoirs, zonal isolation is being seen as desirable. Initial pressure in naturally fractured formations may vary from one fracture to the next, as may the hydrocarbon gravity and likelihood of coning. Allowing them to produce together permits crossflow between fractures and a single fracture with early water breakthrough, which jeopardizes the entire well's production.

As mentioned above, initially horizontal wells were completed with uncemented slotted liner unless the formation was strong enough for an open hole completion. Both methods make it difficult to determine producing zones and, if problems develop, practically impossible to selectively treat the right zone. Today, zonal isolation is achieved using either external casing packers on slotted or perforated liners or by conventional cementing and perforating.

The problem of lateral wellbore (and particularly multilateral wellbore) completion has been recognized for many years as reflected in the patent literature. For example, U.S. Pat. No. 4,807,704 discloses a system for completing multiple lateral wellbores using a dual packer and a deflective guide member. U.S. Pat. No. 2,797,893 discloses a method for completing lateral wells using a flexible liner and deflecting tool. U.S. Pat. No. 2,397,070 similarly describes lateral wellbore completion using flexible casing together with a closure shield for closing off the lateral. In U.S. Pat. No. 2,858,107, a removable whipstock assembly provides a means for locating (e.g., re-entry) a lateral subsequent to completion thereof. U.S. Pat. No. 3,330,349 discloses a mandrel for guiding and completing multiple horizontal wells. U.S. Pat. Nos. 4,396,075; 4,415,205; 4,444,276 and 4,573,541 all relate generally to methods and devices for multilateral completions using a template or tube guide head. Other patents of general interest in the field of horizontal well completion include U.S. Pat. Nos. 2,452,920 and 4,402,551.

Notwithstanding the above-described attempts at obtaining cost effective and workable lateral well completions, there continues to be a need for new and improved methods and devices for providing such completions, particularly sealing between the juncture of vertical and lateral wells, the ability to re-enter lateral wells (particularly in multilateral systems) and achieving zone isolation between respective lateral wells in a multilateral well system.

SUMMARY OF THE INVENTION

The above-discussed and other drawbacks and deficiencies of the prior art are overcome or alleviated by the several methods and devices of the present invention for completion of lateral wells and more particularly the completion of multilateral wells. In accordance with the present invention, a plurality of methods and devices are provided for solving important and serious problems posed by lateral (and especially multilateral) completion including:

1. Methods and devices for sealing the junction between a vertical and lateral well.
2. Methods and devices for re-entering selected lateral wells to perform completions work, additional drilling, or remedial and stimulation work.
3. Methods and devices for isolating a lateral well from other lateral branches in a multilateral well so as to prevent migration of fluids and to comply with good completion practices and regulations regarding the separate production of different production zones.

In accordance with the several methods of the present invention relating to juncture sealing, a first set of embodiments are disclosed wherein deformable means are utilized to selectively seal the juncture between the vertical and lateral wells. Such deformable means may comprise (1) an inflatable mold which utilizes a hardenable liquid (e.g., epoxy or cementious slurry) to form the seal; (2) expandable memory metal devices; and (3) swaging devices for plastically deforming a sealing material.

In a second set of embodiments relating to juncture sealing in single or multilateral wells, several methods are disclosed for improved juncture sealing including novel techniques for establishing pressure tight seals between a liner in the lateral wellbore and a liner in the vertical wellbore. These methods generally relate to the installation of a liner to a location between the vertical and lateral wellbores such that the vertical wellbore is blocked. Thereafter, at least a portion of the liner is removed to reopen the blocked vertical wellbore.

In a third set of embodiments for juncture sealing, several methods are disclosed which utilize a novel guide or mandrel which includes side pockets for directing liners into a lateral wellbore. Other methods include the use of extendable tubing and deflector devices which aid in the sealing process.

In a fourth set of embodiments, various methods and devices are provided for assisting in the location and re-entry of lateral wells. Such re-entry devices include permanent or retrievable deflector (e.g., whipstock) devices having removable sealing means disposed in a bore provided in the deflector devices. Another method includes the use of inflatable packers.

In a fifth set of embodiments, additional methods and devices are described for assisting in the location and re-entry of lateral wells using a guide or mandrel structure. Preferably, the re-entry methods of this invention permit the bore size of the lateral wells to be maximized.

In a sixth set of embodiments, various methods and devices are provided for fluid isolation of a lateral well from other lateral wells and for separate production from a lateral well without commingling the production fluids. These methods include the aforementioned use of a side pocket mandrel, whipstocks with sealable bores and valving techniques wherein valves are located at the surface or downhole at the junction of a particular lateral.

It will be appreciated that many of the methods and devices described herein provide single lateral and multilateral completion techniques which simultaneously solve a plurality of important problems now facing the field of oil well completion and production. For example, the side pocket mandrel device simultaneously provides pressure tight sealing of the junction between a vertical and lateral well, provides a technique for easy re-entry of selected lateral wells and permits zone isolation between multilateral wellbores.

The above-discussed and other features and advantages of the present invention will be appreciated to those skilled in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

In accordance with the present invention, various embodiments of methods and devices for completing lateral, branch or horizontal wells which extend from a single primary wellbore, and more particularly for completing multiple wells extending from a single generally vertical wellbore (multilaterals) are described. It will be appreciated that although the terms primary, vertical, deviated, horizontal, branch and lateral are used herein for convenience, those skilled in the art will recognize that the devices and methods with various embodiments of the present invention may be employed with respect to wells which extend in directions other than generally vertical or horizontal. For example, the primary wellbore may be vertical, inclined or even horizontal. Therefore, in general, the substantially vertical well will sometimes be referred to as the primary well and the wellbores which extend laterally or generally laterally from the primary wellbore may be referred to as the branch wellbores.

Figure 1A:
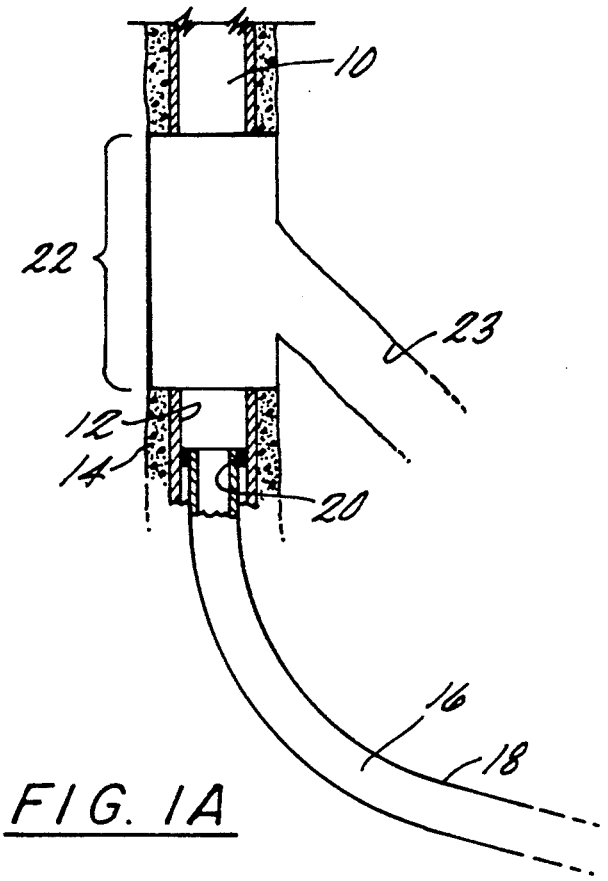
FIGS. 1A–B are sequential cross-sectional elevation views depicting a method for sealing a juncture between a vertical and lateral wellbore using deformable sealing means comprising an inflatable mold.

Referring now to FIGS. 1A and B, a method and apparatus is presented for sealing the juncture between a vertical well and one or more lateral wells using a deformable device which preferably comprises an inflatable mold. In accordance with this method, a primary or vertical well 10 is initially drilled. Next, in a conventional manner, a well casing 12 is cemented in place using cement 14. Thereafter, the lower most lateral well 16 is drilled and is completed in a known manner using a liner 18 which attaches to casing 12 by a suitable packer or liner hanger 20. Still referring to FIG. 1A, in the next step, a window 22 is milled in casing 12 at the cite for drilling an upper lateral wellbore A short lateral (for example 30 feet) is then drilled and opened using an expandable drill to accept a suitably sized casing (for example, 9⅝").

Figure 1B:
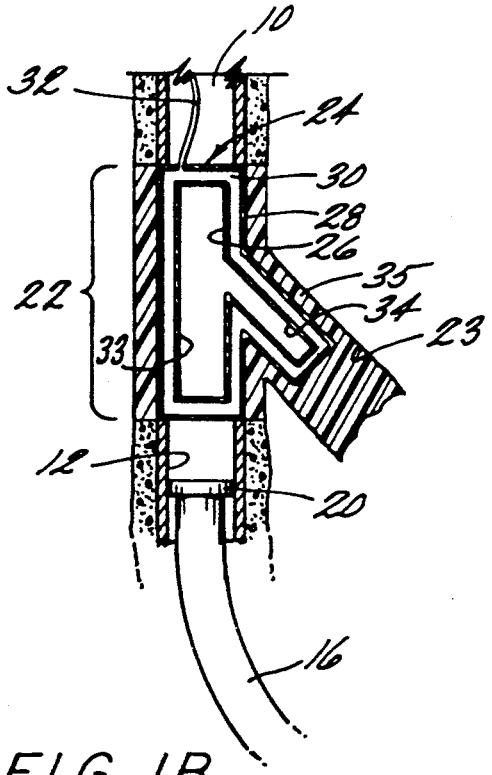

Referring now to FIG. 1B, an inflatable mold 24 is then run in primary wellbore 10 to window 22. Inflatable mold 24 includes an inner bladder 26 and an outer bladder 28 which define therebetween an expandable space 30 for receiving a suitable pressurized fluid (e.g., circulating mud). This pressurized fluid may be supplied to the gap 30 in inflatable mold 24 via a suitable conduit 32 from the surface. Applying pressure to mold 24 will cause the mold to take on a nodal shape which comprises a substantially vertical conduit extending through casing 12 and a laterally depending branch 34 extending from the vertical branch 33 and into the lateral 23. The now inflated mold 24 provides a space or gap 35 between mold 24 and window 22 as well as lateral 23.

Next, a slurry of a suitable hardenable or settable liquid is pumped into space 35 from the surface. This hardenable liquid then sets to form a hard, structural, impermeable bond. A conventional lateral can now be drilled and completed in a conventional fashion such as, with a 7" liner and using a hanger sealing in branch 34. It will be appreciated that many hardenable liquids are well suited for use in conjunction with inflatable mold 24 including suitable epoxies and other polymers as well as inorganic hardenable slurries such as cement. After the hardenable filler has fully set, the inflatable mold 24 may be removed by deflating so as to define a pressure tight and fluid tight juncture between vertical wellbore 10 and lateral wellbore 23. Inflatable mold 24 may then be reused (or a new mold utilized) for additional laterals within wellbore 10. Thus, inflatable mold 24 is useful both in dual lateral completions as well as in multilaterals having three or more horizontal wells. In addition, it will be appreciated that the use of inflatable mold 24 is also applicable to existing wells where re-working is required and the junction between the vertical and one or more lateral wells needs to be completed.

Figure 2C:
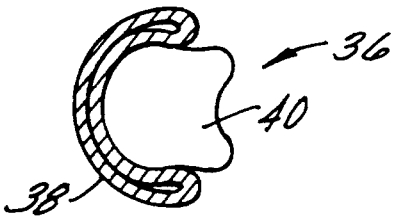
FIG. 2C is a cross-sectional elevation view, similar to FIG. 2B, but subsequent to deformation of the dual bore assembly.
Figure 2B:
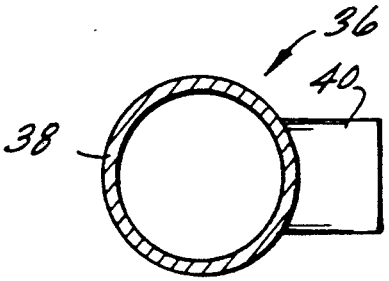
FIG. 2B is a cross-sectional elevation view along the line 2B—2B.
Figure 2A:
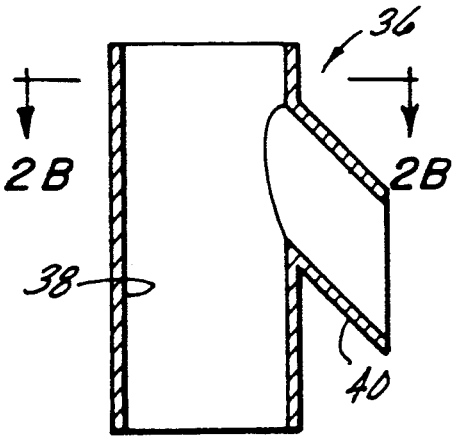
FIG. 2A is a cross-sectional elevation view of a deformable dual bore assembly for sealing a juncture between vertical and lateral wellbores.

Referring now to FIGS. 2A–D, a second embodiment of a device for sealing the juncture between one or more lateral wellbores in a vertical well is depicted. As in the FIG. 1 embodiment, the FIG. 2 embodiment uses a deformable device for accomplishing juncture sealing. This device is shown in FIGS. 2A and 2B as comprising a dual bore assembly 36 which includes a primary conduit section 38 and a laterally an angularly extending branch 40. In accordance with an important feature of this embodiment of the present invention, lateral branch 40 is made of a suitable shape memory alloy such as NiTi-type and Cu-based alloys which have the ability to exist in two distinct shapes or configurations above and below a critical transformation temperature. Such memory shape alloys are well known and are available from Raychem Corporation, Metals Division, sold under the tradename TINEL ®; or are described in U.S. Pat. No. 4,515,213 and in "Shape Memory Alloys", L. McDonald Schetky, Scientific American, Vol 241, No. 5, pp. 2–11 (Nov. 1979), both of which are incorporated herein by reference. This shape memory alloy is selected such that as dual bore assembly 36 is passed through a conventional casing as shown at 41 in FIG. 2D, lateral branch 40 will deform as it passes through the existing casing The deformed dual bore assembly 36 is identified in FIG. 2C wherein main branch 40 has deformed and lateral branch 38 has been received into the moon shaped receptacle of deformed branch 40 In this way, deformed bore assembly 36 has an outer diameter equal to or less than the diameter of casing 42 and may be easily passed through the existing casing. A pocket or window 42 is underreamed at the position where a lateral is desired and deformed bore assembly 36 is positioned within window 43 between upper and lower sections of original casing 43.

Figure 2D:
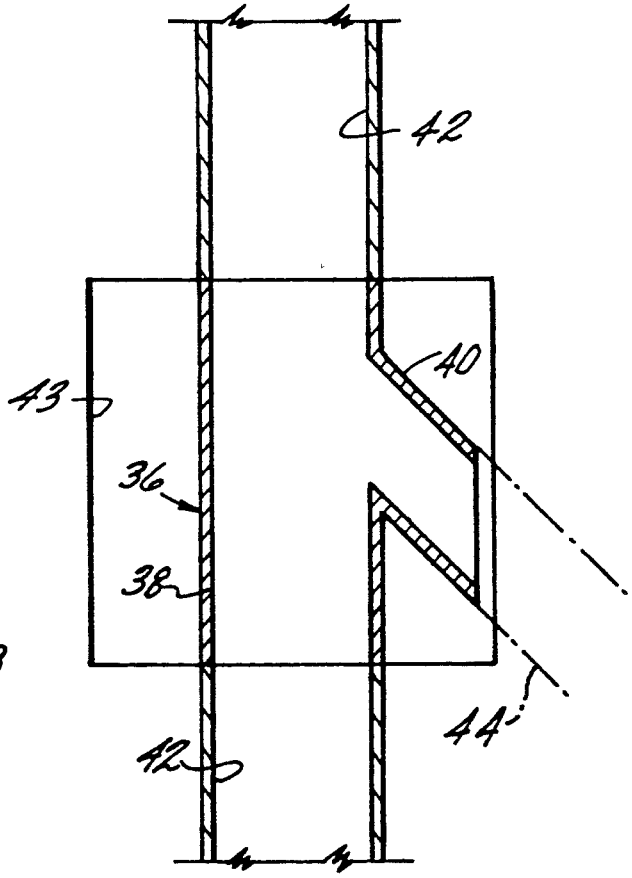
FIG. 2D is a cross-sectional elevation view of the dual bore assembly of FIG. 2A after installation at the juncture of a lateral wellbore.

Next, heat is applied to deformed bore assembly 36 which causes the dual bore assembly 36 to regain its original shape as shown in FIG. 2D. Heat may be applied by a variety of methods including, for example, circulating a hot fluid (such as steam) downhole, electrical resistance heating or by mixing chemicals downhole which will cause an exothermic reaction. If the lateral well is to be a new wellbore, at that point, the lateral is drilled using conventional means such as positioning a retrievable whipstock below branch 40 and directing a drilling tool into branch 40 to drill the lateral. Alternatively, the lateral may already exist as indicated by the dotted lines 44 whereby the pre-existing lateral will be provided with a fluid tight juncture through the insertion of conventional liner and cementing techniques off of branch 40.

Figure 3A:
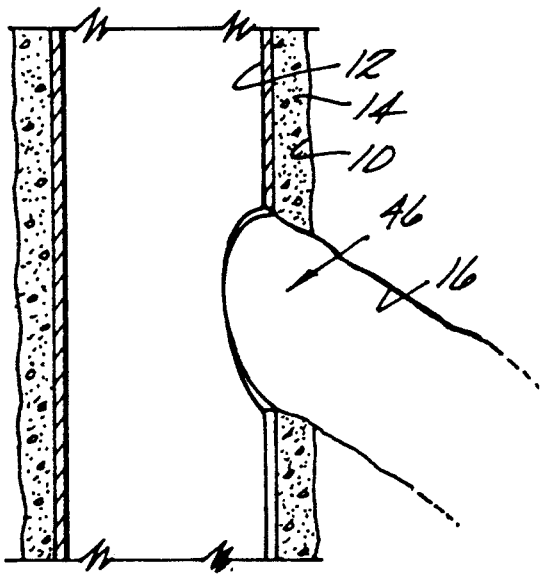
FIGS. 3A–C are sequential cross-sectional elevation views depicting a method for sealing a juncture between vertical and lateral wellbores using deformable flanged conduits.
Figure 3B:
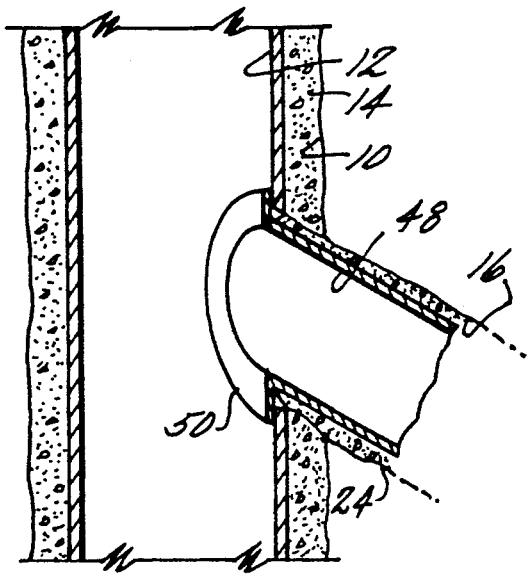
Figure 3C:
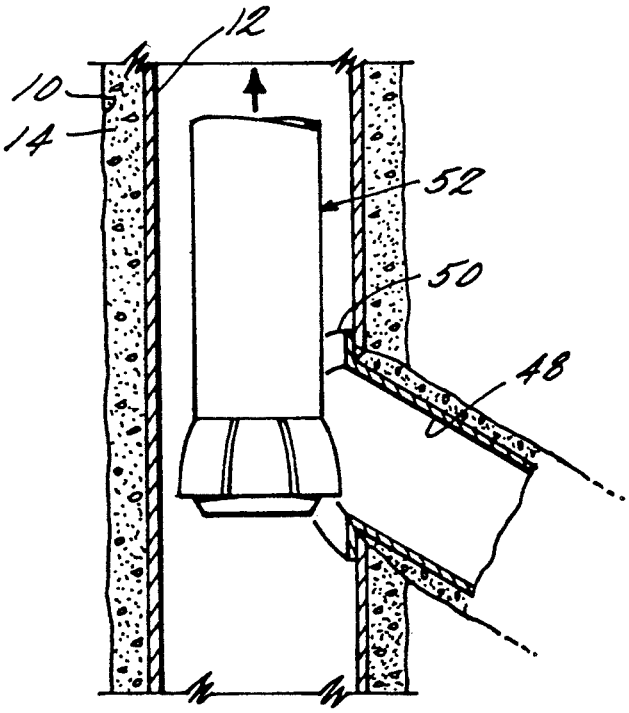

Referring now to FIGS. 3A–C, a method will be described for forming a pressure tight juncture between a lateral and a vertical wellbore is depicted which, like the methods in FIG. 1 and 2, utilizes a deformation technique to form the fluid tight juncture seal. As in many of the embodiments of the present invention, the method of FIGS. 3A–C may also be used either in conjunction with a new well or with an existing well (which is to be reworked or otherwise re-entered). Turning to FIG. 3A, a vertical wellbore 10 is drilled in a conventional manner and is provided with a casing 12 cemented via cement 14 to vertical bore 10. Next, a lateral 16 is drilled at a selected location from casing 12 in a known manner. For example, a retrievable whipstock (not shown) may be positioned at the location of the lateral to be drilled with a window 46 being milled through casing 12 and cement 14 using a suitable milling tool. Thereafter, the lateral 16 is drilled off the whipstock using a suitable drilling tool.

Figure 4A:
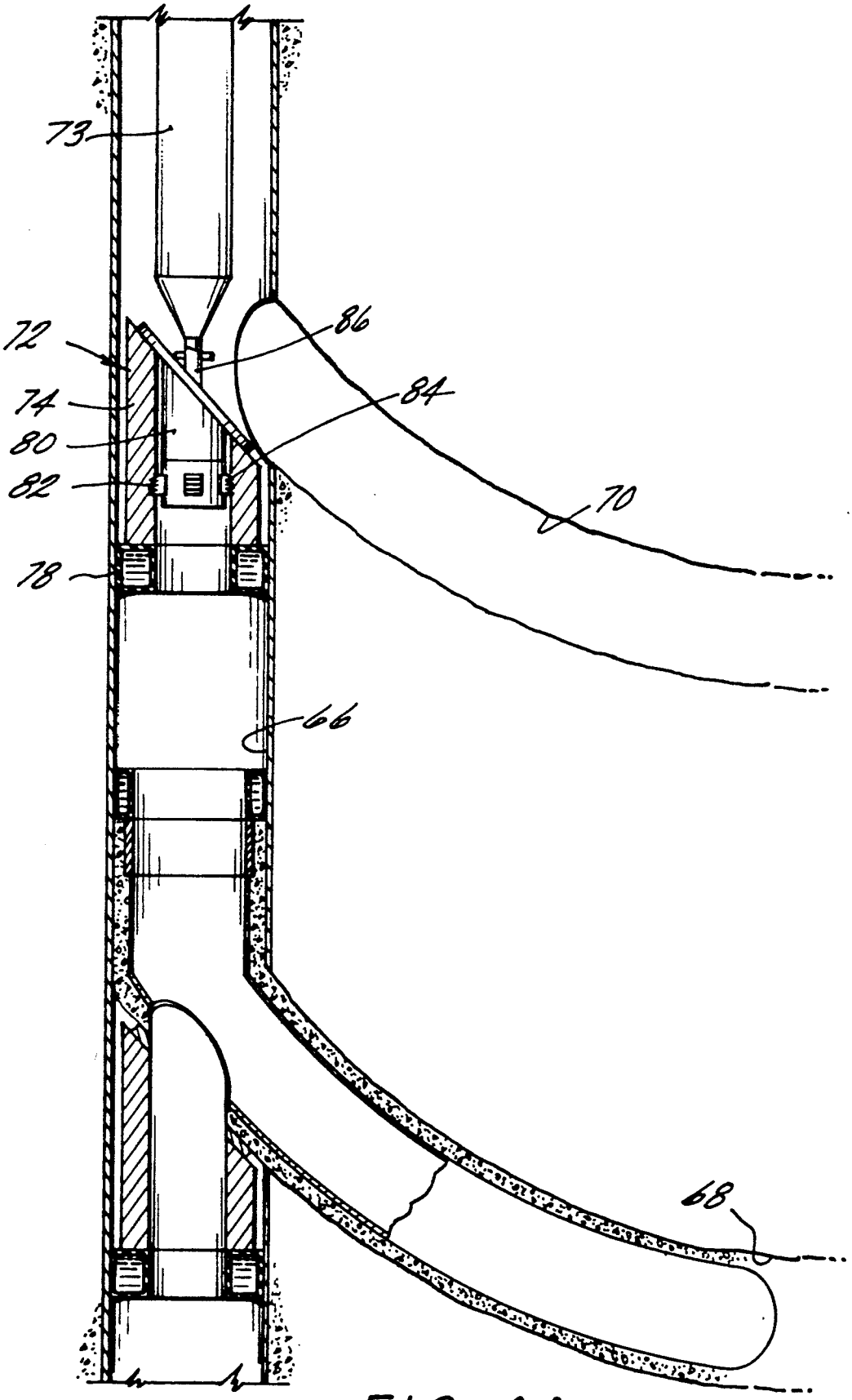
FIGS. 4A–D are sequential cross-sectional views depicting a method for multilateral completion using a ported whipstock device which allows for sealing the juncture between vertical and lateral wells, re-entering of multilaterals and zone isolation.

In accordance with an important feature of this embodiment, a liner 48 is then run through vertical casing 12 and into lateral 16. Liner 48 includes a flanged element 50 surrounding the periphery thereof which contacts the peripheral edges of window 46 in liner 12. Cement may be added to the space between liner 48 and lateral 16 in a known fashion. Next, a swage or other suitable tool is pulled through the wellbore contacting flanged element 50 and swaging flange 50 against the metal window of casing 12 to form a pressure tight metal-to-metal seal. Preferably, flange 50 is provided with an epoxy or other material so as to improve the sealability between the flange and the vertical well casing 12. Swage 52 preferably comprises an expandable cone swage which has an initial diameter which allows it to be run below the level of the juncture between lateral casing 48 and vertical casing 12 and then is expanded to provide the swaging action necessary to create the metal-to-metal seal between flange 50 and window 46. Referring now to FIGS. 4A through D, a method of multilateral completion in accordance with the present invention is shown which provides for the sealing of the juncture between a vertical well and multiple horizontal wells, provides ease of re-entry into a selected multiple lateral well and also provides for isolating one horizontal production zone from another horizontal production zone. Turning first to FIG. 4A, a vertical wellbore is shown at 66 having a lower lateral wellbore 68 and a vertically displaced upper lateral wellbore 70. Lower lateral wellbore 68 has been fully completed in accordance with the method of FIGS. 4A–D as will be explained hereinafter. Upper lateral wellbore 70 has not yet been completed. In a first completion step, a ported whipstock packer assembly 72 is lowered by drillpipe 73 into a selected position adjacent lateral borehole 70. Ported whipstock packer assembly 72 includes a whipstock 74 having an opening 76 axially therethrough. A packer 78 supports ported whipstock 74 in position on casing 66. Within axial bore 76 is positioned a sealing plug 80. Plug 80 is capable of being drilled or jetted out and therefore is formed of a suitable drillable material such as aluminum. Plug 80 is retained within bore 76 by any suitable retaining mechanism such as internal threading 82 on axial bore 76 which interlocks with protrusions 84 on plug 80. Protrusions 84 are threaded or anchor latched so as to mate with threads 82 on the interior of whipstock 74.

It will be appreciated that lateral 70 is initially formed by use of a retrievable whipstock which is then removed for positioning of the retrievable ported anchor whipstock assembly 72. It will also be appreciated that whipstock assembly 72 may either be lowered as a single assembly or may be lowered as a dual assembly. As for the latter, the whipstock 74 and retrievable or permanent packer 78 are initially lowered into position followed by a lowering of plug 80 and the latching of plug 80 within the axial bore 76 of whipstock 74. Insertion drillpipe 74 is provided with a shear release mechanism 86 for releasably connecting to plug 80 after plug 80 has been inserted into whipstock 74.

Figure 4B:
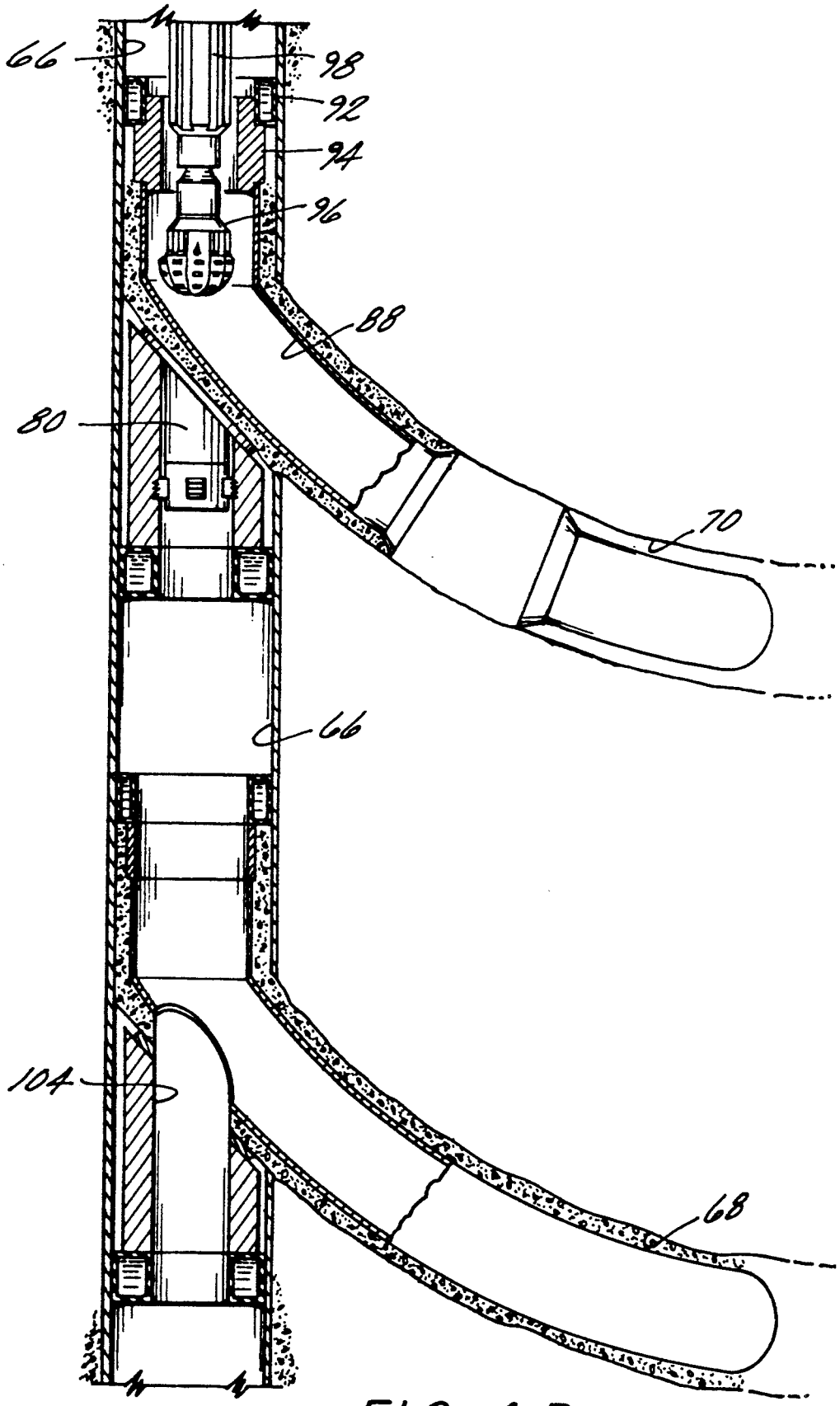
Figure 4C:
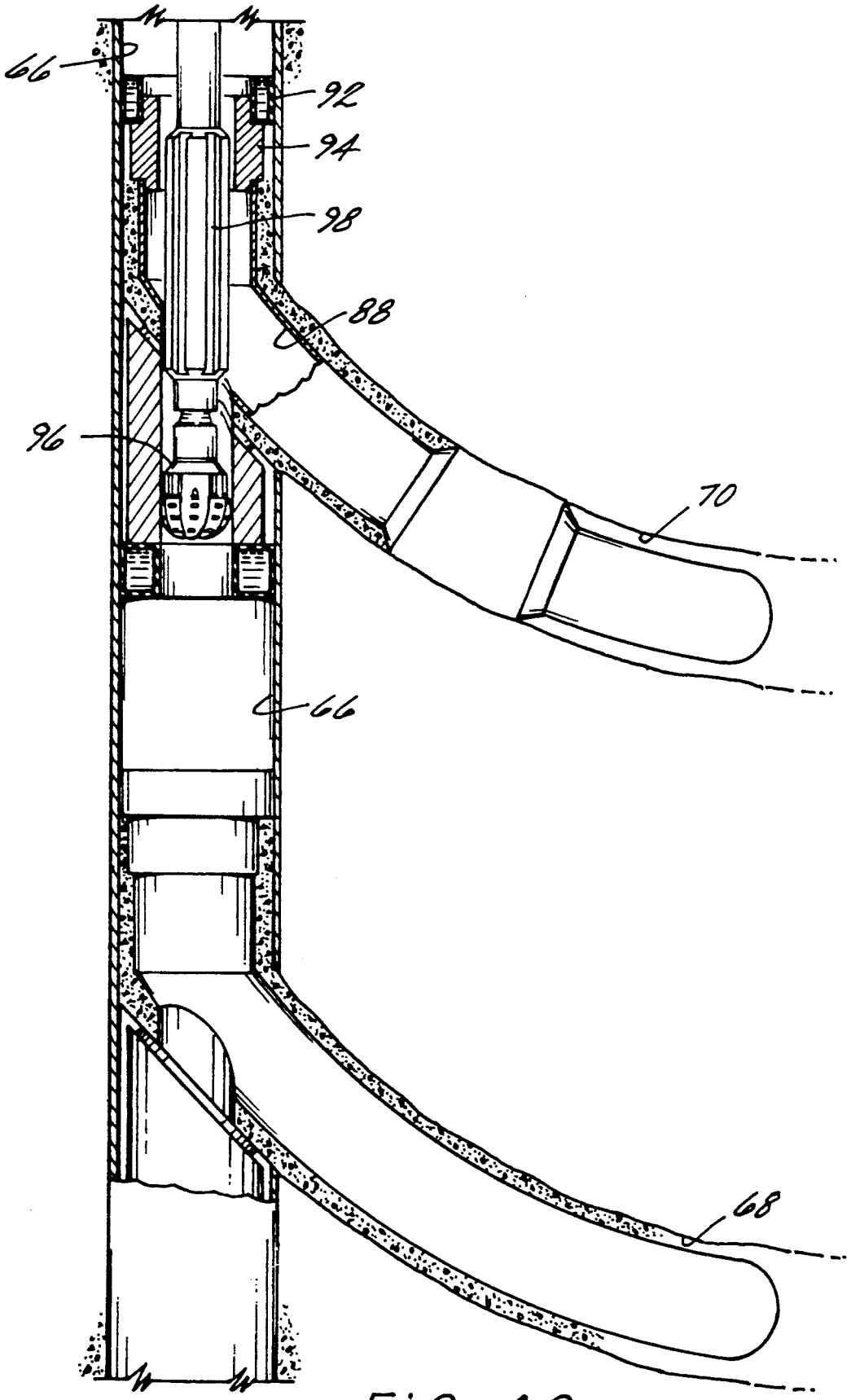

Turning now to FIG. 4B, a conventional liner or slotted liner 88 is run into lateral 70 after being deflected by whipstock assembly 72. Liner 88 is supported within vertical wellbore 66 using a suitable packer or liner hanger 92 provided with a directional stabilization assembly 94 such that a first portion of liner 88 remains within vertical wellbore 66 and a second portion of liner 88 extends from wellbore 66 and into the lateral wellbore 70. Preferably, an external casing packer (ECP) such as Baker Service Tools ECP Model RTS is positioned at the terminal end of liner 88 within lateral opening 70 for further stabilizing liner 88 and providing zone isolation for receiving cement which is delivered between liner 88 and wellbore 66, 70. After cement 94 has hardened, a suitable drilling motor such as an Eastman drilling motor 96 with a mill or bit (which preferably includes stabilization fins 98) is lowered through vertical wellbore 66 and axially aligned with the whipstock debris plug 80 where, as shown in FIG. 4C, drilling motor 96 drills through liner 88, cement 94 and debris plug 80 providing a full bore equal to the internal diameter of the whipstock assembly and retrievable packer 78. It will be appreciated that debris plug 80 is important in that it prevents any of the cement and other debris which has accumulated from the drilling of lateral opening 70 and the cementing of liner 88 from falling below into the bottom of wellbore 66 and/or into other lateral wellbores such as lateral wellbore 68.

Figure 4D:
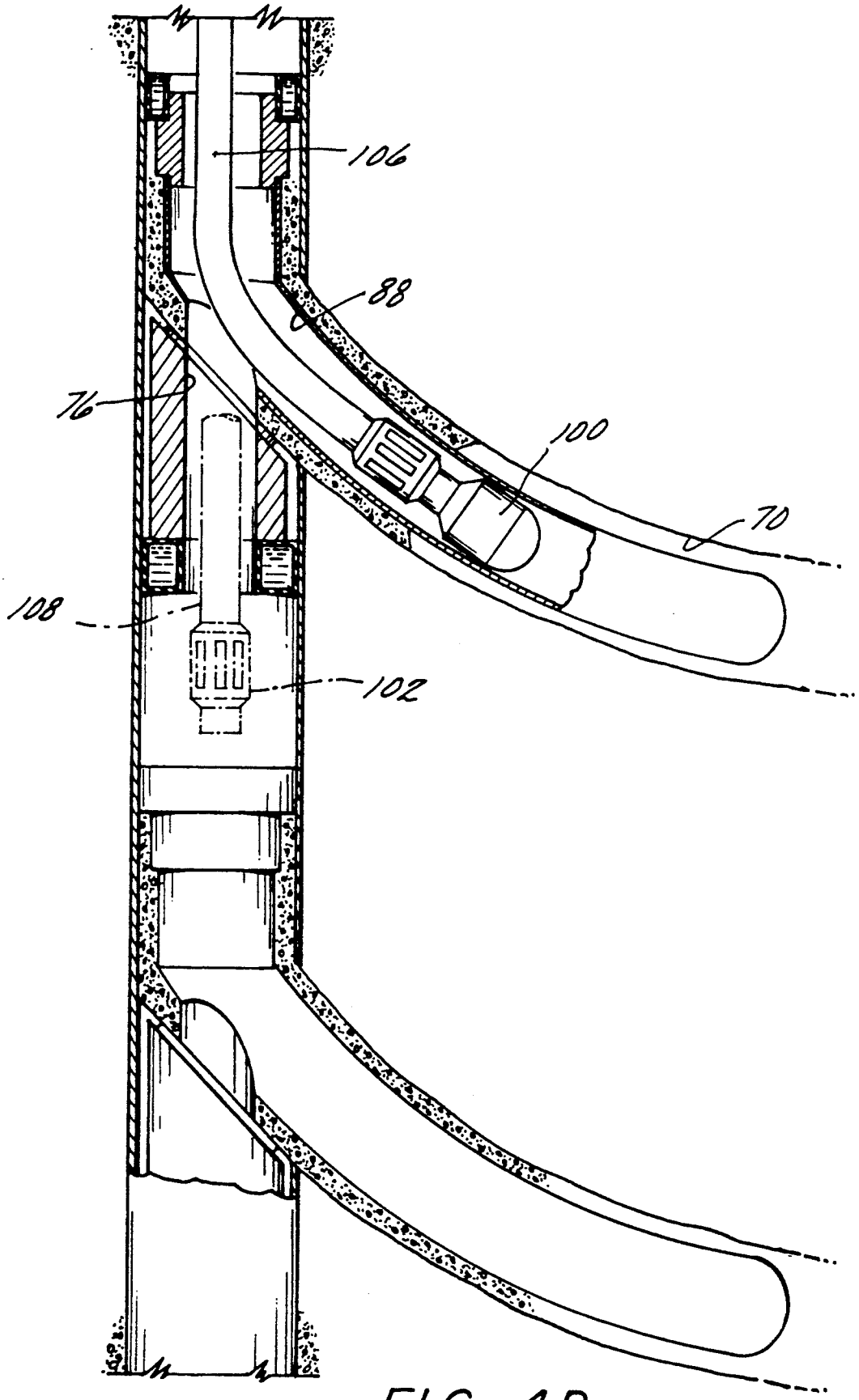

Referring now to FIG. 4D, it will be appreciated that the multilateral completion method of this embodiment provides a pressure tight junction between the multilateral wellbore 70 and the vertical wellbore 66. In addition, selective tripping mechanisms may be used to enter a selected multilateral wellbore 70 or 68 so as to ease re-entry into a particular lateral. For example, in FIG. 4D, a selective coiled tubing directional head is provided with a suitably sized and dimensioned head such that it will not enter the smaller diameter whipstock opening 76 but instead will be diverted in now completed (larger diameter) multilateral 70. Head 100 may also be a suitably inflated directional head mechanism. An inflated head is particularly preferred in that depending on the degree of inflation, head 100 could be directed either into lateral wellbore 70 or could be directed further down through axial bore 76 into lower lateral 68 (or some other lateral not shown in the FIGURES). A second coil tubing conduit 102 is dimensioned to run straight through whipstock bore 76 and down towards lower lateral 68 or to a lower depth.

It will be appreciated that while the coil tubing 100, 102, may have varied sized heads to regulate re-entry into particular lateral wellbores, the whipstock axial bore 76 and 104 may also have varied inner diameters for selective re-entering of laterals. In any event, the multilateral completion scheme of FIGS. 4A–D provides an efficient method for sealing the juncture between multilateral wellbores and a common vertical well; and also provides for ease of re-entry using coiled tubing or other selective re-entry means. Additionally, as is clear from a review of the several conduits 106 and 108 extending downwardly from the surface and selectively extending to different laterals, this multilateral completion scheme also provides effective zone isolation so that separate multilaterals may be individually isolated from one another for isolating production from one lateral zone to another lateral zone via the discrete conduits 106, 108.

It will further be appreciated that the embodiment of FIGS. 4A–D may be used both in conjunction with a newly drilled well or in a pre-existing well wherein the laterals are being reworked, undergo additional drilling or are used for remedial and stimulation work.

Figure 5A:
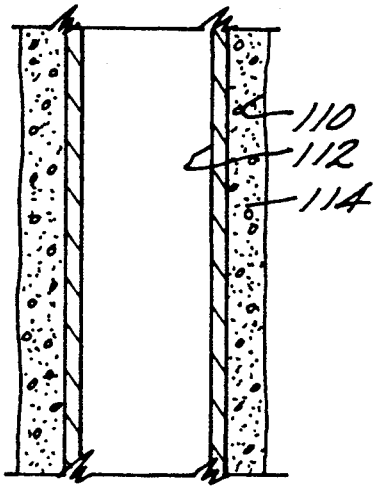
FIGS. 5A–I are sequential cross-sectional elevation views depicting a method for multilateral completion using a whipstock/packer assembly for cementing in a liner and then selectively milling to create the sealing of the juncture between vertical and lateral wells and re-entering of multilaterals.
Figure 5B:
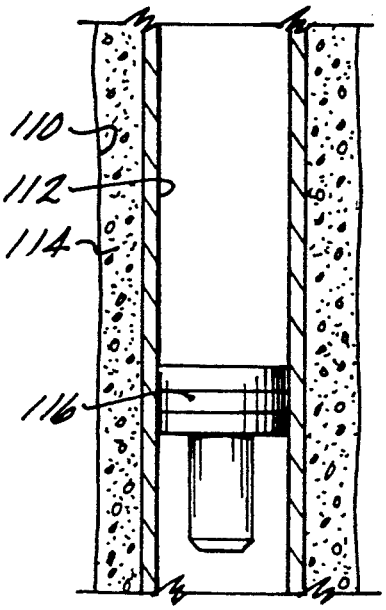
Figure 5C:
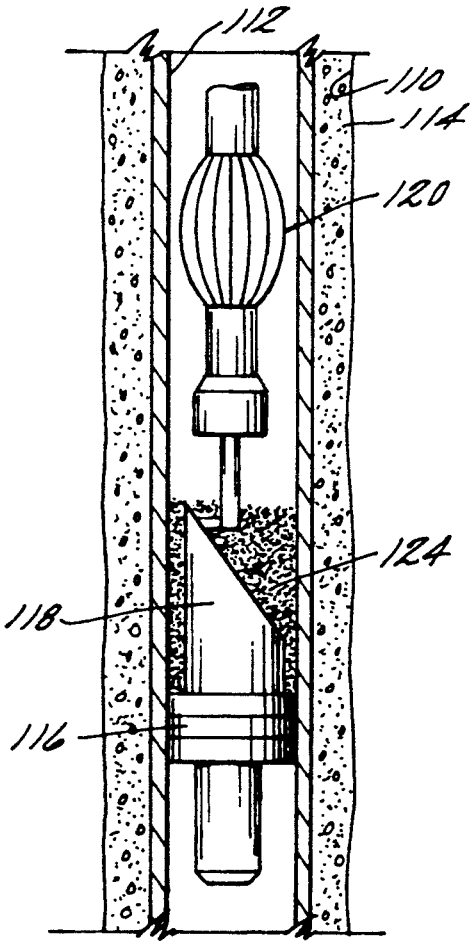
Figure 5D:
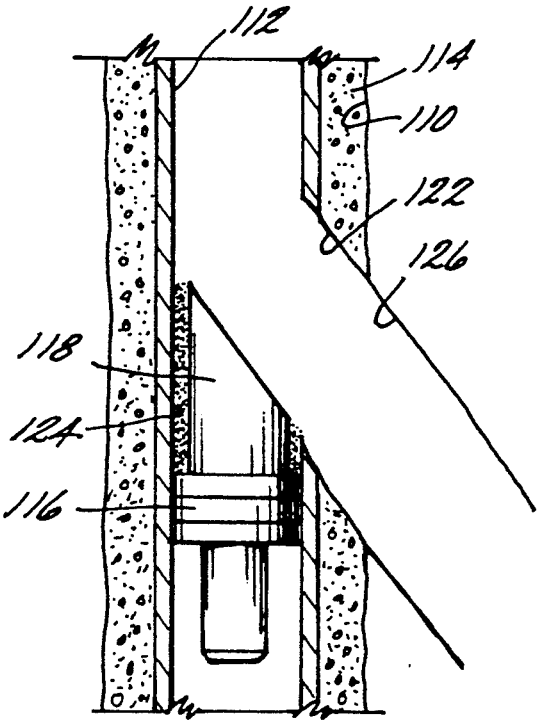

Turning now to FIGS. 5A–H, still another embodiment of the present invention is shown which provides a pressure tight junction between a vertical casing and a lateral liner and also provides a novel method for re-entering multiple horizontal wells. In FIG. 5A, a vertical wellbore 110 has been drilled and a casing 112 has been inserted therein in a known manner using cement 114 to define a cemented well casing. Next in FIG. 5B, a whipstock packer 116 such as is available from Baker Oil Tools and sold under the trademark "DW-1" is positioned within casing 112 at a location where a lateral is desired. Turning now to FIG. 5C, a whipstock 118 is positioned on whipstock packer 116 and a mill 120 is positioned on whipstock 118 so as to mill a window through casing 112 (as shown in FIG. 5D). Preferably, a protective material 124 is delivered to the area surrounding whipstock 118. Protective material 124 is provided to avoid cuttings (from cutting through window 122) from building up on whipstock assembly 118. Protective material 124 may comprise any suitable heavily jelled fluid, thixotropic grease, sand or acid soluble cement. The protective materials are placed around the whipstock and packer assembly prior to beginning window cutting operations. This material will prevent debris from lodging around the whipstock and possibly hindering its retrieval. The protective material is removed prior to recovering the whipstock. After window 122 is milled using mill 120, a suitable drill (not shown) is then deflected by whipstock 118 into window 22 whereupon lateral borewell 126 is formed as shown in FIG. 5D.

Figure 5E:
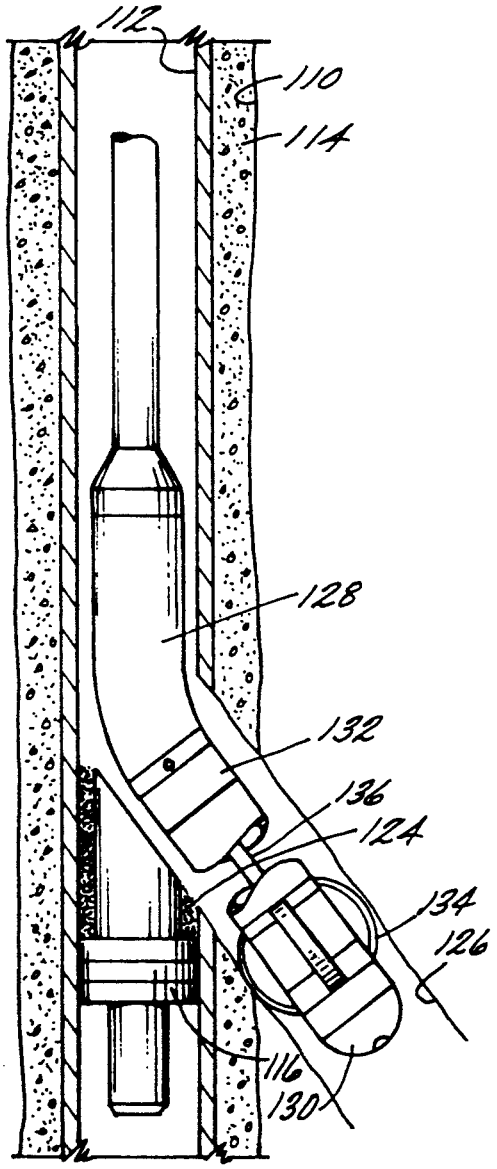
Figure 5F:
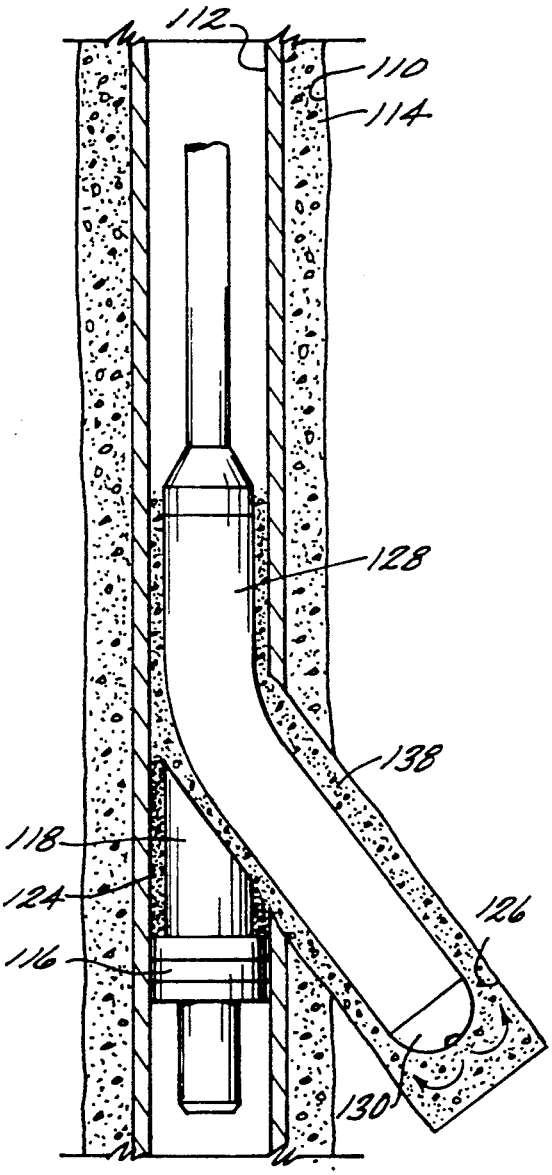

Next, referring to FIG. 5E, a liner 128 is run down casing 112 and into lateral borewell 126. Liner 128 terminates at a guide shoe 130 and may optionally include an ECP and stage collar 132, a central stabilizing ring 134 and an internal circulating string 136. Next, as shown in FIG. 5F, cement is run into lateral 126 thereby cementing liner 128 in position within window 122. As in the embodiment of FIG. 4, it is important that liner 128 be positioned such that a portion of the liner is within vertical casing 112 and a portion of the liner extends from vertical casing 112 into lateral borewell 126. The cement 138 fills the gap between the junction of lateral 126 and vertical casing 112 as shown in FIG. 5F. Note that a suitable liner hanger packer may support the upper end of liner 128 in vertical casing 112. However, in accordance with an advantageous feature of this invention, liner 128 may not even require a liner hanger. This is because the length of liner 128 required to go from vertical (or near vertical) to horizontal is relatively short. The bulk of the liner is resting on the lower side of the wellbore. The weight of the upper portion of liner 128 which is in the build section is thus transferred to the lower section. Use of an ECP or cementing of the liner further reduces the need for traditional liner hangers.

Figure 5G:
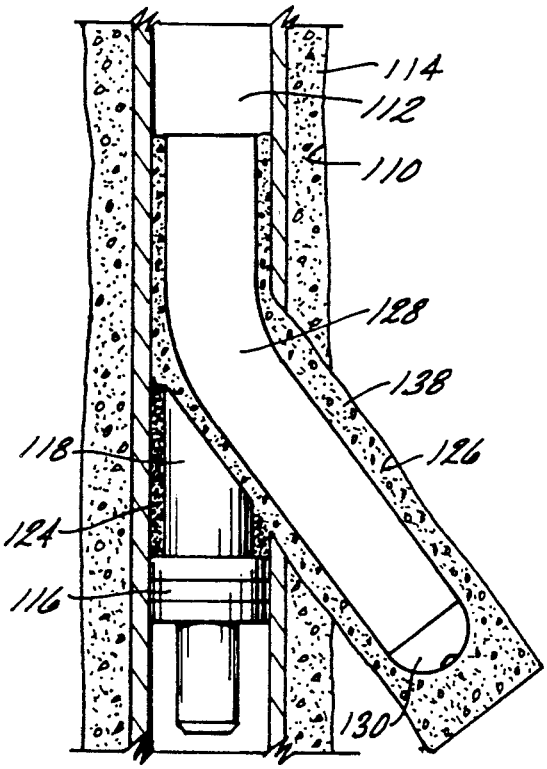
Figure 5H:
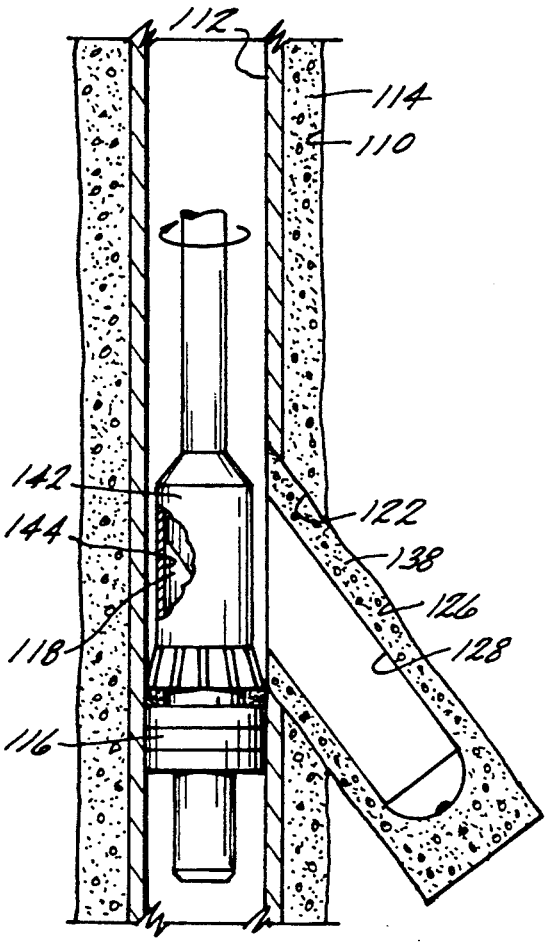
Figure 5I:
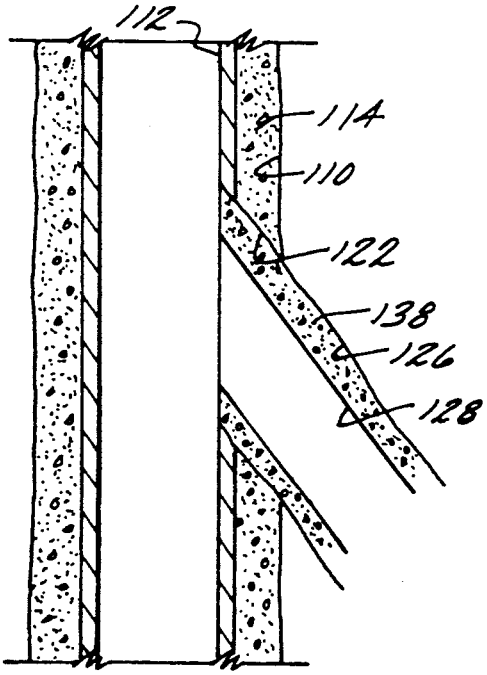

After the cement has hardened, the liner running tool is removed FIG. 5G) and as shown in FIG. 5H, a thin walled mill 142 mills through that portion of liner 128 and cement 138 which is positioned within the diameter of vertical casing 112. Mill 142 includes a central axial opening which is sized so as to receive retrievable whipstock 118 without damaging whipstock 118 as shown in FIG. 5H. As an alternative, a conventional mill 142 may be used which would not only mill through a portion of liner 128 and cement 138, but also mill through whipstock 118 and whipstock packer 116. After mill 142 is removed, a pressure tight junction between vertical casing 112 and lateral casing 128 has been provided with an internal diameter equivalent to the existing vertical casing 112 as shown in FIG. 5I.

Preferably, the thin walled mill 142 having the axial bore 144 for receiving whipstock 118 is utilized in this embodiment. This allows for the whipstock packer assembly remain undamaged, and be removed and reinserted downhole at another selected lateral junction for easy re-entry of tools for reworking and other remedial applications.

Figure 6A:
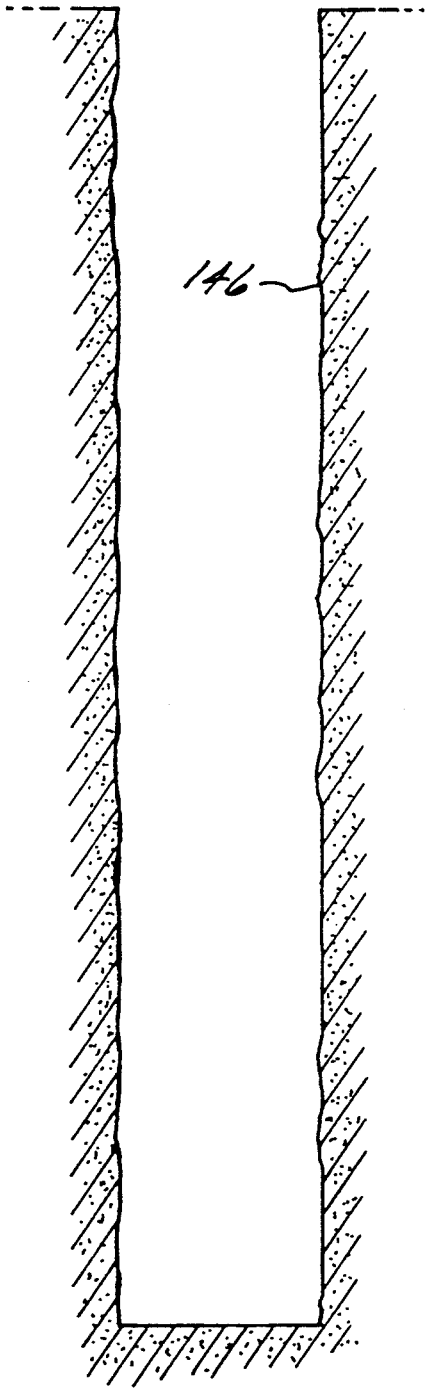
FIGS. 6A–C are sequential cross-sectional elevation views depicting a method for multilateral completion using a novel side pocket mandrel for providing sealing of the juncture between vertical and lateral wells, re-entering of multilaterals and zone isolation for new well completion.
Figure 6B:
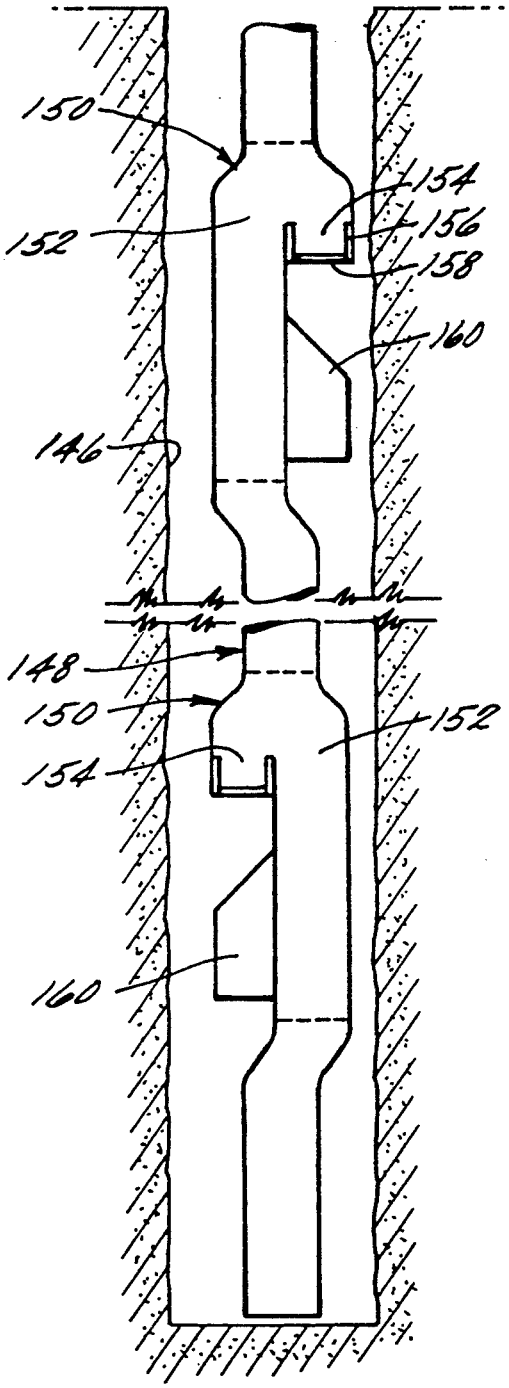
Figure 6C:
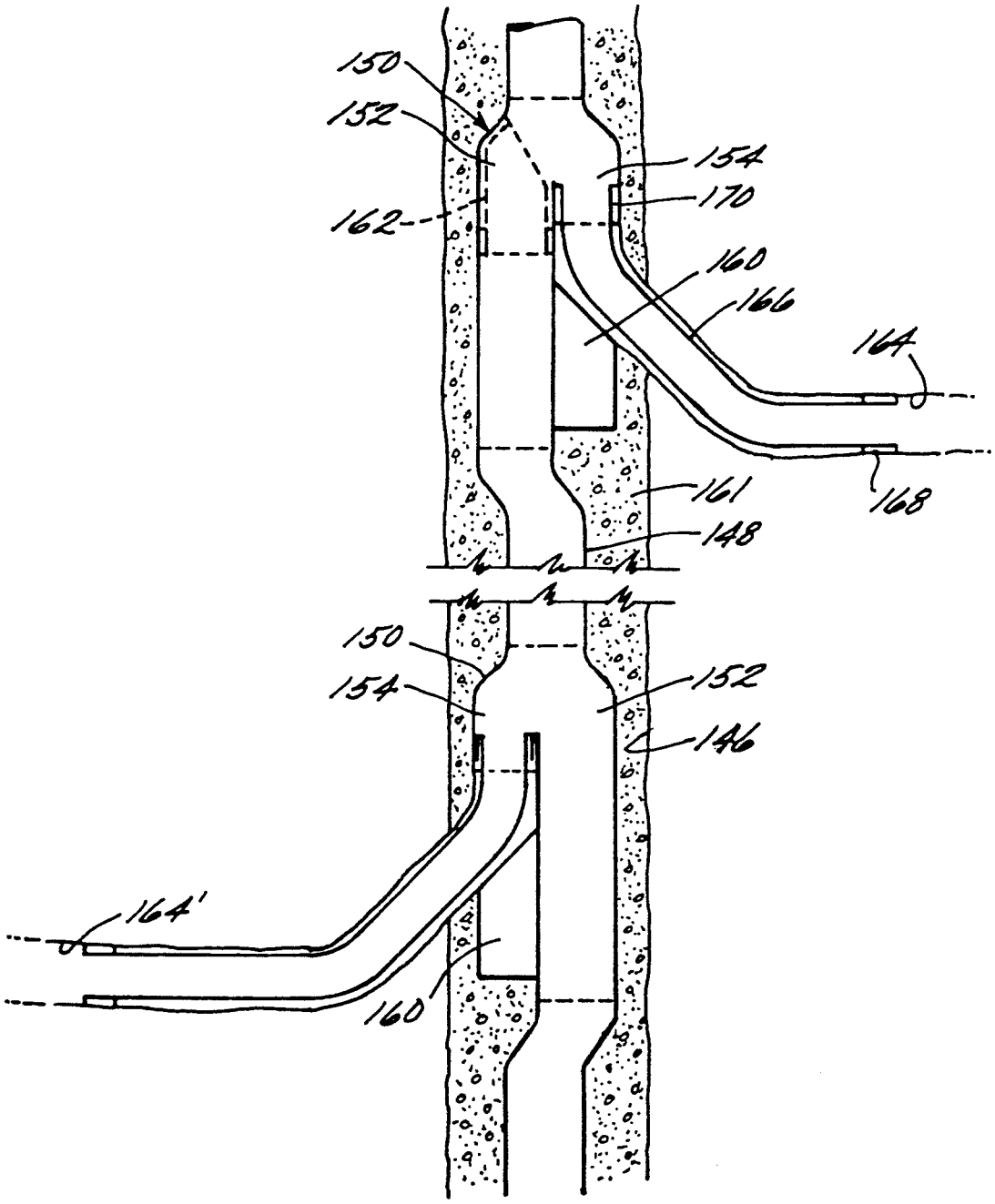
Figure 7A:
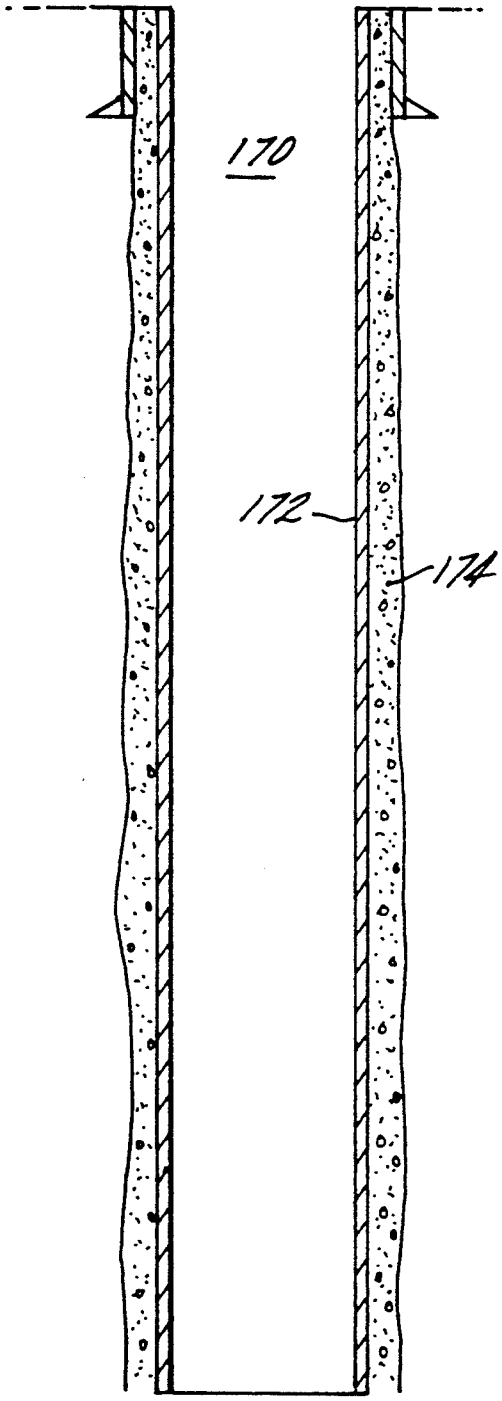
FIGS. 7A–D are sequential cross-sectional elevation views depicting a method similar to that of FIGS. 6A–C for completion of existing wells.
Figure 7B:
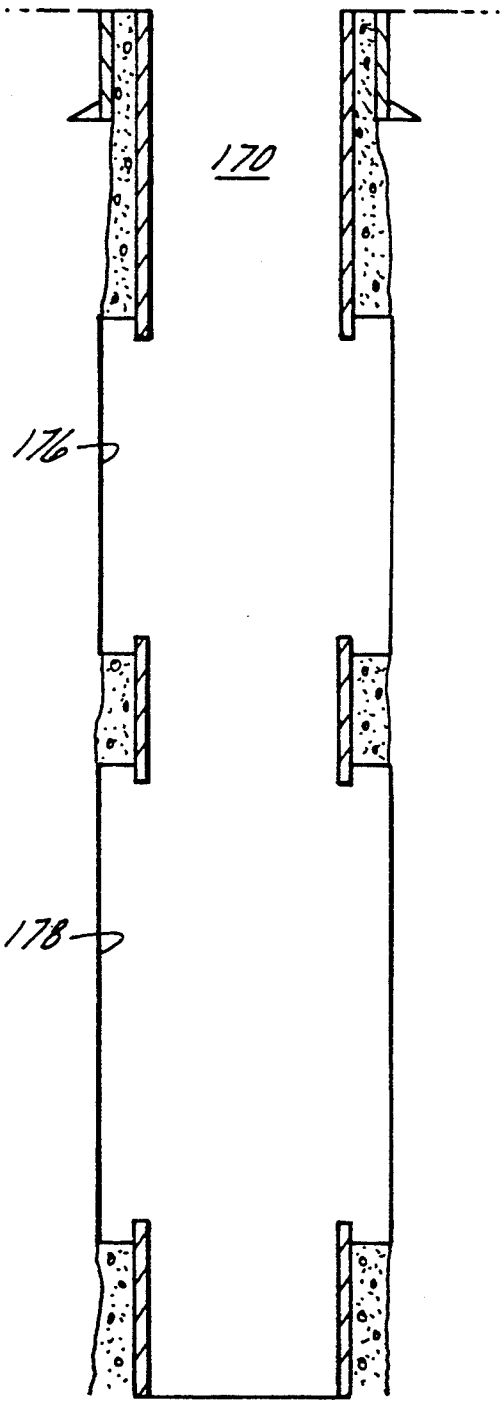
Figure 7C:
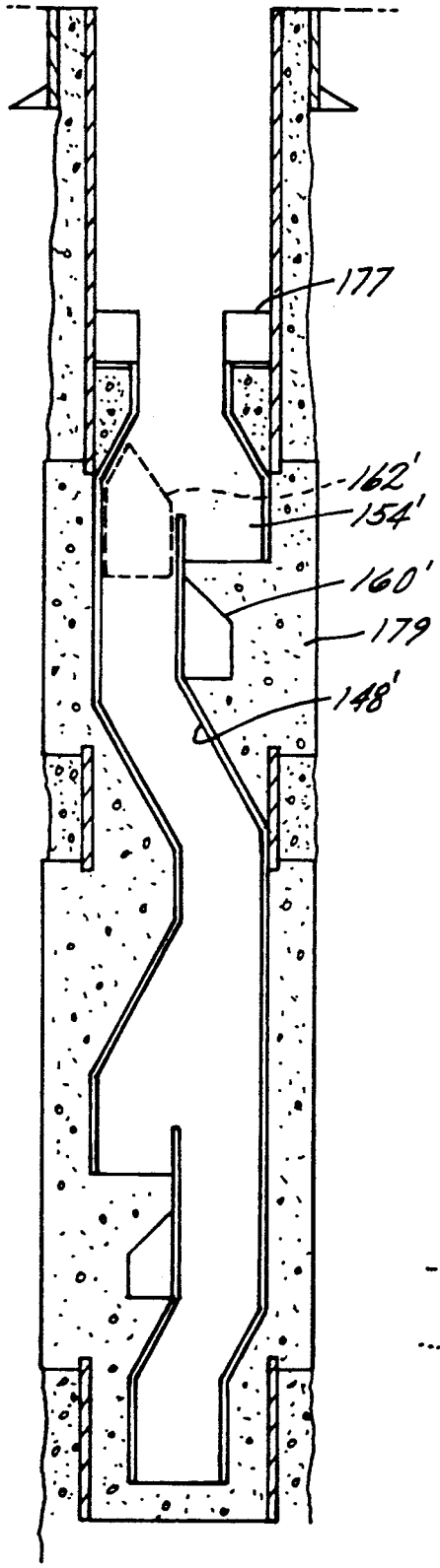

Referring now to FIGS. 6A–C and 7A–C, still another embodiment of the present invention is depicted wherein a novel side pocket mandrel apparatus (sometimes referred to as a guide means) is used in connection with either a new well or existing well for providing sealing between the junction of a vertical well and one or more lateral wells, provides re-entering of multiple lateral wellbores and also provides zone isolation between respective multilaterals. FIGS. 6A–C depict this method and apparatus for a new well while FIGS. 7A–C depict the same method and apparatus for use in an existing well. Referring to FIG. 6A, the wellbore 146 is shown after conventional drilling. Next, referring to FIG. 6B, a novel side pocket or sidetrack mandrel 148 is lowered from the surface into borehole 146 and includes vertically displaced housings (Y sections) 150. One branch of each Y section 150 continues to extend downwardly to the next Y section or to a lower portion of the borehole. The other branch 154 terminates at a protective sleeve 156 and a removable plug 158. Attached to the exterior of mandrel 148 and disposed directly beneath branch 154 is a built-in whipstock or deflector member 160. It will be appreciated that each branch 154 and its companion whipstock 160 are preselectively positioned on mandrel 148 so as to be positioned in a location wherein a lateral borehole is desired.

Turning now to FIG. 6C, cement 161 is then pumped downhole between mandrel 148 and borehole 146 so as to cement the entire mandrel within the borehole. Next, a known bit diverter tool 162 is positioned in Y branch 152 which acts to divert a suitable mill (not shown) into Y branch 154. Plug 158 is removed and this mill contacts whipstock 160 where it is diverted into and mills through cement 161. Next, in a conventional manner, a lateral 164, 164' is drilled. Thereafter, a lateral liner 166 is positioned within lateral wellbore 164 and retained within the junction between lateral 164 and branch 154 using an inflatable packer such as Baker Service Tools Production Injection Packer Product No. 300-01. The upper portion of liner 166 is provided with a seal assembly 170. This series of steps are then repeated for each lateral wellbore.

It will be appreciated that the multilateral completion scheme of FIGS. 6A–C provides an extremely strong seal between the junction of a multilateral borewell and a vertical borewell. In addition, using a bit diverter tool 152, tools and other devices may be easily and selectively re-entered into a particular borehole. In addition, zone isolation between respective laterals are easily accomplished by setting conventional plugs in a particular location.

Figure 7D:
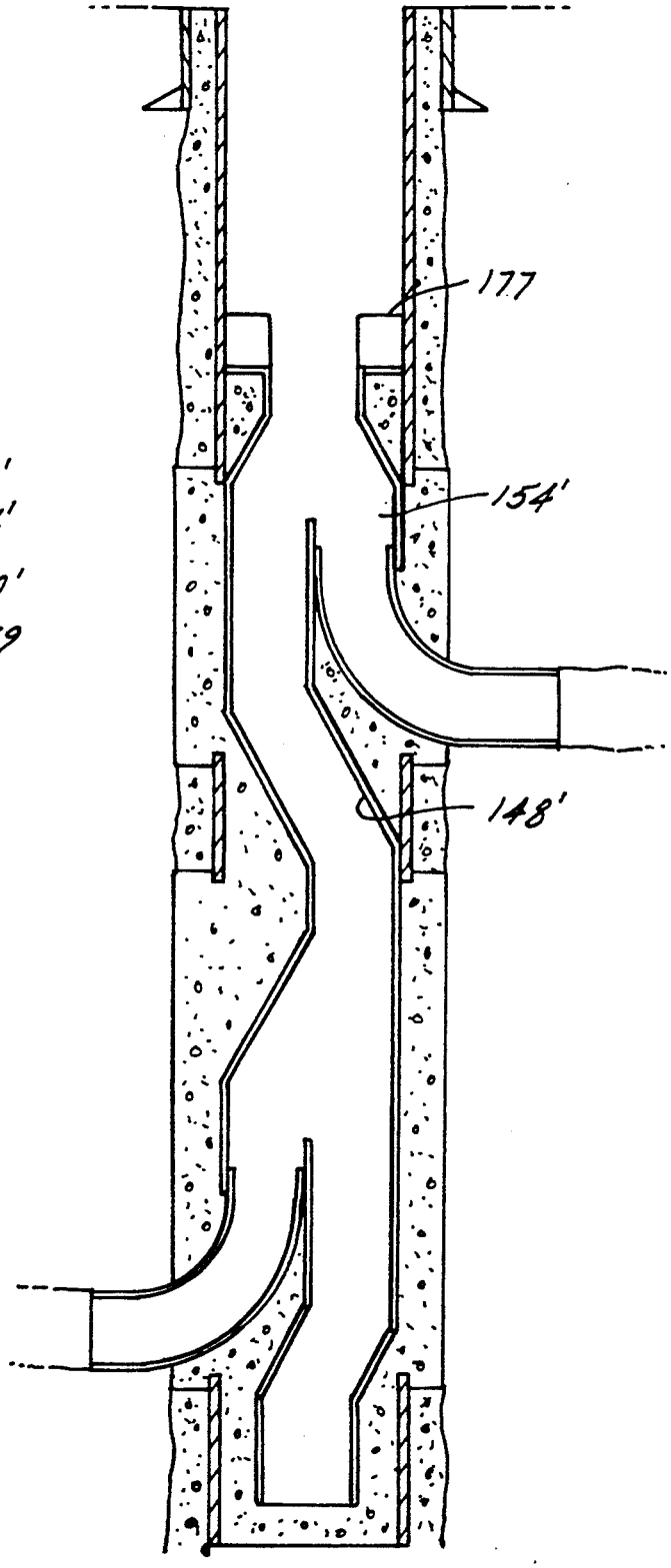

Turning now to FIGS. 7A–D, an existing well is shown at 170 having an original production casing 172 cemented in place via cement 174. In accordance with the method of this embodiment, selected portions of the original production casing and cement are milled and underreamed at vertically displaced locations as dentified at 176 and 178 in FIG. 7B. Next, a mandrel 148' of the type identified at 148 in FIGS. 6A–C is run into casing 172 and supported in place using a liner hanger 176. An azimuth survey is taken and the mandrel 148' is directionally oriented so that branches 154' will be oriented in the right position and vertical depth. Next, cement 178 is loaded between mandrel 148' and casing 172. It will be appreciated that the underreamed sections will provide support for mandrel 148' and will also allow for the drilling of laterals as will be shown in FIG. 7D. Next, as discussed in detail with regard to FIG. 6C, diverter tool 152' is used in conjunction with built-in whipstock 160' to drill one or more laterals and thereafter provide a lateral casing using the same method steps as described with regard to FIG. 6C. The final completed multilateral for an existing well using a side pocket mandrel 148' is shown in FIG. 7D wherein the juncture between the several laterals and the vertical wellbore are tightly sealed, each lateral is easily reentered for rework and remeadial and simulation work, and the several multilaterals may be isolated for separating production zones.

Figure 8B:
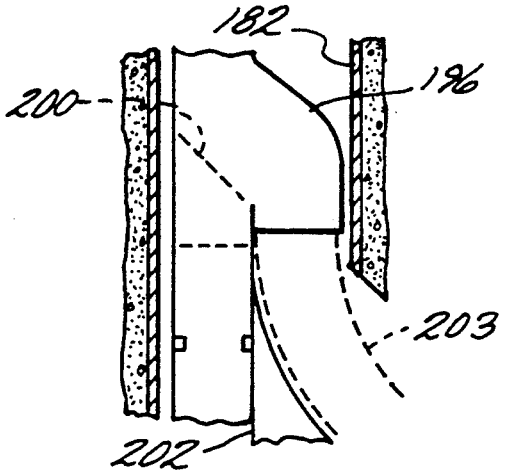
FIG. 8B is an enlarged cross-sectional view of a portion of FIG. 8A.
Figure 8A:
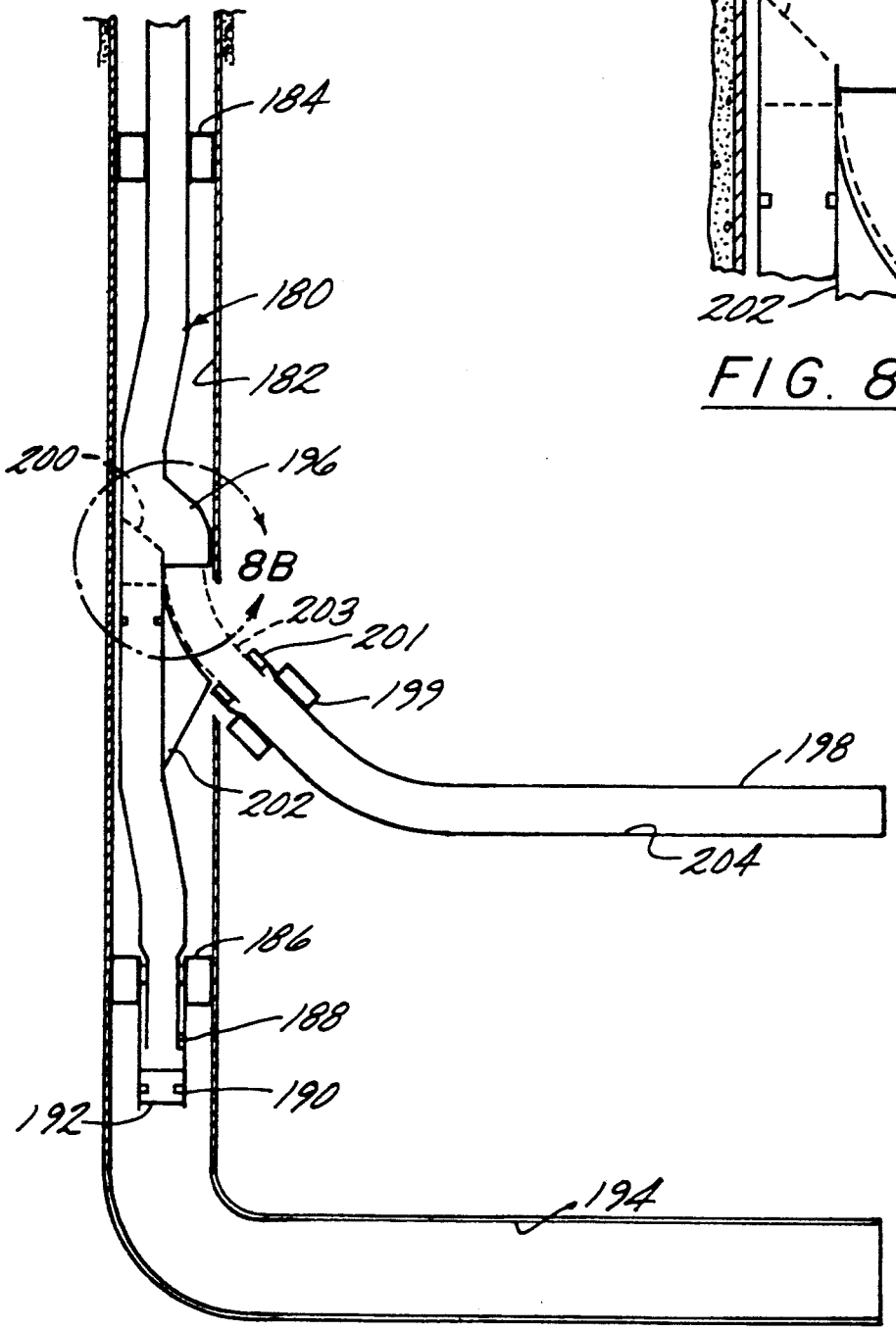
FIG. 8A is a cross-sectional elevation view of a multilateral completion method using a mandrel of the type shown in FIGS. 6A–D for providing sealing junctions, ease of re-entry and zone isolation.

Turning now to FIGS. 8A and 8B, an alternative mandrel configuration similar to the mandrel of FIGS.

6 and 7 is shown. In FIGS. 8A and 8B, a mandrel is identified at 180 and is supported within the casing 182 of a vertical wellbore by a packer hanger 184 such as Baker Oil Tools Model "D". Mandrel 180 terminates at a whipstock anchor packer 186 (Baker Oil Tools "DW-1" and is received by an orientation lug or key 188. Orientation lug 188 hangs from packer 186. Preferably, a blanking plug 192 is inserted within nipple profile 190 for isolating lower lateral 194. Orientation lug 188 is used to orient mandrel 180 such that a lateral diverter portion 196 is oriented towards a second lateral 198. Before mandrel 180 is run, lateral 198 is drilled by using a retrievable whipstock (not shown) which is latched into packer 186. Orientation lug 188 provides torsional support for the retrievable whipstock as well as azimuth orientation for the whipstock face. After lateral 198 is drilled, a liner 204 may be run and hung within lateral 198 by a suitable means such as an ECP 199. A polished bore receptacle 201 may be run on the top of liner 198 to tie liner 198 into main wellbore 182 at a later stage.

The retrievable whipstock is then removed from the well and mandrel 180 is then run as described above. A short piece of tubing 203 with seals on both ends may then be run through mandrel 180. The tubing 203 is sealed internally in the diverter portion 196 and in the PBR 210 thus providing pressure integrity and isolation capability for lateral 198. It will be appreciated that lateral 198 may be isolated by use of coil tubing or a suitable plug inserted therein. In addition, lateral 198 may be easily re-entered as was discussed with regard to the FIGS. 6–8 embodiments.

Figure 9A:
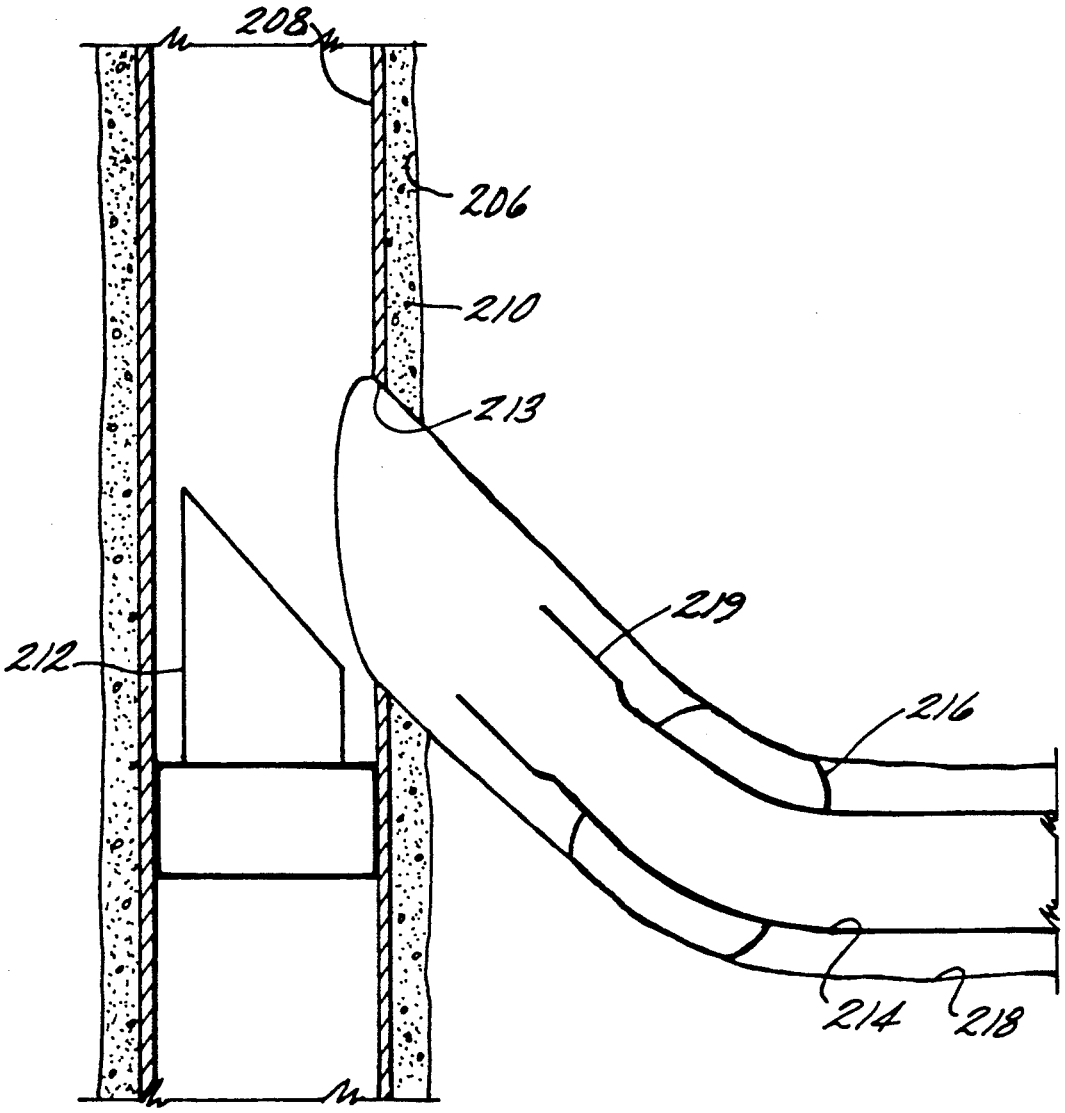
FIGS. 9A–C are sequential cross-sectional elevation views of a multilateral completion method utilizing a mandrel fitted with extendable tubing for providing sealed junctions, ease of re-entry and zone isolation.
Figure 9B:
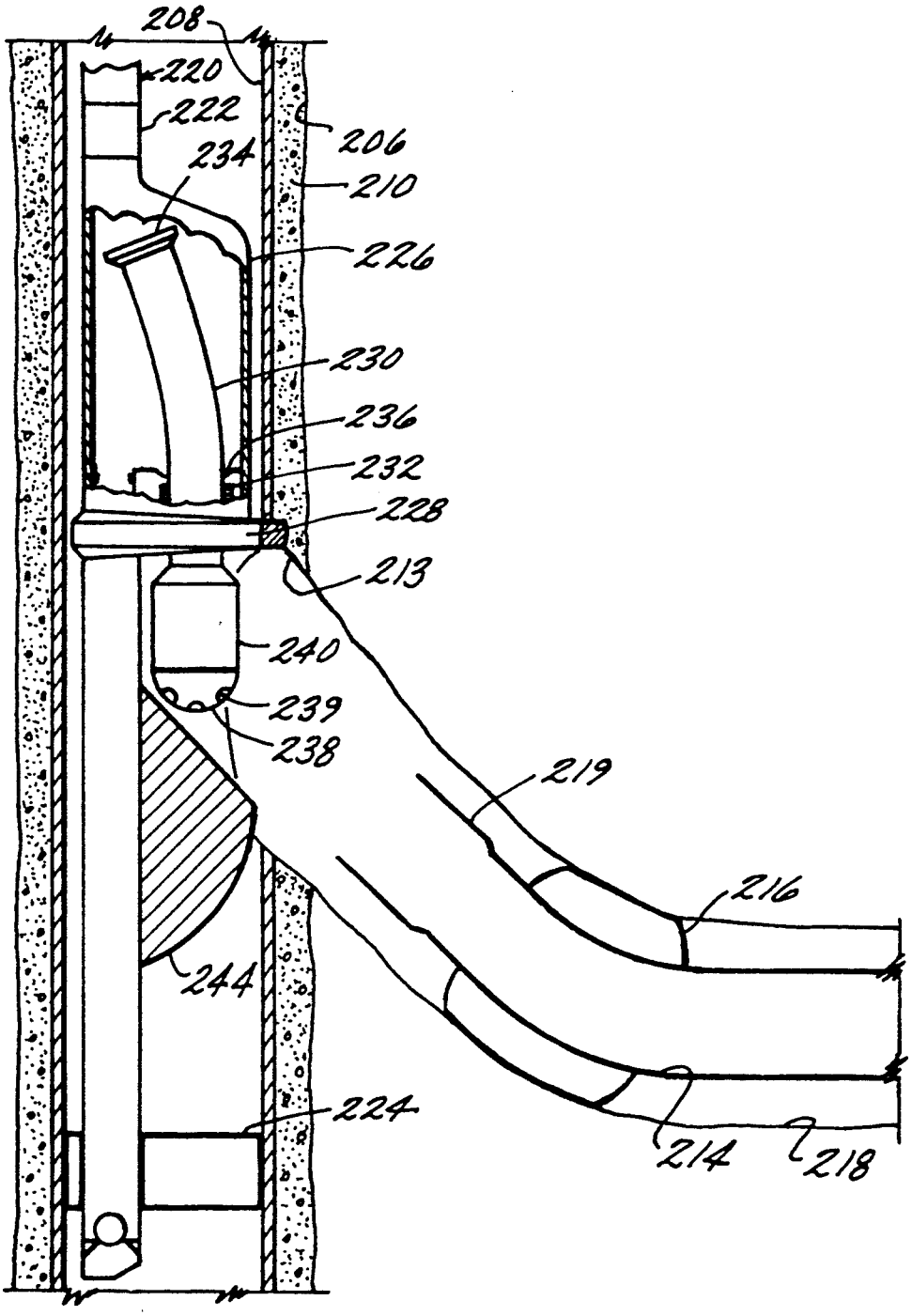
Figure 9C:
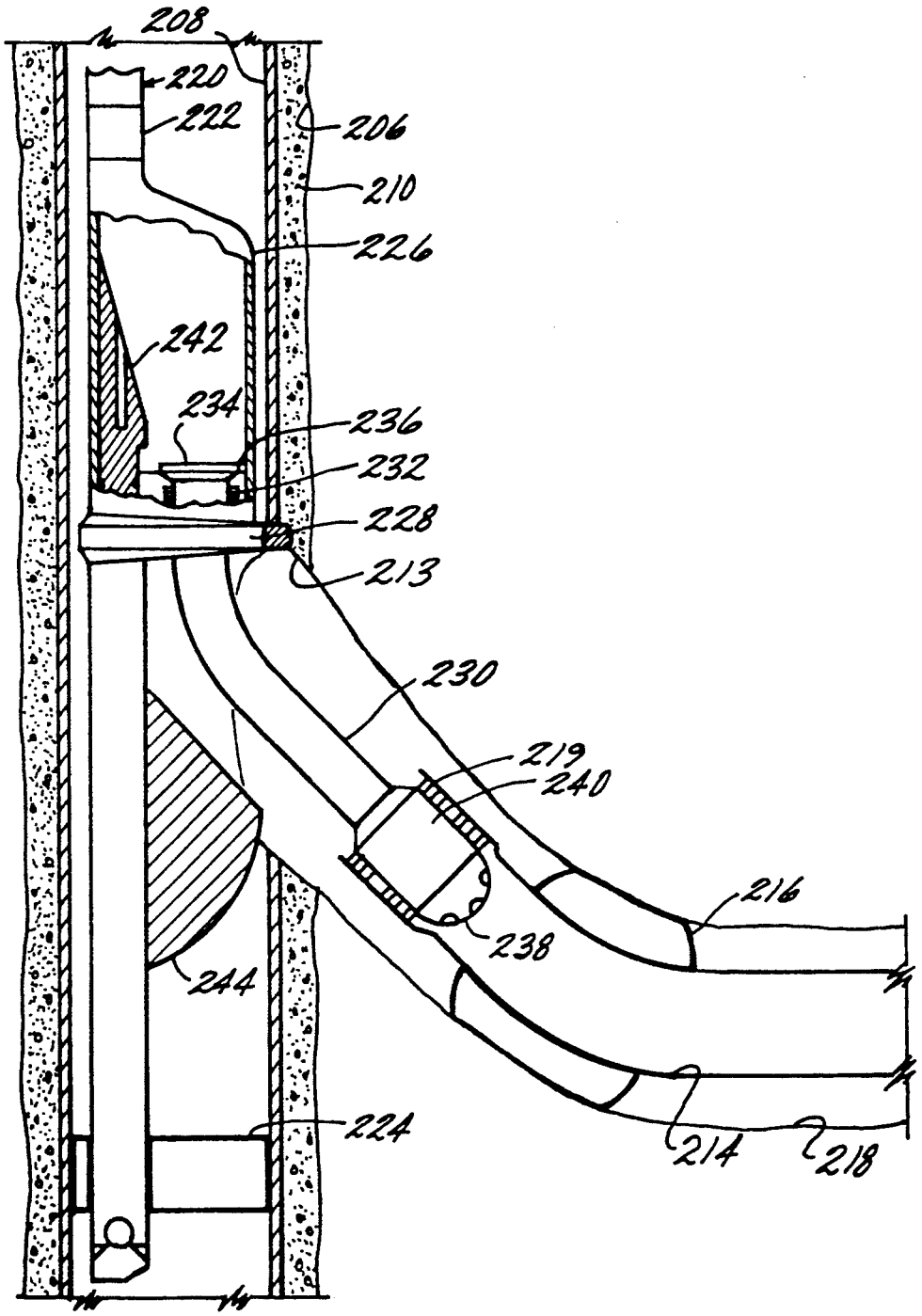

Referring now to FIGS. 9A–C, still another embodiment of a multilateral completion method using a guide means or side track mandrel will be described. FIG. 9A shows a vertical wellbore 206 having been conventionally completed using casing 208 and cement 210. Lateral wellbore 218 may either be a new lateral or preexisting lateral. If lateral 218 is new, it is formed in a conventional manner using a whipstock packer assembly 212 to divert a mill for milling a window 213 through casing 208 and cement 210 followed by a drill for drilling lateral 218. A liner 214 is run into lateral 218 where it is supported therein by ECP 216. Liner 214 terminates at a polished bore receptacle (PBR) 219.

Turning now to FIG. 9B, a sidetrack mandrel 220 is lowered into casing 208. Mandrel 220 includes a housing 226 which terminates at an extendable key and gauge ring 228 wherein the entire sidetrack mandrel may rotate (about swivel 222) into alignment with the lateral when picked up from the surface with the extendable key 228 engaging window 213. Once mandrel 220 is located properly with respect to lateral 218, packer 224 is set either hydraulically or by other suitable means. Housing 226 includes a laterally extended section which retains tubing 230. Tubing 230 is normally stored within the sidetrack mandrel housing 226 for extension (hydraulically or mechanically) into lateral 218 as will be discussed hereinafter. A seal 232 is provided in housing 226 to prevent fluid inflow from within casing 208. Tube 230 terminates at its upper end at a flanged section 234 which is received by a complementary surface 236 at the base of housing 226. Tube 230 terminates at a lower end at a round nose ported guide 238 which is adjacent a set of seals 240. Port guide 238 may include a removable material 239 (such as zinc) in the ports to permit access into lateral liner 214. After mandrel 220 is precisely in position adjacent lateral 218, tubing 230 is hydraulically or mechanically extended downwardly through housing 226 whereupon head 238 will contact a whipstock diverter 244 which deflects head 238 into PBR 219. Seals 240 will form a fluid tight seal with PBR 218 as shown in FIG. 9C. Diverter 242 may then be run to divert tools into lateral 218. Alternatively, a known kick-over tool may be used to divert tools into lateral 218.

Extendable tubing 230 is an important feature of this invention as it provides a larger diameter opening than is possible if the tubular connection between the lateral and side track mandrel is run-in from the surface through the internal diameter of a workstring.

As shown in FIG. 9C, the completion method described herein provides a sealed juncture between a lateral 218 and a vertical casing 208 via tubing 230 and also allows for re-entry into a selected lateral using a diverter 242 or kick-over tool for selective re-entry into tubing 230 and hence into lateral liner 214. In addition, zone isolation may be obtained by appropriate plugging of tube 230 or by use of a blanking plug below the packer.

Figure 10A:
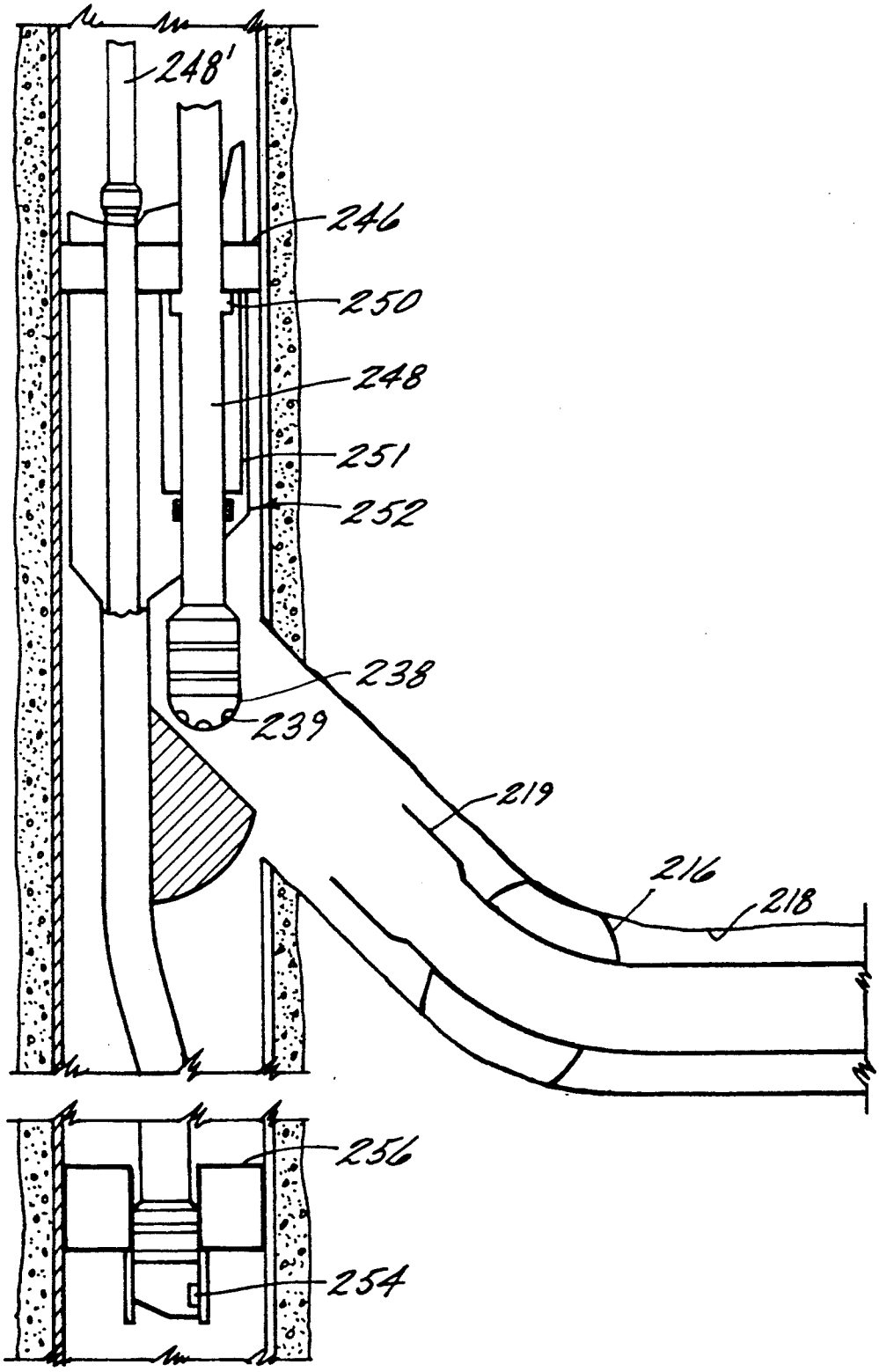
FIGS. 10A–B are sequential cross-sectional elevation views of a multilateral completion method similar to the method of FIGS. 9A–C, but utilizing a dual packer for improved zone isolation.
Figure 10B:
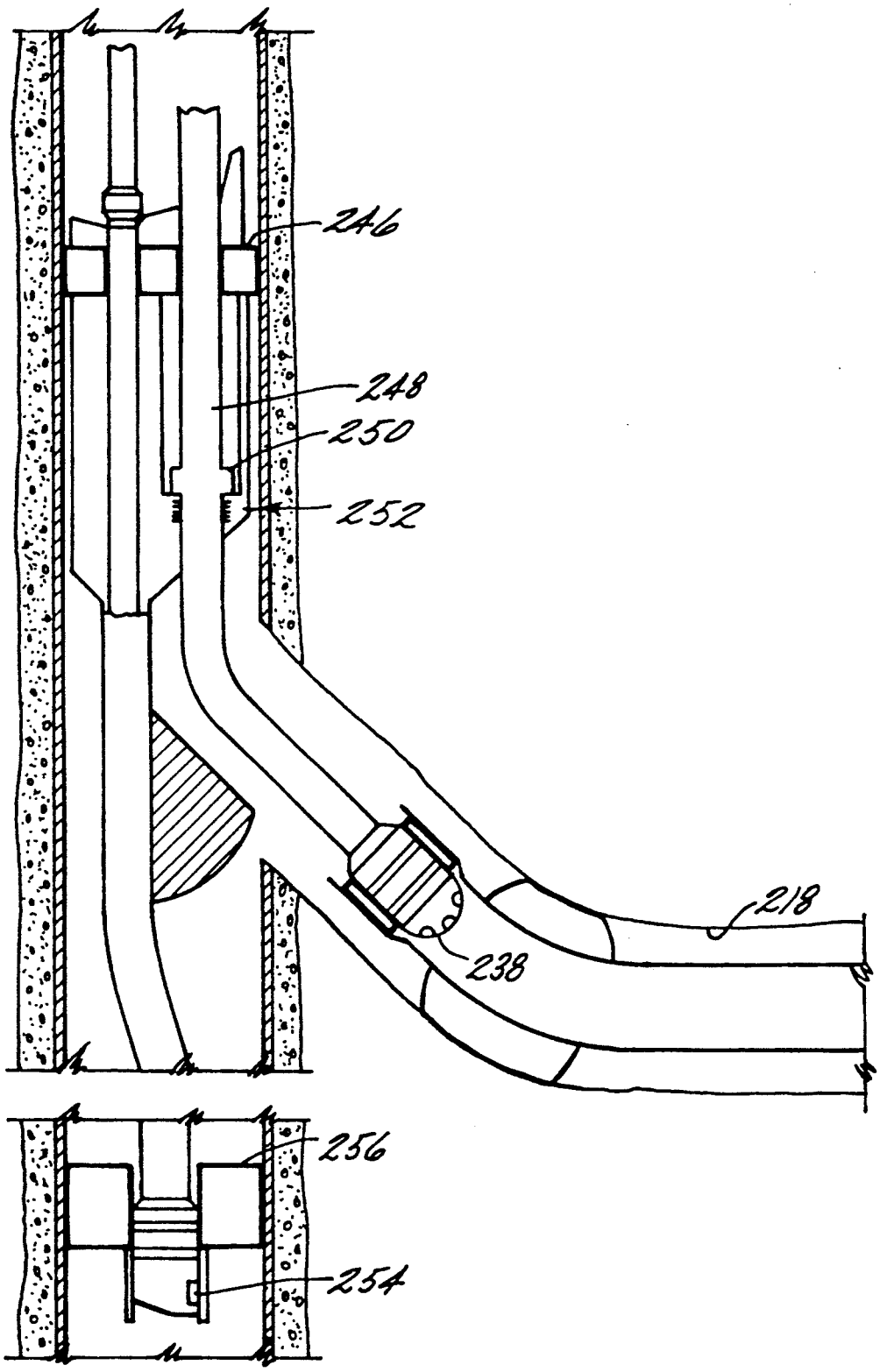

The embodiment of FIGS. 10A–B is similar to the embodiments of FIGS. 9A–C with the difference primarily residing in improved zone isolation with respect to the FIG. 10 embodiment. That is, the FIG. 10 embodiment utilizes a dual packer assembly 246 together with a separated running string 248 (as opposed to the shorter (but typically larger diameter) extendable tube 230). Running string 248 includes a pair of shoulders 250 which acts as a stop between a non-sealed position shown in FIG. 10A and a sealed position shown in FIG. 10B. The dual packer assembly 246 is positioned as part of a housing 250 which defines a modified side pocket mandrel 252. Mandrel 252 may be rotationally orientated within the vertical casing using any suitable means such as an orientation slot 254 which hangs from a whipstock packer 256. It will be appreciated that the embodiment of FIGS. 10A–B provides improved zone isolation through the use of discrete conduits 248, 248' each of which can extend from distinct multilateral borewells.

Figure 11A:
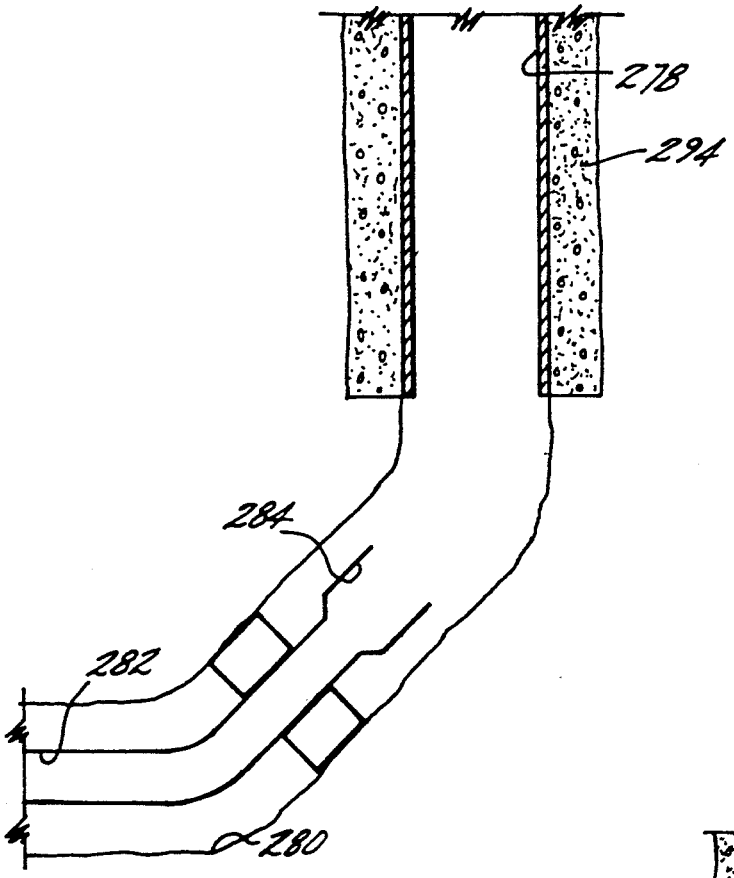
FIGS. 11A–D are sequential cross-sectional elevation views of a multilateral completion head packer assembly for providing sealed junctions, ease of re-entry and zone isolation.
Figure 11B:
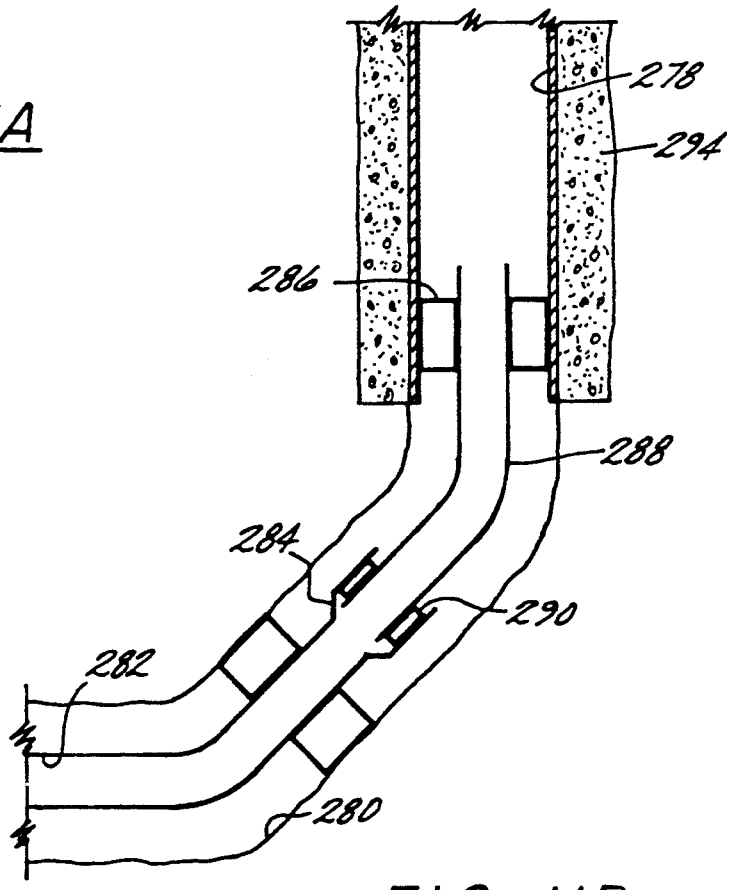

Tuning now to FIGS. 11A–E, still another embodiment of the present invention is shown wherein multilateral completion is provided using a dual completion head. Turning first to FIG. 11A, a vertical wellbore is shown after being cased with casing 278 and cement 294. In accordance with conventional methods, a horizontal wellbore is drilled at 280 and a liner 282 is positioned in the uncased lateral opening 280. Liner 282 is supported in position using a suitable external casing packer such as Baker Service Tools Model RTS Product No. 30107. An upper seal bore 284 such as a polished bore receptacle is positioned at the upper end of liner 282. In FIG. 11B, a whipstock anchor packer 286 such as Baker Oil Tools "DW-1" is positioned at the base of casing 278 and provided with a lower tubular extension 288 which terminates at seals 290 received in PBR 284.

Figure 11C:
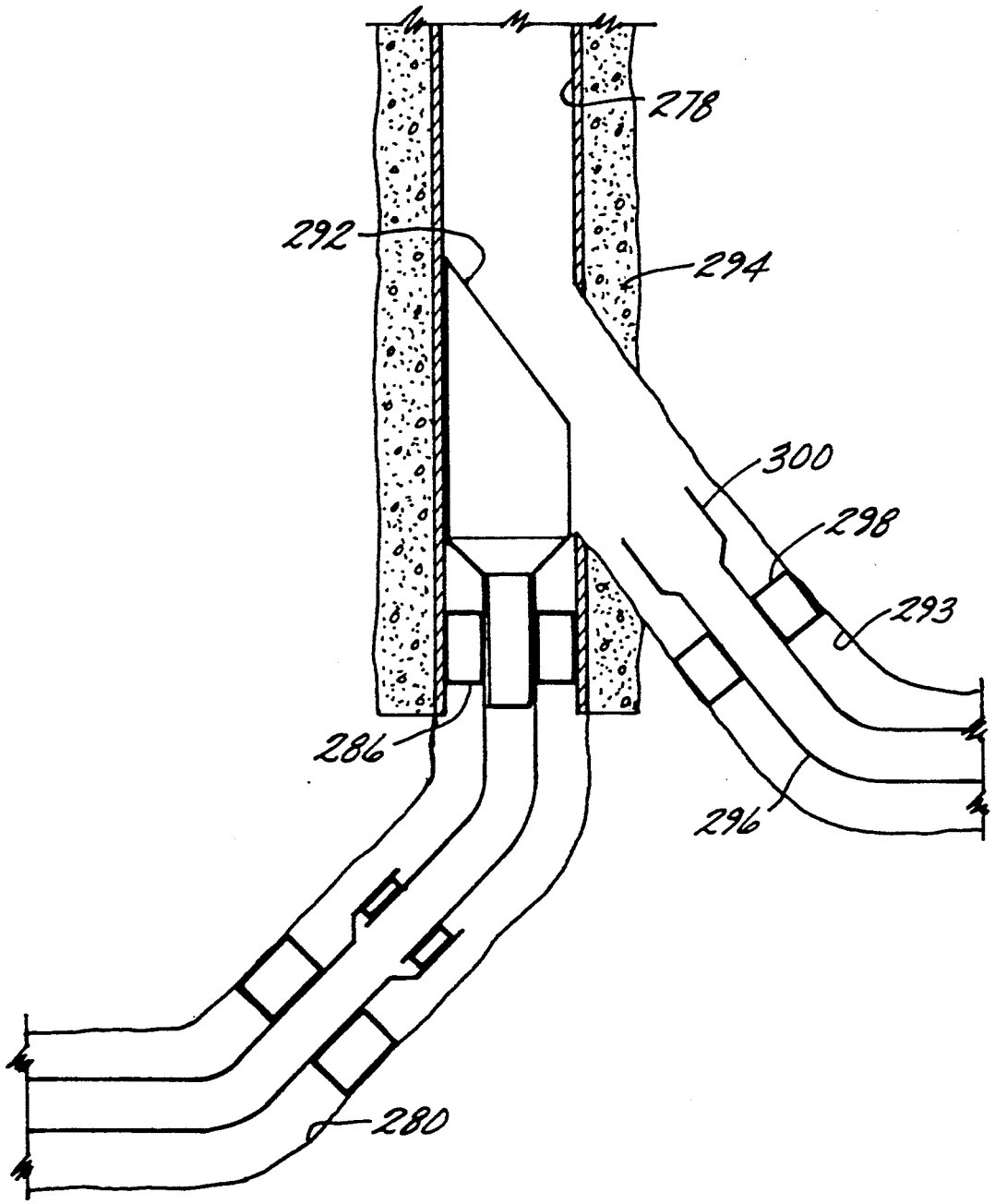

In FIG. 11C, a retrievable drilling whipstock 292 is lowered into casing 278 and supported by whipstock anchor packer 286. Next, a second lateral wellbore 293 is drilled in a conventional manner (initially using a mill) to mill through casing 278 and cement 294 followed by a drill for drilling lateral 293. Lateral 293 is then provided with a liner 296, ECP 98 and PBR 300 as was done in the first lateral 280. Thereafter, retrievable whipstock 292 is retrieved from the vertical wellbore and removed to the surface.

Figure 11E:
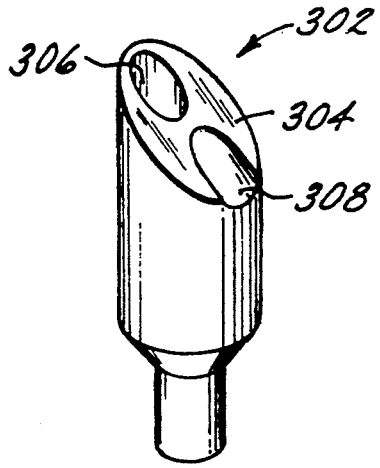
FIG. 11E is a perspective view of the dual completion head used in the method of FIGS. 11A–D.
Figure 11D:
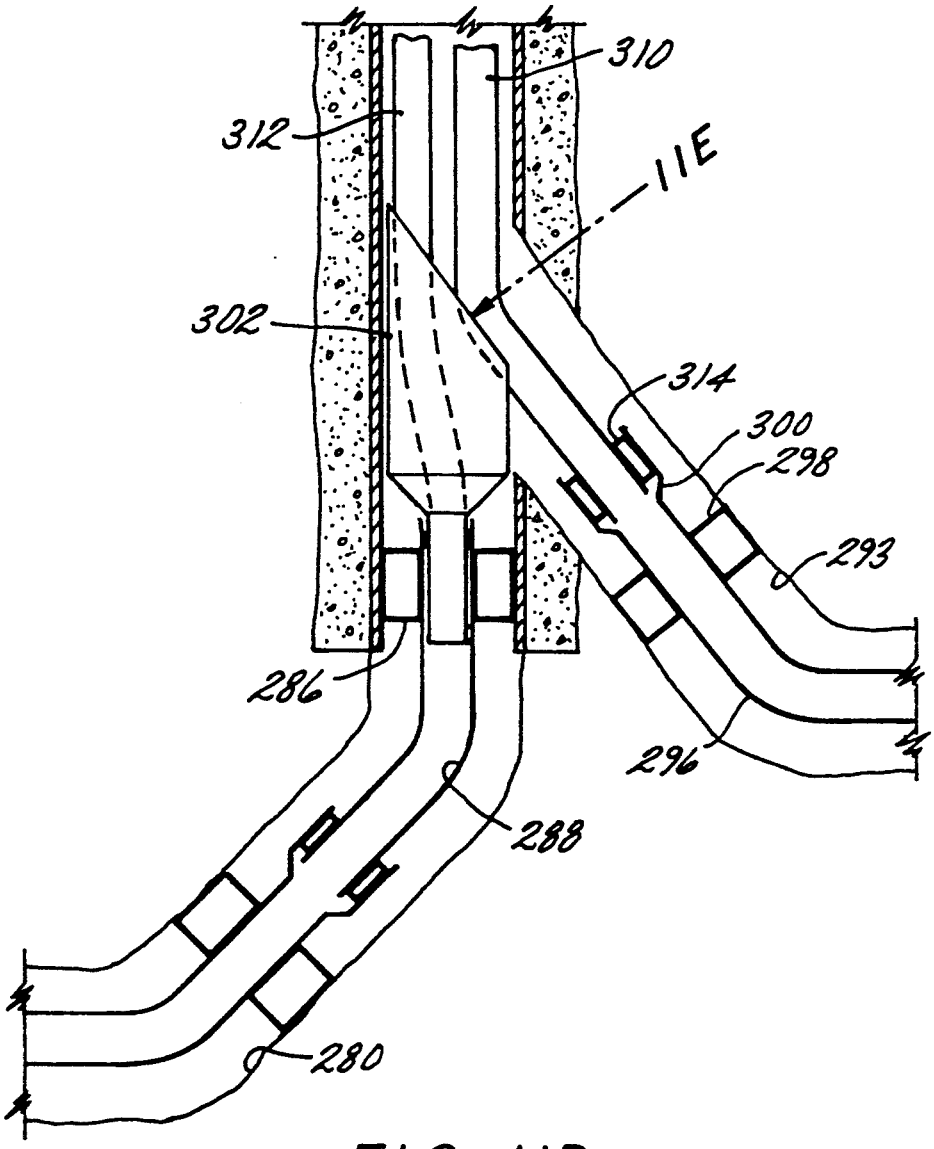

In accordance with an important feature of this embodiment, a dual completion head shown generally at 302 in FIG. 11E is lowered into the vertical wellbore and into whipstock anchor packer as shown in FIG. 11D. Dual completion head 302 has an upper deflecting surface 304 and includes a longitudinal bore 306 which is offset to one end thereof. In addition, deflecting surface 304 includes a scooped surface 308 which is configured to be a complimentary section of tubing such as the tubing identified at 310 in FIG. 11D. Thus, a first tubing 312 is stung from the surface through bore 306 of dual completion head 302, through packer 286 and into tubing 288. Similarly, a second tubing 310 is stung from the surface and deflected along scoop 308 of dual completion head 302 where it is received and sealed in PBR 300 via seals 314.

It will be appreciated that the method of FIGS. 11A–D provides sealing of the juncture between one or more laterals in a vertical wellbore and also allows for ease of re-entry into a selected lateral wellbore while permitting zone isolation for isolating one production zone from another with regard to a multilateral wellbore system.

Figure 12:
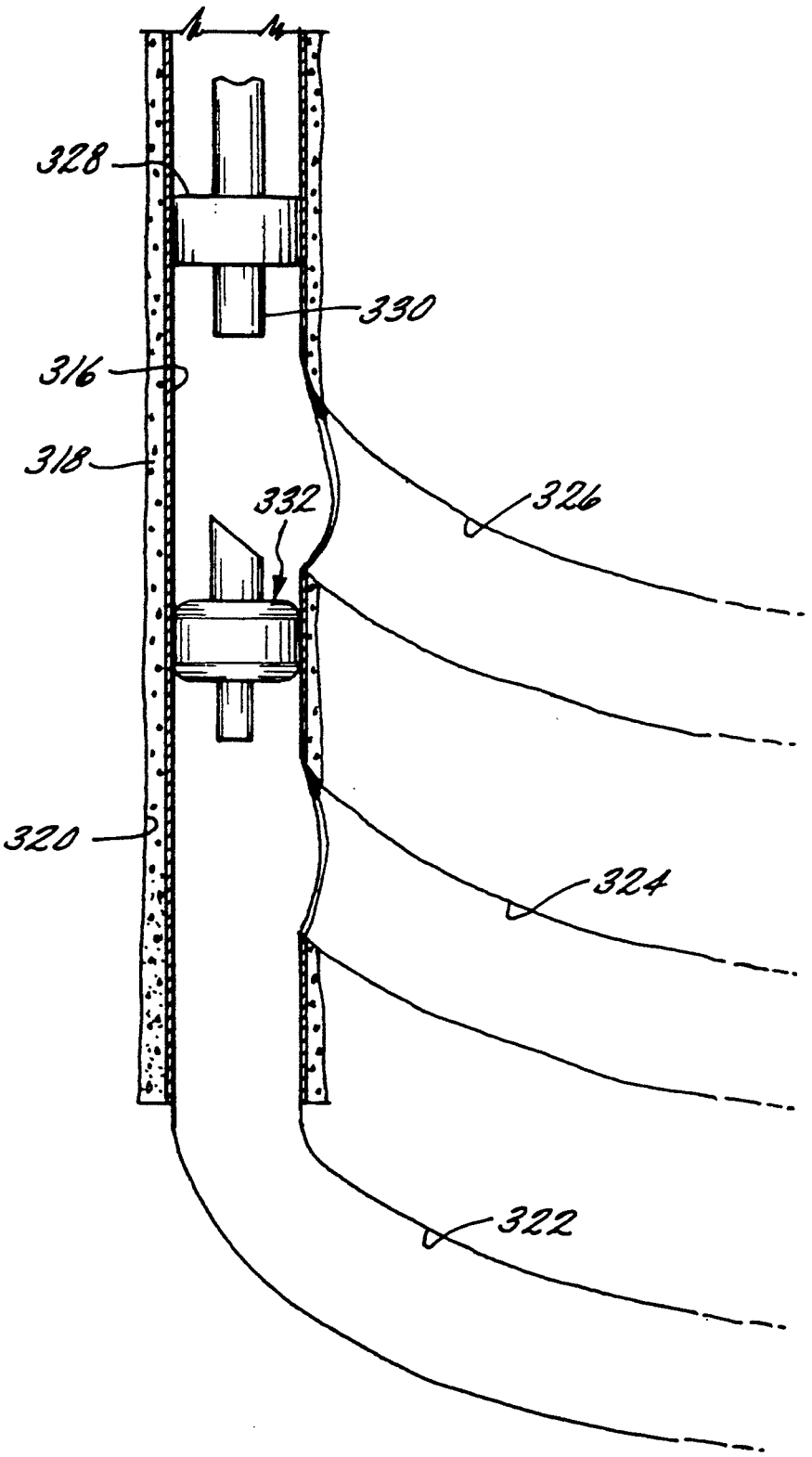
FIG. 12 is a cross-sectional elevation view of a multilateral completion method utilizing an inflatable bridge plug with whipstock anchor for re-entry into a selective lateral wellbore.

Turning now to FIG. 12, still another multilateral completion method in accordance with the present invention will now be described which is particularly well-suited for selective re-entry into lateral wells for completions, additional drilling or remedial and stimulation work. In FIG. 12, a vertical well is conventionally drilled and a casing 316 is cemented via cement 318 to the vertical wellbore 320. Next, vertical wellbores 322, 324 and 326 are drilled in a conventional manner wherein retrievable whipstock packer assemblies (not shown) are lowered to selected areas in casing 31. A window in casing 316 is then milled followed by drilling of the respective laterals. Each of laterals 322, 324 and 326 may then be completed in accordance with any of the methods described above to provide a sealed joint between vertical casing 316 and each respective lateral.

In accordance with the method of the present invention, a process will now be described which allows quick and efficient re-entry into a selected lateral so that the selected lateral may be reworked or otherwise utilized. In accordance with this method, a packer 328 is positioned above a lateral with a tail pipe 330 extending downwardly therefrom. To re-enter any lateral, an inflatable packer with whipstock anchor profile 332 is stabbed downhole and inflated using suitable coil tubing or other means. Whipstock anchor profile 332 is commercially available, for example, Baker Service Tools Thru-Tubing Bridge Plug. Utilizing standard logging techniques in conjunction with the drilling records, whipstock anchor profile 332 may be oriented into alignment with the lateral (for example, lateral 326 as shown in FIG. 12). Thereafter, the inflatable packer/-whipstock 332 may be deflated using coil tubing and moved to a second lateral such as shown in 324 for re-entry into that second lateral.

Figure 13A:
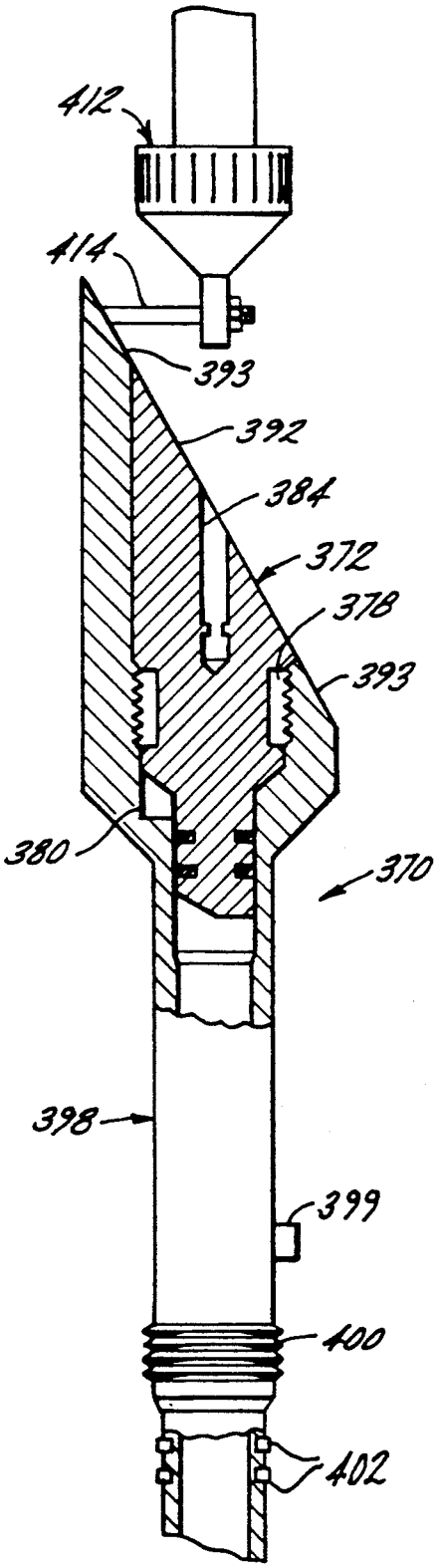
FIGS. 13A–B are cross-sectional elevation views of a production whipstock with retrievable sealing bore with the sealing bore inserted in FIG. 13A and retrieved in FIG. 13B.
Figure 13B:
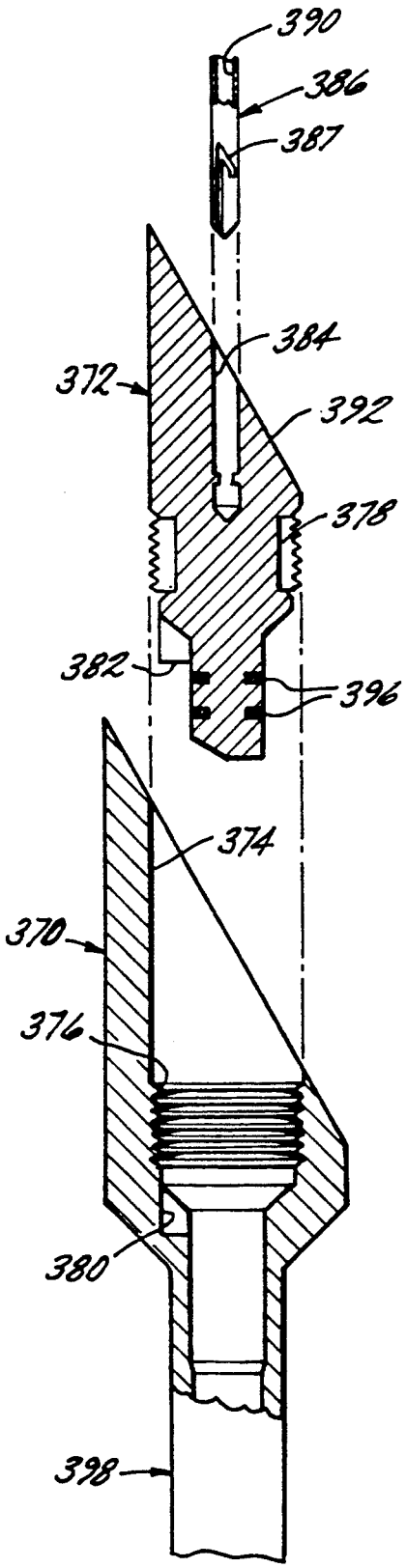
Figure 13C:
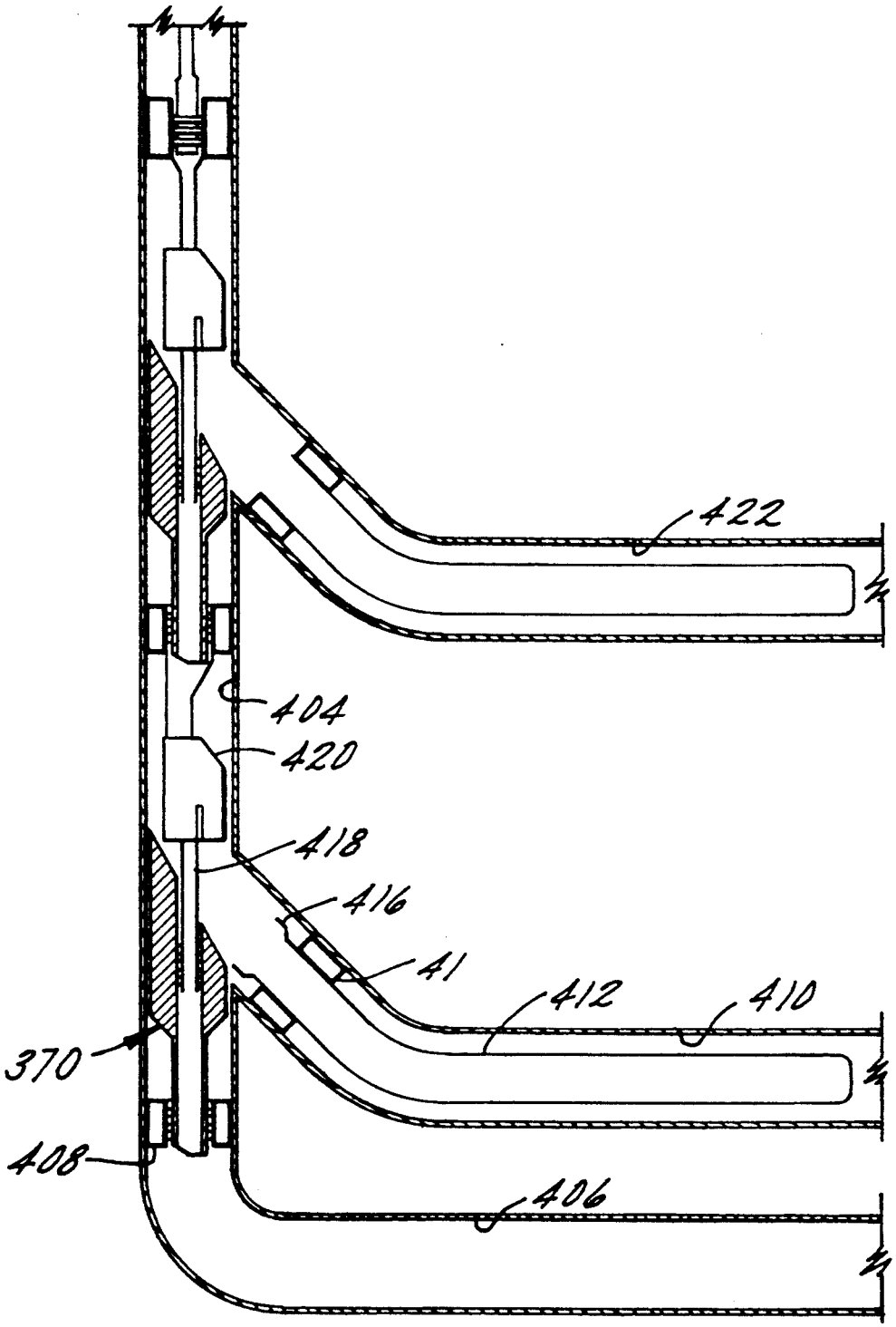
FIG. 13C is a cross-sectional elevation view of a completion method utilizing the production whipstock of FIGS. 13A–B.

Referring to FIG. 13C, still another embodiment of the present invention is shown wherein multilateral completion is accomplished by using a production whipstock 370 having a retrievable sealing plug 372 received in an axial opening 374 through the whipstock. This production whipstock is shown in more detail in FIGS. 13A and B with FIG. 13A depicting the retrievable plug 372 inserted in the whipstock 370 and FIG. 13B depicting the retrievable plug 372 having been withdrawn. Whipstock 370 includes a suitable mechanism for removably retaining retrievable plug 372. One example of such a mechanism is the use of threading 376 (see FIG. 13B) provided in axial bore 374 for latching sealing plug 372 through the interaction of latch and shear release anchors 378. In addition, a suitable locating and orientation mechanism is provided in production whipstock 370 so as to properly orient and locate retrievable plug within axial bore 374. A preferred locating mechanism comprises a locating slot 380 within axial bore 374 and displaced below threading 376. The locating slot is sized and configured so as receive a locating key 382 which is positioned on retrievable sealing plug 372 at a location below latch anchors 378. Sealing plug 372 includes an axial hole 384 which defines a retrieving hole for receipt of a retrieving stinger 386. Retrieving stinger 386 includes one or more J slots (or other suitably configured engaging slots) or fishing tool profile 387 to engage one or more retrieving lugs 388 which extend inwardly towards one another within retrieving hole 384.

Retrievable stinger 386 includes a flow-through 390 for washing. Retrievable plug 372 also has an upper sloped surface 392 which will be planar to a similarly sloped annular ring 393 defining the outer upper surface of whipstock 370. In addition, sealable plug 372 includes optional lower seals 396 for forming a fluid tight seal with an axial bore 374 of whipstock 370.

As will be discussed hereinafter, whipstock 370 includes an orientation device 398 having a locator key 399. The lowermost section of whipstock 370 includes a latch and shear release anchor 400 for latching into the axial opening of a whipstock packer such as a Baker Oil Tools "DW-1". Below latch and shear release anchor 400 are a pair of optional seals 402.

Turning now to FIG. 13C, a method for multilateral completion using the novel production whipstock of FIGS. 13A–B will now be described. In a first step of this method, a vertical wellbore 404 is drilled. Next, a conventional bottom lateral wellbore 406 is then drilled in a conventional manner. Of course, vertical borehole 404 may be cased in a conventional manner and a liner may be provided to lateral wellbore 406. Next, production whipstock 370 with a retrievable plug 372 inserted in the central bore 374 is run down hole and installed at the location where a second lateral wellbore is desired. It will be appreciated that whipstock 370 is supported within vertical wellbore 404 by use of a suitable whipstock packer such as Baker Oil Tools "DW-1". Next, a second lateral is drilled in the conventional manner, for example, by use of a starting mill shown at 412 in FIG. 13A being attached to whipstock 370 by shear bolt 414. Starting mill 412 mills through the casing and cement in a known manner whereupon the mill 412 is withdrawn and a drill drills the final lateral borehole 410. Preferably, lateral 410 is provided with a liner 412 positioned in place by an ECP or packer 414 which terminates at a PBR 416.

In the next step, sealable plug 372 is retrieved using retrieving stinger 386 such that whipstock 370 now has an axial opening therethrough to permit exit and entry of a production string from the surface. It will be appreciated that the sealing bore thus acts as a conduit for producing fluids and as a receptacle to accommodate the pressure integrity seal during completion of laterals above the whipstock 370 which in effect protects debris from travelling downwardly through the whipstock into the lower laterals 406.

Preferably, a wye block assembly is then provided onto production string 418. Wye block 420 is essentially similar to housing 150 in the FIG. 6 embodiment or housing 196 in the FIG. 8 embodiment or housing 226 in the FIG. 9 embodiment. In any case, wye block 420 permits selective exit and entry of a conduit or other tool into lateral 410 and into communication with PBR 416. In addition, wye block 420 may be valved to allow shut off of wellbore 410 on a selective basis to permit zone isolation. For purposes of re-entry, a short section of tubing may be run through the eccentric port of the wye block to seal off the wellbore packer in lateral wellbore 410 followed by sealing of the wye block. This would be appropriate if the production operator did not wish to expose any open hole to production fluids. Also, a separation sleeve may be run through the wye block isolating lateral borewell 410.

It will be appreciated that additional production whipstocks 370 may be used uphole from lateral 410 to provide additional laterals in a multilateral system, all of which may be selectively re-entered and or isolated as discussed. An example of additional a lateral wellbore is shown at 422. Finally, it will be appreciated that while the method of FIG. 13C was described in conjunction with a new wellbore, the multilateral completion method of FIG. 13C may also be utilized in conjunction with reworking and completing an existing well wherein the previously drilled laterals (drainholes) are to be re-entered for reworking purposes.

Turning now to FIGS. 14A–K, 15A–D and 16A–C, still another embodiment of this invention for multilateral wellbore completion will be described. As in the method of FIG. 13C, the method depicted sequentially in FIGS. 14A–K utilize the whipstock assembly with retrievable sealing plug 370 of FIGS. 13A–B. It will be appreciated that while this method will be described in conjunction with a new well, it is equally applicable to multilateral completions of existing wells.

Figure 14D:
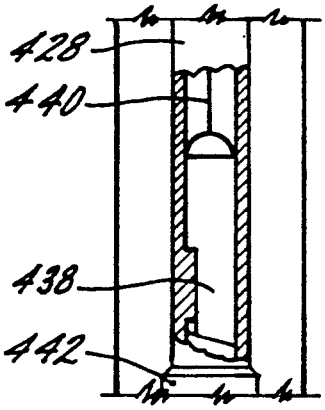
FIGS. 14A–K are cross-sectional elevation views of a multilateral completion method utilizing the production whipstock of FIGS. 13A–B providing selective re-entry in multilateral wellbores and zone isolation.
Figure 14A:
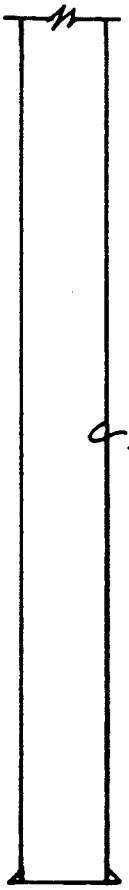
Figure 14B:
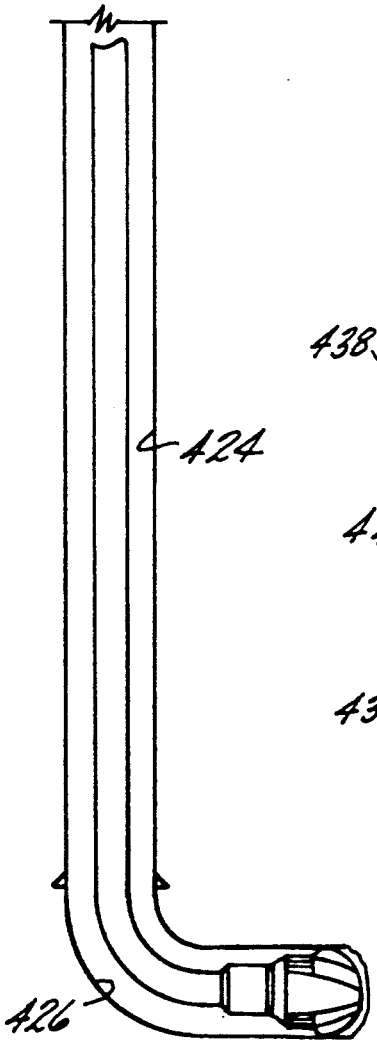
Figure 14C:
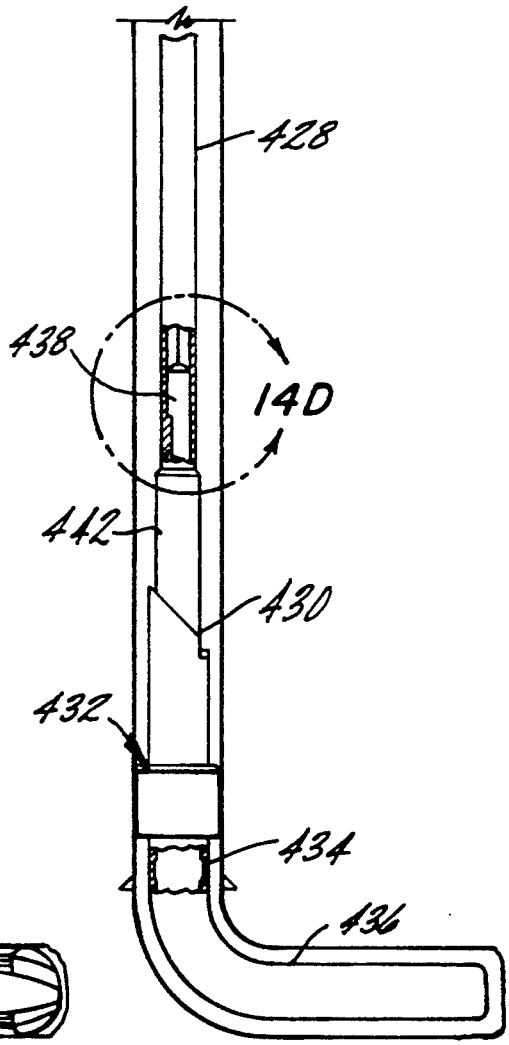

In FIG. 14A, a vertical well is conventionally drilled and completed with casing 424. Next, a bottom horizontal borehole 426 is drilled, again in a conventional manner (see FIG. 14B). In FIG. 14C, a running string 428 runs in an assembly comprising a whipstock anchor-/orientation device 430, a whipstock anchor packer (preferably hydraulic) 432, a nipple profile 434 and liner 436. Pressure is applied to running string 428 to set packer 432. A read-out of the orientation is accomplished via a survey tool 438 (see FIG. 14D) and transmitted to the surface by wireline 440. The running tool is thereafter released (by appropriate pulling of, for example, 30,000 lbs.) and retrieved to the surface.

FIGS. 15A–D depict in detail the orientation whipstock/packer device 430. Device 430 comprises a running tool 442 attached sequentially to an orientation device 444 and a packer 446. At an upper end, running tool 442 includes an orientation key 448 for mating with survey tool 438 (see FIG. 14D). The lower end of tool 442 has a locator key 450 which extends outwardly therefrom. Running tool 442 terminates at a latch-in shear release mechanism 456 (such as is available from Baker Oil Tools, Permanent Packer Systems, Model "E", 37 K" or "N" Latch-In Shear Release Anchor Tubing Seal Assembly) followed by a pair of seals 458.

Orientation device 444 includes an upper sloped annular surface 460. Surface 460 is interrupted by a locator slot 462 which is located and configured to be received by locator key 450. An inner bore 464 of orientation device 444 has a threaded section 466 (preferably left handed square threads). The bottom portion of device 444 is received in packer 446 which preferably is a Baker Oil Tools packer, "DW-1".

Figure 14E:
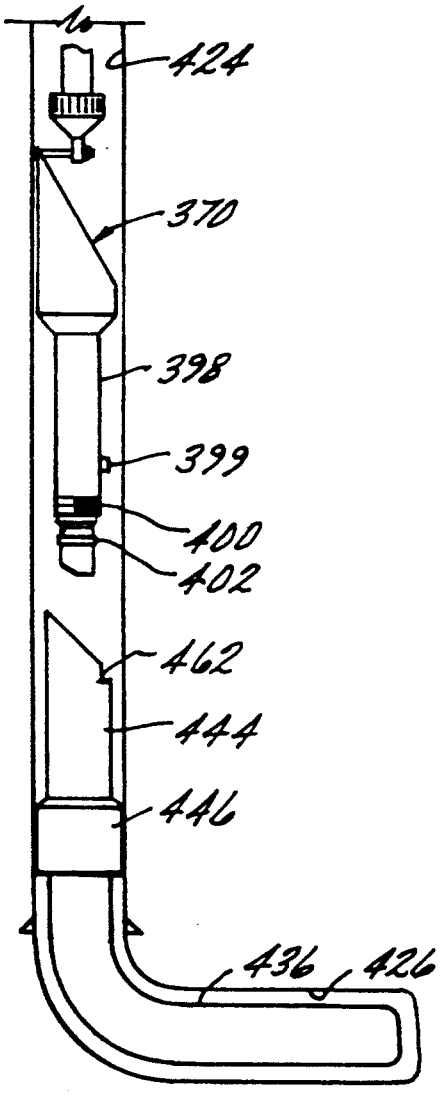

Referring now to FIG. 14E, a description of the completion method will now continue. In FIG. 14E, running tool 442 has been removed so as to leave orientation device in position supported by packer 446. Next, the production whipstock assembly 370 of FIG. 12A–B is run into casing 424. As discussed above, assembly 370 includes keyed orienting device 398 (which corresponds to the lower orienting portion of running tool 442) so that assembly 370 will self-orient (with respect to mating orientation device 444) through interaction of locator slot 462 and locator key 399 and thereby latch (by mating latch mechanism 400 to threaded section 376) onto orientation device 444.

Figure 14F:
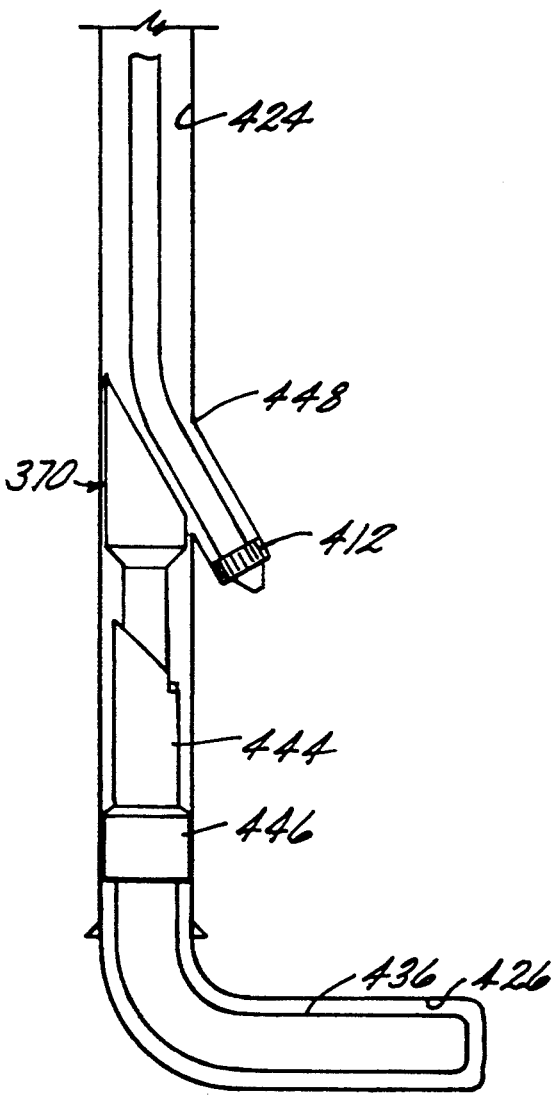
Figure 14G:
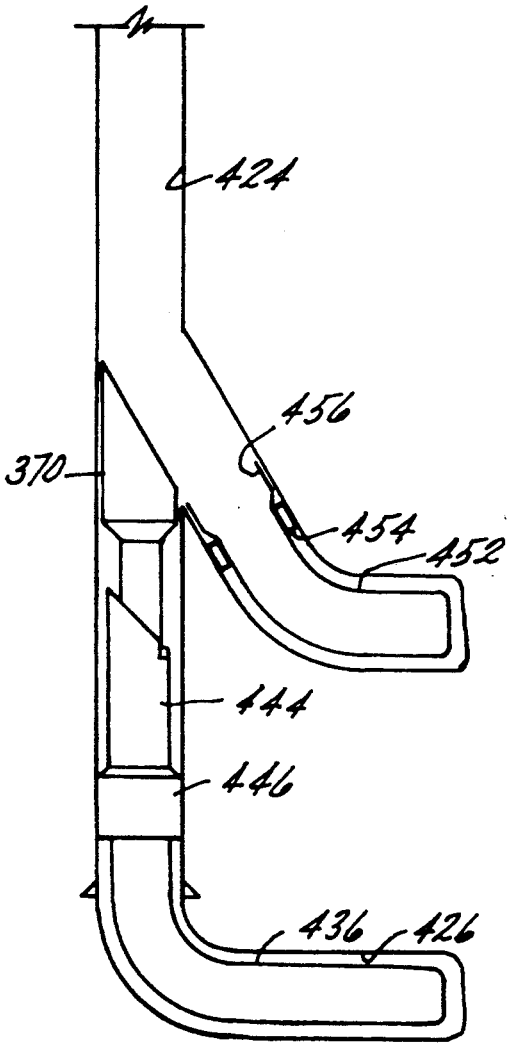

FIG. 14F depicts the milling of a window 448 in casing 424 using a starting mill 412. This is accomplished by applying weight to shear bolt 414. Alternatively, if no starting mill is present on whipstock 370, a running string runs a suitable mill into the borehole in a conventional manner. After a lateral 450 has been drilled, the lateral 450 is completed in a conventional manner using a liner 452 supported by an ECP 454 and terminating at a seal bore 456 (see FIG. 14G).

Figure 14H:
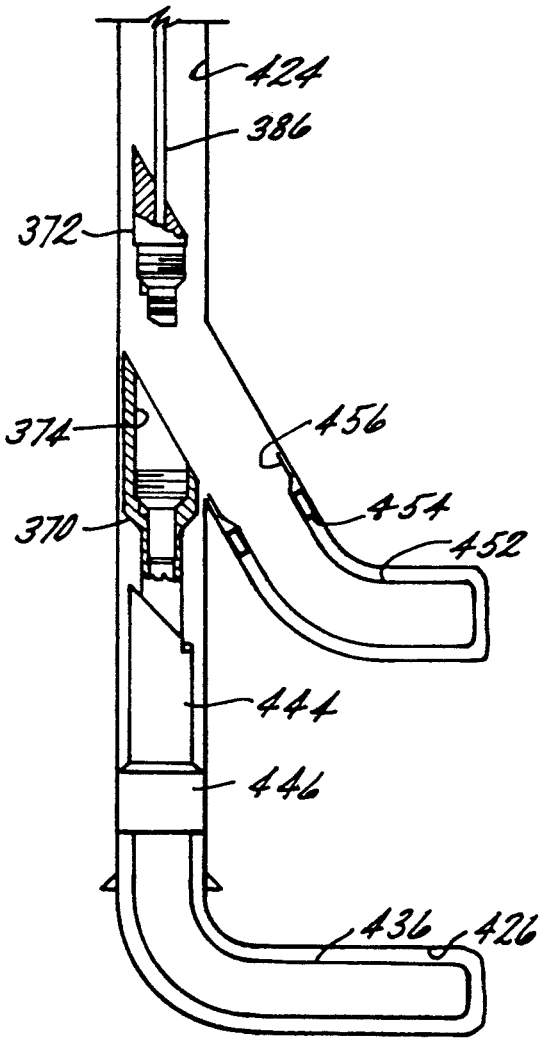
Figure 14I:
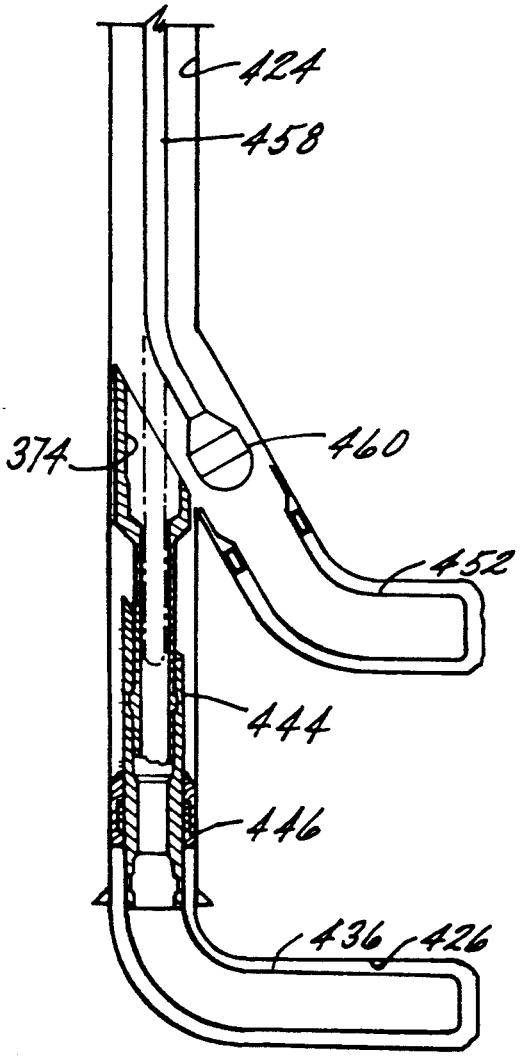

Thereafter, as shown in FIG. 14H, sealable whipstock plug 372 is retrieved using retrieving stinger 386 as was described with regard to the FIG. 13C embodiment. As a result, production whipstock 370 remains with an open axial bore 374. The resultant assembly in FIG. 14H provides several alternatives for re-entry, junction sealing and zone isolation. For example, in FIG. 14I, coiled tubing or threaded tubing 458 is run downhole and either stabbed into bore 374 of whipstock 370 or diverted into engagement with liner 452. Such selective re-entry is possible using suitable size selective devices (e.g., expandable nose diverter 460) as described above with regard to FIG. 13C. Thus, both wellbores may be produced (or injected into).

Figure 14J:
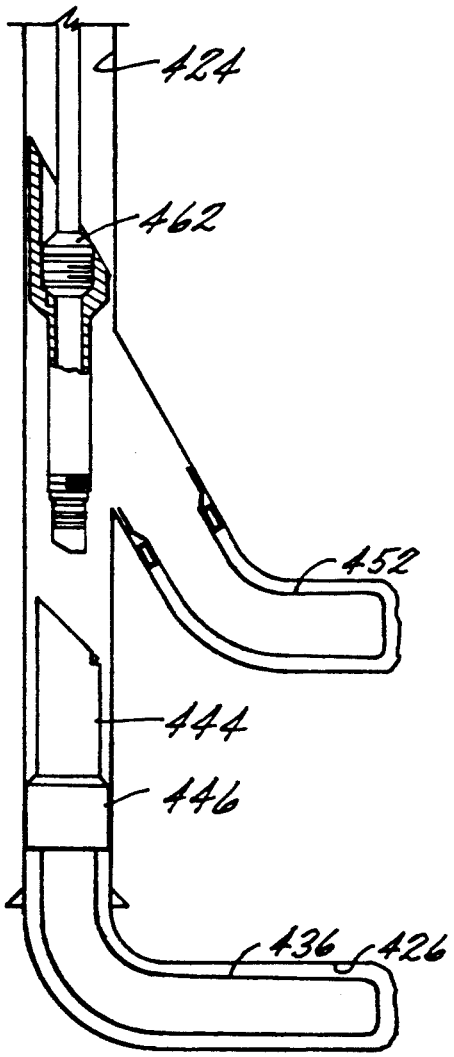
Figure 14K:
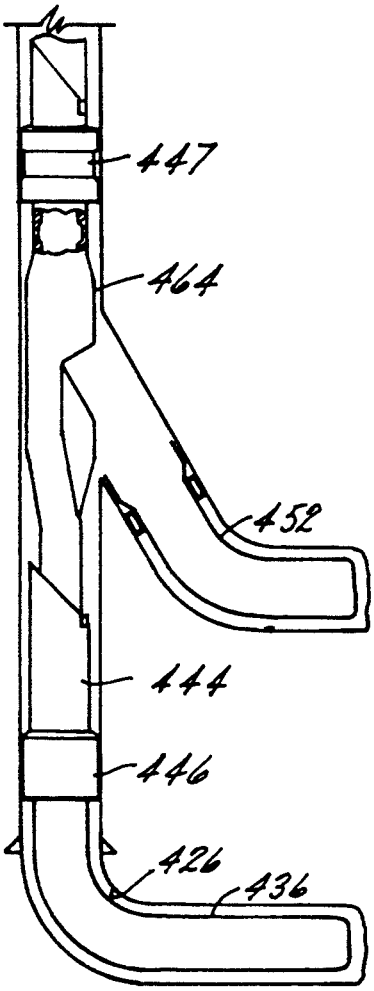
Figure 15C:
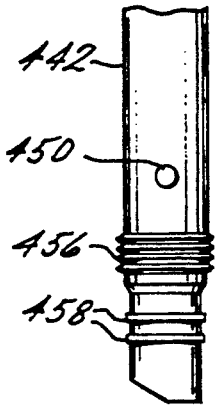
FIGS. 15A–D are elevation views partly in cross-section depicting an orientation device for the production whipstock of FIGS. 13A–B.
Figure 15A:
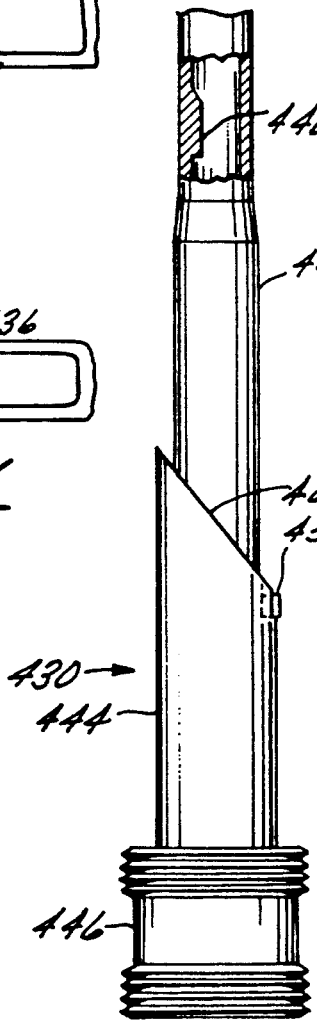
Figure 15B:
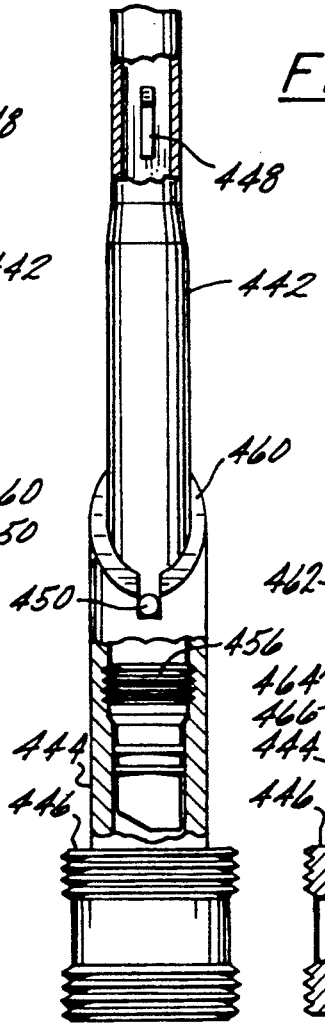
Figure 15D:
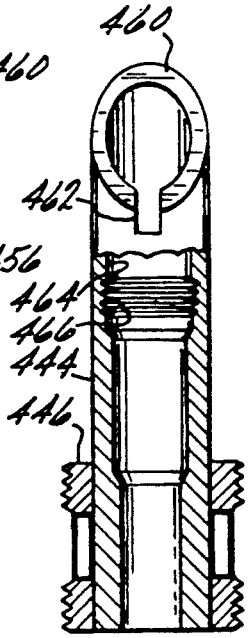

Alternatively, as shown in FIG. 14J, the entire whipstock assembly may be removed from well casing 424 by latching in retrieving tool 462 and pulling production whipstock 370. Thereafter, with reference to FIG. 14K, a diverter mandrel 464 is run into casing 424 and mated together with orientation device 444 and packer 446. A whipstock anchor packer or standard packer 447 may be used to support diverter mandrel 464 in well casing 424. As shown in more detail in FIGS. 16A–D, diverter mandrel 464 acts as a guide means in a manner similar to the embodiments shown in FIG. 6B.

Figure 16A:
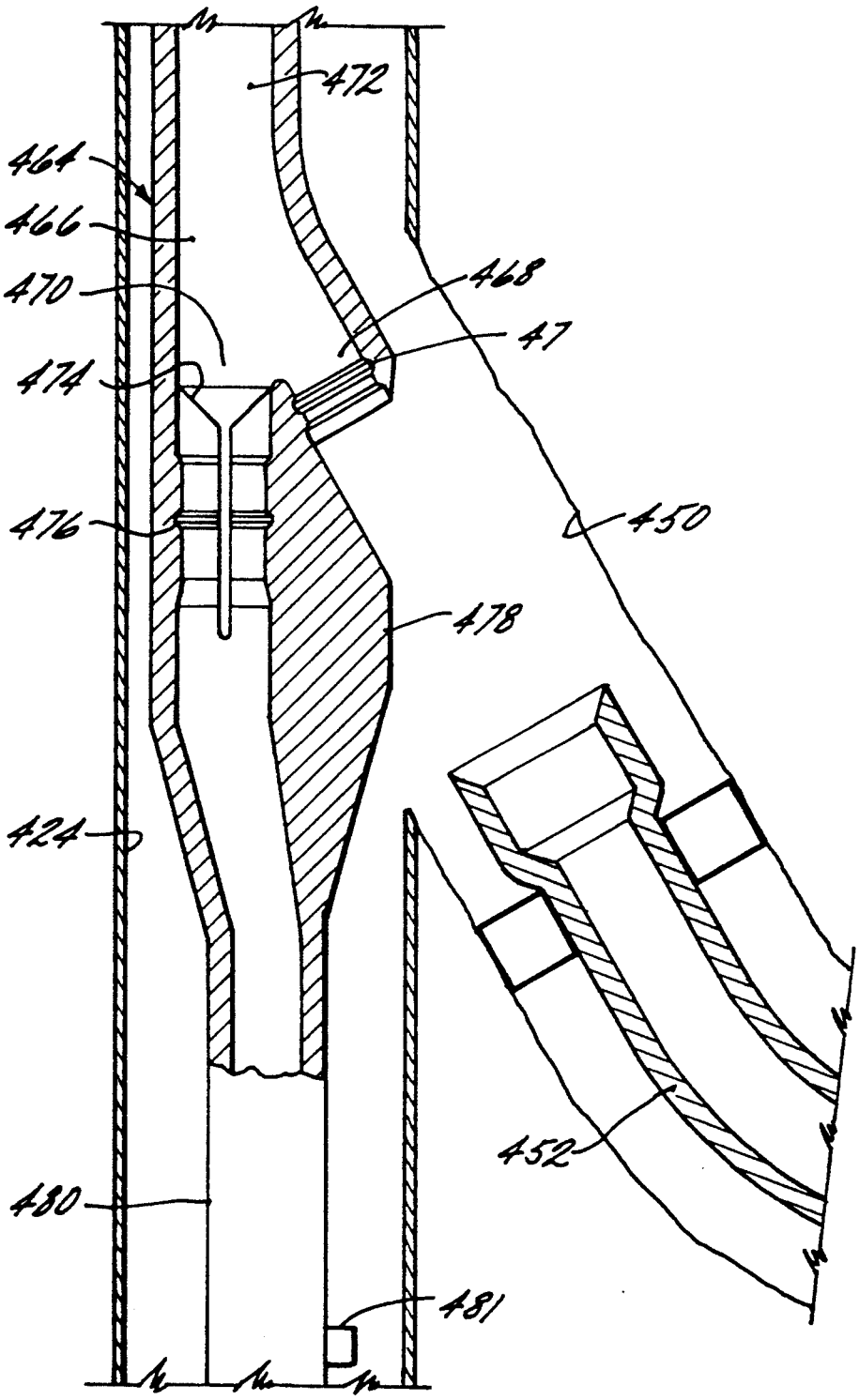
FIGS. 16A–C are sequential cross-sectional views showing in detail the diverter mandrel used in the method of FIGS. 14A–K.

In FIG. 16A, diverter mandrel 464 comprises a housing 466 having a generally inverted "Y" shape including Y branches 468, 470 and vertical branch 472. Branch 468 is adapted to be oriented towards lateral 450 and branch 470 is oriented toward the lower section of wellbore 424. Preferably, the internal diameter of branch 468 includes a nipple and seal profile 472. Branch 470 includes an orientation slot 474 for a diverter guide as well as a nipple and seal profile 476. Positioned directly below the exit of branch 468 is a diverter member 478. Finally, the lower most portion of mandrel 466 comprises an orientation device 480 and associated locator key 481 analogous to orientation device 398 on whipstock 370.

Figure 16D:
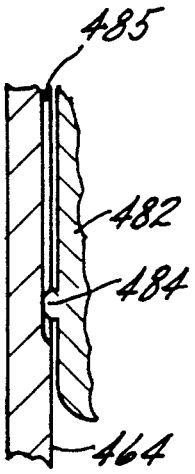
FIG. 16D is a cross-sectional elevation view along the line 16D—16D of FIG. 16B.
Figure 16B:
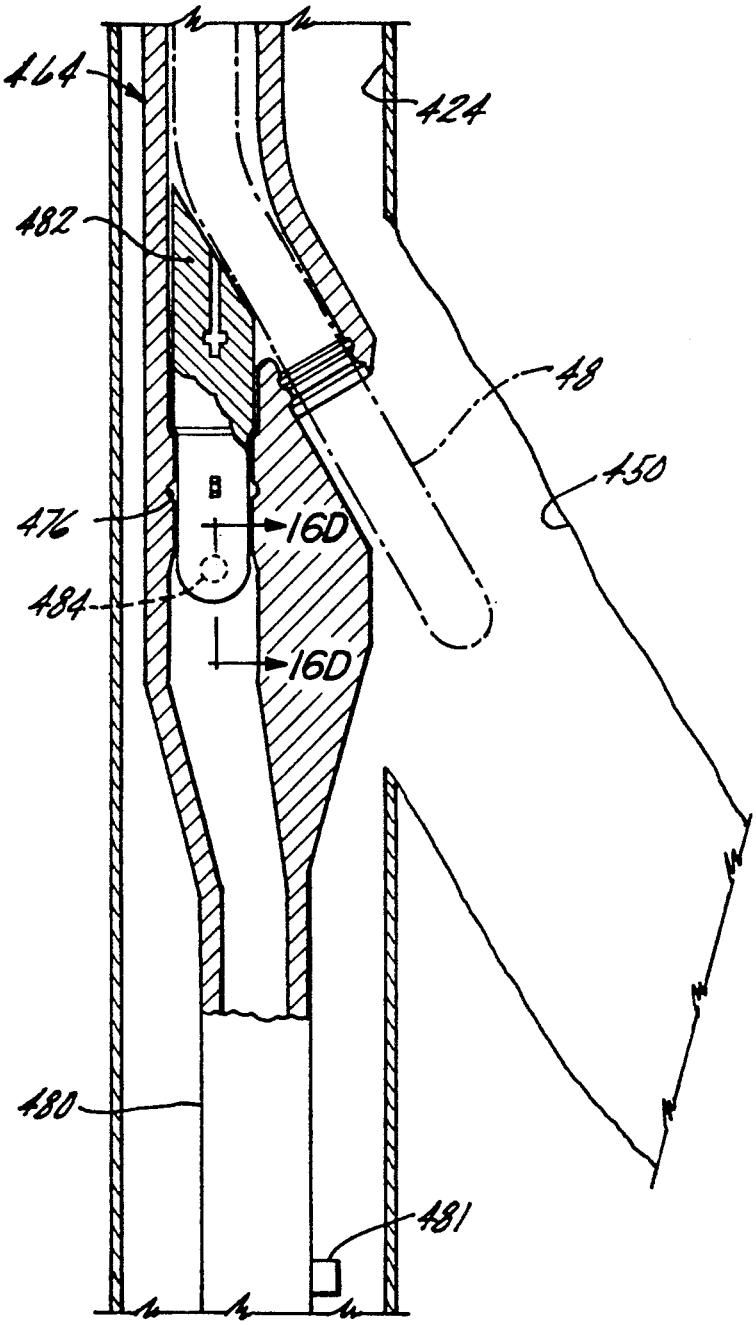

Mandrel 466 allows for selective re-entry, zone isolation and juncture sealing. In FIGS. 16B and D, a diverter guide 482 is run into slot 474 and locked into nipple profile 476 Diverter guide 482 is substantially similar to removable plug 372 (FIG. 13B) and, as best shown in FIG. 16D, is properly oriented by locating a pin 484 from guide 482 in a slot 484 in mandrel 466. In this way, tools are easily diverted into wellbore 450. Alternatively, known kick-over tools may be used (rather than diverter 482) to place tools 485 into lateral 450 for re-entry. It will be appreciated that diverter guide not only allows for re-entry, but also acts to isolate production zones.

Figure 16C:
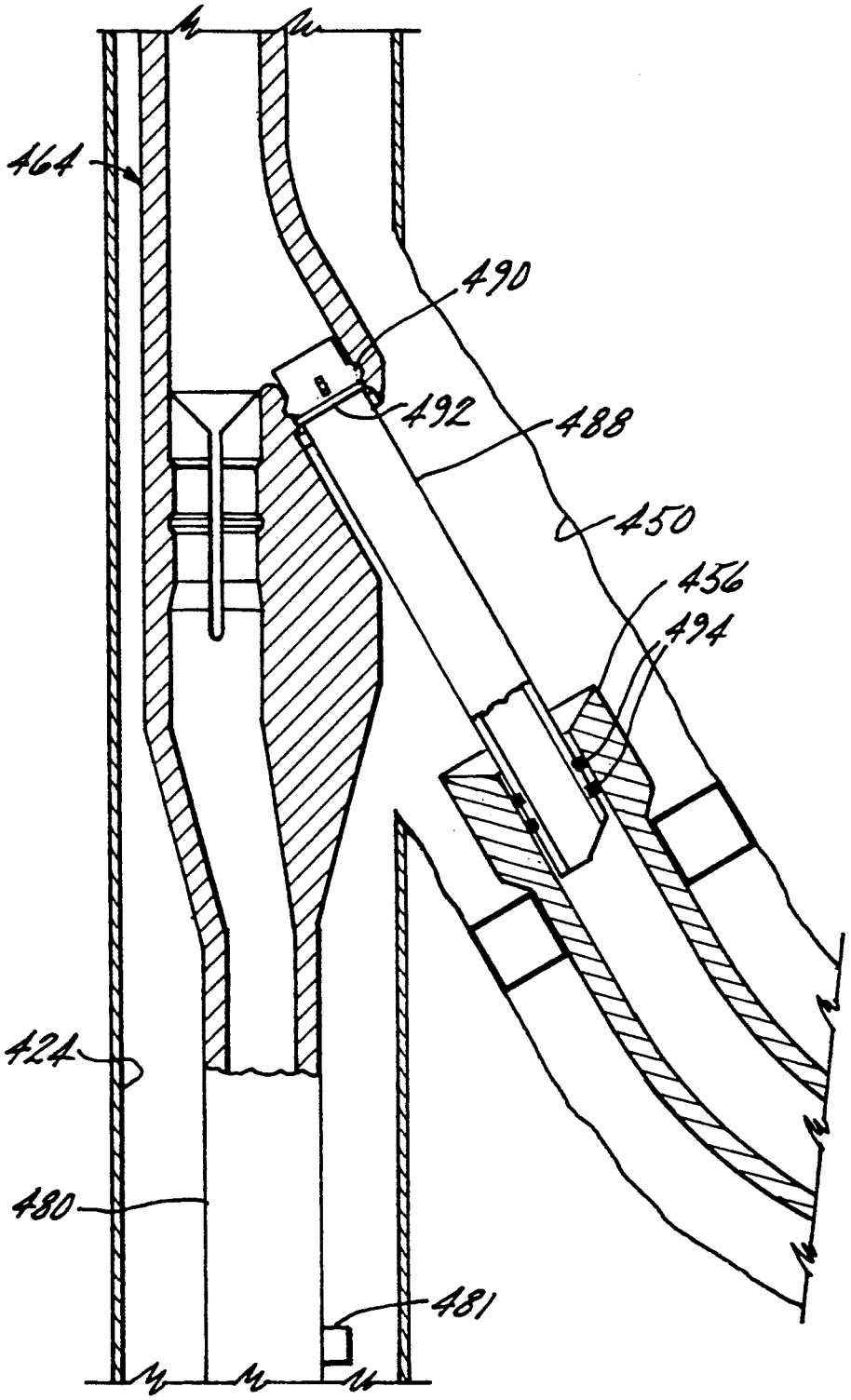

In FIG. 16C, a short section of tubing 488 is shown having latches 490 and first sealing means 492 on one end and second sealing means 494 on the other end. Tubing 488 may be run downhole and diverted into sealing engagement with sealing bore 456 so as to provide a sealed junction and thereby collapse of the formation from obstruction production or re-entry.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A method for selectively permitting passage of an object either through a primary borehole or through a first branch borehole wherein the primary borehole includes a casing having an interior space, including the steps of:

(1) positioning whipstock means in said interior space, said whipstock means having a bore therethrough to permit the passage of an object from a location in said primary borehole above said whipstock means to a location in said primary borehole below said whipstock means;

(2) connecting said whipstock means to said casing so as to position said whipstock means in a desired alignment with a branch borehole previously formed or to be formed;

(3) selectively permitting passage of an object either through said whipstock means bore or into said branch borehole; and (4) providing removable plug means in said bore of said whipstock means for selectively permitting passage of an object through said bore.

2. The method of claim 1 including the step of:

removing said plug means from said bore.

3. The method of claim including the step of:

removing said plug means from said bore by retrieving said plug means and returning said plug means to the surface.

4. The method of claim 3 including the step of:

removing said plug means from said bore by drilling or jetting through said plug means.

5. The method of claim 1 including:

releasably retaining said plug means in said bore.

6. The method of claim 1 including:

orienting said plug means within said bore with respect to a preselected orientation.

7. The method of claim 1 including the step of:

drilling said branch borehole while said plug means is positioned in said bore to prevent drilling debris from falling downhole in said primary borehole and to guide a drilling device.

8. The method of claim 1 including the step of:

using an upper surface of said whipstock means to access said branch borehole.

9. The method of claim 8 including a second branch borehole displaced from said first branch borehole and including the step of:

repositioning said whipstock means in said interior space to access said second branch borehole.

10. The method of claim 8 including the step of:

positioning a first string in said bore of said whipstock means; and providing a scooped section in said upper surface to support and divert a second string in said branch borehole.

11. The method of claim 1 including:

using packer means to support said whipstock means in said interior space.

12. The method of claim 11 wherein:

said whipstock means is releasably supported in said packer means.

13. The method of claim 11 including:

orienting said whipstock means within said packer means with respect to a preselected orientation.

14. The method of claim 8 including the step of:

selectively entering an object into said branch borehole to perform completion work, additional drilling, remedial work or stimulation work.

15. A method for selectively permitting passage of an object either through a primary borehole or through a first branch borehole wherein the primary borehole includes a casing having an interior space, including the steps of:

(1) positioning whipstock means in said interior space, said whipstock means having a bore therethrough to permit the passage of an object from a location in said primary borehole above said whipstock means to a location in said primary borehole below said whipstock means;

(2) connecting said whipstock means to said casing so as to position said whipstock means in a desired alignment with a branch borehole previously formed or to be formed;

(3) selectively permitting passage of an object either through said whipstock means bore or into said branch borehole;

(4) removing said whipstock means from said interior space; and 5) delivering diverter mandrel means into said interior space in desired alignment with the branch borehole.

16. The method of claim 15 wherein said diverter mandrel means includes at least one upper passageway and at least a first and second lower passageway, said first lower passageway being associated with diverter means for diverting an object into said branch borehole.

17. The method of claim 16 wherein:

said diverter mandrel means comprises an inverted Y with said first and second lower passageways defining the branches of the Y.

18. The method of claim 16 wherein:

said second lower passageway receives a diverter guide for diverting objects for entry into said first lower passageway.

19. The method of claim 18 wherein:

said lower passageway is configured to receive and retain said diverter guide.

20. The method of claim 18 wherein:

said diverter guide is retrievable from said lower passageway and acts to isolate the primary borehole downhole of the diverter mandrel means from the branch borehole.

21. The method of claim 16 including:

extendable tube means for connecting said first lower passageway to a liner in said branch borehole.

22. A method for accessing the intersection between a primary borehole and a one or more branch boreholes wherein said primary borehole has a casing comprising the steps of:

positioning a string in said primary borehole with said string terminating at an opening above the uppermost of said branch boreholes;

delivering inflatable whipstock/packer means through said string and out said string opening to a position proximate to a selected branch borehole previously formed or to be formed;

inflating said whipstock/packer means against said casing wherein objects may be deflected by said whipstock packer means into said selected branch borehole.

23. The method of claim 22 including the steps of:

deflating said whipstock/packer means and repositioning said whipstock/packer means to a position adjacent another branch borehole.

24. Apparatus selectively permitting passage of an object either through a primary borehole or through a branch borehole, comprising:

a casing located in a primary borehole and having an interior space;

whipstock means in said interior space, said whipstock means having a bore therethrough to permit the passage of an object from a location in said primary borehole above said whipstock means to a location in said primary borehole below said whipstock means;

connecting means for connecting said whipstock means to said casing so as to position said whipstock means in desired alignment with a branch borehole previously formed or to be formed; and selective passage means for selectively permitting passage of an object through said whipstock means bore or into said branch borehole wherein said selective passage means comprises removable plug means in said bore of said whipstock means for selectively permitting passage of an object through said bore.

25. The apparatus of claim 24 wherein said removable plug means includes:

retrieving means retrieving said plug means and returning said plug means to the surface.

26. The apparatus of claim 24 including:

means for releasably retaining said plug means in said bore.

27. The apparatus of claim 24 including:

means for orienting said plug means within said bore with respect to a preselected orientation.

28. The apparatus of claim 24 including:

a first string in said bore of said whipstock means; and a scooped section in said upper surface to support and divert a second string in said branch borehole 29. The apparatus of claim 24 including:

packer means to support said whipstock means in said interior space.

30. The apparatus of claim 29 including:

releasable supporting means for releasable supporting said whipstock means in said packer means.

31. The apparatus of claim 30 including:

means for orienting said whipstock means within said packer means with respect to a preselected orientation.

32. Apparatus for accessing the intersection between a primary borehole and a one or more branch boreholes wherein said primary borehole has a casing, comprising:

a string positioned in said primary borehole with said string terminating at an opening above the uppermost of said branch boreholes;

inflatable whipstock/packer means delivered through said string and out said string opening to a position adjacent a selected branch borehole;

said whipstock/packer means being inflated against said casing wherein objects may be deflected by said whipstock packer means into said selected branch borehole.

* * * * *